US010876181B2

(12) United States Patent
Takeda et al.

(10) Patent No.: US 10,876,181 B2
(45) Date of Patent: Dec. 29, 2020

(54) COLD-ROLLED STEEL SHEET AND METHOD OF MANUFACTURING SAME

(71) Applicant: NIPPON STEEL & SUMITOMO METAL CORPORATION, Tokyo (JP)

(72) Inventors: Kengo Takeda, Kitakyushu (JP); Kunio Hayashi, Kimitsu (JP); Akihiro Uenishi, Kisarazu (JP); Masafumi Azuma, Tokai (JP); Takayuki Nozaki, Chita (JP); Yuri Toda, Kimitsu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 639 days.

(21) Appl. No.: 15/549,468

(22) PCT Filed: Feb. 24, 2016

(86) PCT No.: PCT/JP2016/055428
§ 371 (c)(1),
(2) Date: Aug. 8, 2017

(87) PCT Pub. No.: WO2016/136810
PCT Pub. Date: Sep. 1, 2016

(65) Prior Publication Data

US 2018/0023155 A1 Jan. 25, 2018

(30) Foreign Application Priority Data

Feb. 24, 2015 (JP) ..... 2015/034137
Feb. 24, 2015 (JP) ..... 2015-034234
(Continued)

(51) Int. Cl.
*C21D 8/12* (2006.01)
*C21D 8/02* (2006.01)
(Continued)

(52) U.S. Cl.
CPC ..... *C21D 8/1233* (2013.01); *C21D 8/02* (2013.01); *C21D 8/0436* (2013.01); *C21D 9/46* (2013.01);
(Continued)

(58) Field of Classification Search
CPC ..... C21D 8/1233; C21D 8/02; C21D 9/46; C21D 8/0436; C21D 8/0226;
(Continued)

(56) References Cited

U.S. PATENT DOCUMENTS

2005/0247378 A1 11/2005 Ikeda et al.
2014/0000765 A1* 1/2014 Nozaki ..... C21D 8/0226 148/504
(Continued)

FOREIGN PATENT DOCUMENTS

CN 103781932 A 5/2014
CN 104245988 A 12/2014
(Continued)

OTHER PUBLICATIONS

Extended European Search Report for counterpart Application No. 16755554.9, dated Oct. 12, 2018.
(Continued)

*Primary Examiner* — John A Hevey
(74) *Attorney, Agent, or Firm* — Birch, Stewart, Kolasch & Birch, LLP

(57) ABSTRACT

In a cold-rolled steel sheet having a predetermined chemical composition, a metallographic structure contains 40.0% or more and less than 60.0% of a polygonal ferrite, 30.0% or more of a bainitic ferrite, 10.0% to 25.0% of a residual austenite, and 15.0% or less of a martensite, by an area ratio, in the residual austenite, a proportion of the residual austenite in which an aspect ratio is 2.0 or less, a length of a long axis is 1.0 μm or less, and a length of a short axis is 1.0
(Continued)

μm or less, is 80.0% or more, in the bainitic ferrite, a proportion of the bainitic ferrite in which an aspect ratio is 1.7 or less and an average value of a crystal orientation difference in a region surrounded by a boundary in which a crystal orientation difference is 15° or more is 0.5° or more and less than 3.0°, is 80.0% or more, and a connection index D value of the martensite, the bainitic ferrite, and the residual austenite is 0.70 or less.

11 Claims, 2 Drawing Sheets

(30) Foreign Application Priority Data

Jul. 13, 2015 (JP) ..... 2015-139687
Jul. 13, 2015 (JP) ..... 2015-139888

(51) Int. Cl.

| | |
|---|---|
| ***C21D 9/46*** | (2006.01) |
| ***C22C 38/60*** | (2006.01) |
| ***C21D 8/04*** | (2006.01) |
| ***C22C 38/18*** | (2006.01) |
| ***C22C 38/14*** | (2006.01) |
| ***C22C 38/00*** | (2006.01) |
| ***C22C 38/02*** | (2006.01) |
| ***C22C 38/38*** | (2006.01) |
| ***C22C 38/12*** | (2006.01) |
| ***C22C 38/24*** | (2006.01) |
| ***C22C 38/34*** | (2006.01) |
| ***C22C 38/28*** | (2006.01) |
| ***C22C 38/04*** | (2006.01) |
| ***C22C 38/06*** | (2006.01) |
| ***C22C 38/26*** | (2006.01) |
| ***C22C 38/22*** | (2006.01) |

(52) U.S. Cl.
CPC ..... *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/22* (2013.01); *C22C 38/24* (2013.01); *C22C 38/26* (2013.01); *C22C 38/28* (2013.01); *C22C 38/34* (2013.01); *C22C 38/38* (2013.01); *C22C 38/60* (2013.01)

(58) Field of Classification Search
CPC .. C21D 8/0236; C21D 8/0247; C21D 8/0263; C21D 2211/005; C21D 2211/001; C22C 38/60; C22C 38/02; C22C 38/04; C22C 38/06; C22C 38/14; C22C 38/12; C22C 38/18; C22C 38/22; C22C 38/24; C22C 38/26; C22C 38/28; C22C 38/34; C22C 38/38; C23C 2/06
See application file for complete search history.

(56) References Cited

U.S. PATENT DOCUMENTS

| | | | | |
|---|---|---|---|---|
| 2014/0087208 | A1 | 3/2014 | Toda et al. | |
| 2014/0241933 | A1 | 8/2014 | Haga | |
| 2015/0037610 | A1* | 2/2015 | Hata | C21D 8/0205 428/684 |
| 2016/0017465 | A1 | 1/2016 | Toda et al. | |
| 2016/0177414 | A1 | 6/2016 | Takashima et al. | |
| 2016/0177427 | A1 | 6/2016 | Takashima et al. | |

FOREIGN PATENT DOCUMENTS

| | | | | |
|---|---|---|---|---|
| EP | 2256224 | A1 | 12/2010 | |
| EP | 2692895 | A1 | 2/2014 | |
| EP | 2695961 | A1 | 2/2014 | |
| EP | 2765212 | A1 | 8/2014 | |
| GB | 2477419 | A | 8/2011 | |
| JP | 2004-292891 | A | 10/2004 | |
| JP | 2005-200694 | A | 7/2005 | |
| JP | 2007-154283 | A | 6/2007 | |
| JP | 2011-149066 | A | 8/2011 | |
| JP | 2011-214081 | A | 10/2011 | |
| JP | 2012-122093 | A | 6/2012 | |
| JP | 5397569 | B2 | 1/2014 | |
| JP | 5408383 | B2 | 2/2014 | |
| JP | 5589893 | B2 | 9/2014 | |
| JP | 2015-14026 | A | 1/2015 | |
| JP | 2015-34327 | A | 2/2015 | |
| MX | 2013011063 | A | 10/2013 | |
| TW | 201502286 | A | 1/2015 | |
| WO | WO 2013/125400 | A1 | 8/2013 | |
| WO | WO-2013125400 | A1 * | 8/2013 | C21D 8/0236 |
| WO | WO 2015/019557 | A1 | 2/2015 | |

OTHER PUBLICATIONS

International Search Report for PCT/JP2016/055428 dated May 31, 2016.
Office Action for TW 105105456 dated Sep. 23, 2016.
Written Opinion of the International Searching Authority for PCT/JP2016/055428 (PCT/ISA/237) dated May 31, 2016.
Chinese Office Action dated Jun. 5, 2018, issued in Chinese Patent Application 201680010935.5.

* cited by examiner

COLD-ROLLED STEEL SHEET AND METHOD OF MANUFACTURING SAME

TECHNICAL FIELD OF THE INVENTION

The present invention relates to a cold-rolled steel sheet and a method of manufacturing the same, particularly to a high-strength cold-rolled steel sheet having excellent ductility, hole expansibility, and punching fatigue properties, mainly for automobile components or the like, and a method of manufacturing the same. Priority is claimed on Japanese Patent Application No. 2015-034137, filed on Feb. 24, 2015, Japanese Patent Application No. 2015-034234, filed on Feb. 24, 2015, Japanese Patent Application No. 2015-139888, filed on Jul. 13, 2015, and Japanese Patent Application No. 2015-139687, filed on Jul. 13, 2015, the contents of which are incorporated herein by reference.

RELATED ART

In order to suppress emissions of carbon dioxide gas from a vehicle, it is desirable to reduce the weight of a vehicle body by employing a high-strength steel sheet. In addition, to ensure the safety of an occupant, a high-strength steel sheet has been widely used instead of a soft steel sheet in the vehicle body.

Henceforth, in order to further reduce the weight of the vehicle body, it is necessary to increase a strength level of the high-strength steel sheet to be equal to or higher than that of the related art. However, in general, when strength of the steel sheet is increased, formability deteriorates. In order to use the steel sheet as a vehicle member, it is necessary to perform various forming processes, and thus, it is also necessary to improve formability in addition to the strength for forming the high-strength steel sheet as the vehicle member.

In addition, in weight reduction of a component for a mechanical structure that configures a vehicle or the like, thickness reduction of the component by achieving a high strength of steel to be used and volume reduction of the component itself by forming a piercing hole are efficient. However, in forming the piercing hole, it is preferable to employ punching on an industrial scale, but excessive stress and strain are concentrated on an end surface of a punching portion. Therefore, in particular, in the high-strength steel sheet, in a case of performing the punching, there is a problem in that voids are generated on a boundary of a low-temperature transformation phase or residual austenite, and punching fatigue properties deteriorate.

For example, in a case of using the high-strength steel sheet in a frame component, elongation and hole expansibility as above described formability are required in the steel sheet. Therefore, in the related art, in the high-strength steel sheet, several means for improving elongation and hole expansibility are suggested.

For example, in Patent Document 1, a high-strength steel sheet which uses residual austenite as a metallographic structure of the steel sheet for improving ductility is disclosed. In the steel sheet of Patent Document 1, it is disclosed that a steel sheet in which ductility of the high-strength steel sheet is improved by increasing stability of the residual austenite. However, the punching fatigue properties are not considered, a morphology of an optimal metallographic structure for improving elongation, hole expansibility, and punching fatigue properties is not apparent, and none of the control methods thereof are disclosed.

In Patent Document 2, in order to improve hole expansibility, a cold-rolled steel sheet of which a texture of the metallographic structure of the steel sheet is reduced is disclosed. However, punching fatigue properties are not considered, and a structure for improving elongation, hole expansibility, and punching fatigue properties and a control technology thereof are not disclosed.

In Patent Document 3, a high-strength cold-rolled steel sheet which includes a low-temperature transformation generation phase as a main phase and in which the fraction of ferrite is reduced in a steel sheet containing ferrite, bainite, and residual austenite, in order to improve local elongation, is disclosed. However, in the cold-rolled steel sheet of Patent Document 3, since the metallographic structure of the steel sheet includes the low-temperature transformation generation phase as a main phase, voids are generated on a boundary of a low-temperature transformation generation phase or the residual austenite in a sheet end surface portion when performing punching, and in a fatigue environment where a repeating stress is loaded to a punching hole, it is difficult to ensure high fatigue properties.

As described above, in the related art, in the high-strength steel sheet, the ductility and the hole expansibility are increased at the same time, and further, it is extremely difficult to ensure the fatigue properties (punching fatigue properties) in the fatigue environment where the repeating stress is loaded to the punching hole.

PRIOR ART DOCUMENT

Patent Document

[Patent Document 1] Japanese Patent No. 5589893
[Patent Document 2] Japanese Patent No. 5408383
[Patent Document 3] Japanese Patent No. 5397569

DISCLOSURE OF THE INVENTION

Problems to be Solved by the Invention

As described above, in order to further reduce the weight of the vehicle body, it is necessary to increase a use strength level of the high-strength steel sheet to be equal to or higher than that of the related art. In addition, for example, for using the high-strength steel sheet in a frame component of the vehicle body, it is necessary to achieve both high elongation and hole expansibility. In addition, even when the elongation and the hole expansibility are excellent, even when punching fatigue properties deteriorate, the component is not preferable as the frame component of the vehicle component.

In addition, in particular, among the frame components, after a member, such as a side sill, is formed as a member, collision safety is required. In other words, in the member, such as a side sill, excellent workability is acquired when forming the member, and after forming the member, collision safety is required.

In order to ensure the collision safety, not only a high tensile strength but also a high 0.2% proof stress is also required. However, in the high-strength steel sheet for a vehicle, it is extremely difficult to satisfy all of a high tensile strength, a high 0.2% proof stress, excellent ductility, and excellent hole expansibility.

The present invention has been made in consideration of the circumstances of the related art, and an object thereof is to provide a high-strength cold-rolled steel sheet in which a tensile strength is 980 MPa or more and 0.2% proof stress is 600 MPa or more, and which has excellent elongation and hole expansibility while ensuring sufficient punching fatigue properties, and a method of manufacturing the same. In the present invention, excellent elongation indicates that the total elongation is 21.0% and excellent hole expansibility indicates that a hole expansion ratio is 30.0% or more.

Means for Solving the Problem

Currently, the present inventors have thoroughly studied in order to ensure high-strength, high elongation, and excellent hole expansibility while ensuring punching fatigue properties on the assumption of a manufacturing process which can be achieved by using a continuous hot rolling facility and a continuous annealing facility which are generally employed. As a result, the following knowledge was obtained.

(a) In the high-strength cold-rolled steel sheet of which the tensile strength is 980 MPa or more, by controlling an area ratio of polygonal ferrite in the metallographic structure of the steel sheet, and by further controlling morphology of the residual austenite, it is possible to achieve excellent ductility. Specifically, the local elongation is improved by increasing a structure fraction of ferrite, and uniform elongation is improved by the residual austenite. Therefore, by combining metallographic structures, it is possible to significantly improve ductility of a high-strength steel sheet of the related art.

(b) By controlling the morphology of the residual austenite and by controlling the disposition of a hard structure, it is possible to further ensure high ductility and excellent hole expansibility. Specifically, by controlling a manufacturing condition such that the morphology of the residual austenite becomes granular, it is possible to suppress generation of voids on an interface between the soft structure and the hard structure during the hole expansion. In general, since the residual austenite included in the high-strength steel sheet has a shape of a sheet, the stress is concentrated in an edge portion of the sheet-shaped austenite, and the generation of voids from the interface with the ferrite during the hole expansion is caused. In other words, the voids generated from the interface are particularly likely to be generated from an edge of the austenite after transformation to martensite. Therefore, by making the residual austenite granular, stress concentration is mitigated, and thus, even when the ferrite fraction is high, it is possible to prevent deterioration of hole expansibility.

(c) Furthermore, by controlling a dispersive state of the hard structure in the metallographic structure of the steel sheet, the hole expansibility is improved. As described above, the voids generated during the hole expansion are generated from the edge portion of the hard structure or a connected portion of the hard structure, and the voids are coupled to each other and become a crack. The crack generated from an edge portion of the hard structure can be suppressed by controlling the morphology of the residual austenite. Specifically, by controlling the disposition of the hard structure such that connection index of the hard structure decrease, it is possible to suppress the crack generated from the connected portion of the hard structure, and to further achieve improvement of hole expansibility. In addition, by controlling the connection index to be low, the punching fatigue properties also become excellent.

The gist of the present invention is as follows based on the above-described knowledge.

(1) According to an aspect of the present invention, a cold-rolled steel sheet is provided, including, as a chemical composition, in % by mass: C: 0.100% or more and less than 0.500%; Si: 0.8% or more and less than 4.0%; Mn: 1.0% or more and less than 4.0%; P: less than 0.015%; S: less than 0.0500%; N: less than 0.0100%; Al: less than 2.000%; Ti: 0.020% or more and less than 0.150%; Nb: 0% or more and less than 0.200%; V: 0% or more and less than 0.500%; B: 0% or more and less than 0.0030%; Mo: 0% or more and less than 0.500%; Cr: 0% or more and less than 2.000%; Mg: 0% or more and less than 0.0400%; Rem: 0% or more and less than 0.0400%; Ca: 0% or more and less than 0.0400%; and a remainder of Fe and impurities, in which the total amount of Si and Al is 1.000% or more, in which a metallographic structure contains 40.0% or more and less than 60.0% of a polygonal ferrite, 30.0% or more of a bainitic ferrite, 10.0% to 25.0% of a residual austenite, and 15.0% or less of a martensite, by an area ratio, in which, in the residual austenite, a proportion of the residual austenite in which an aspect ratio is 2.0 or less, a length of a long axis is 1.0 μm or less, and a length of a short axis is 1.0 μm or less, is 80.0% or more, in which, in the bainitic ferrite, a proportion of the bainitic ferrite in which an aspect ratio is 1.7 or less and an average value of a crystal orientation difference in a region surrounded by a boundary in which a crystal orientation difference is 15° or more is 0.5° or more and less than 3.0°, is 80.0% or more, in which a connection index D value of the martensite, the bainitic ferrite, and the residual austenite is 0.70 or less, and in which a tensile strength is 980 MPa or more, a 0.2% proof stress is 600 MPa or more, a total elongation is 21.0% or more, and a hole expansion ratio is 30.0% or more.

(2) In the cold-rolled steel sheet according to (1), the connection index D value may be 0.50 or less and the hole expansion ratio is 50.0% or more.

(3) The cold-rolled steel sheet according to (1) or (2), may include, as the chemical composition, in % by mass: one or two or more of Nb: 0.005% or more and less than 0.200%; V: 0.010% or more and less than 0.500%; B: 0.0001% or more and less than 0.0030%; Mo: 0.010% or more and less than 0.500%; Cr: 0.010% or more and less than 2.000%; Mg: 0.0005% or more and less than 0.0400%; Rem: 0.0005% or more and less than 0.0400%; and Ca: 0.0005% or more and less than 0.0400%.

(4) According to another aspect of the present invention, a hot-rolled steel sheet which is used for manufacturing the cold-rolled steel sheet according to any one of (1) to (3) is provided, including, as a chemical composition, in % by mass: C: 0.100% or more and less than 0.500%; Si: 0.8% or more and less than 4.0%; Mn: 1.0% or more and less than 4.0%; P: less than 0.015%; S: less than 0.0500%; N: less than 0.0100%; Al: less than 2.000%; Ti: 0.020% or more and less than 0.150%; Nb: 0% or more and less than 0.200%; V: 0% or more and less than 0.500%; B: 0% or more and less than 0.0030%; Mo: 0% or more and less than 0.500%; Cr: 0% or more and less than 2.000%; Mg: 0% or more and less than 0.0400%; Rem: 0% or more and less than 0.0400%; Ca: 0% or more and less than 0.0400%; and a remainder of Fe and impurities, in which the total amount of Si and Al is 1.000% or more, in which a metallographic structure contains a bainitic ferrite, in which, in the bainitic ferrite, an area ratio of the bainitic ferrite in which an average value of a crystal orientation difference in a region surrounded by a boundary in which a crystal orientation difference is 15° or more is 0.5° or more and less than 3.0°, is 80.0% or more, and in which a connection index E value of pearlite is 0.40 or less.

(5) According to still another aspect of the present invention, a method of manufacturing a cold-rolled steel sheet is provided, the method including: casting a steel ingot or a slab including, as a chemical composition, C: 0.100% or more and less than 0.500%, Si: 0.8% or more and less than 4.0%, Mn: 1.0% or more and less than 4.0%, P: less than 0.015%, S: less than 0.0500%, N: less than 0.0100%, Al: less than 2.000%, Ti: 0.020% or more and less than 0.150%, Nb: 0% or more and less than 0.200%, V: 0% or more and less than 0.500%, B: 0% or more and less than 0.0030%, Mo: 0% or more and less than 0.500%, Cr: 0% or more and less than 2.000%, Mg: 0% or more and less than 0.0400%, Rem: 0% or more and less than 0.0400%, Ca: 0% or more and less than 0.0400%, and a remainder of Fe and impurities, in which the total amount of Si and Al is 1.000% or more; hot rolling including a rough rolling in which the steel ingot or the slab is reduced at 40% or more in total in a first temperature range of 1000° C. to 1150° C., and a finish rolling in which the steel ingot or the slab is reduced at 50% or more in total in a second temperature range of T1° C. to T1+150° C. and the hot rolling being finished at T1−40° C. or more to obtain a hot-rolled steel sheet when a temperature determined by compositions specified in the following Equation (a) is set to be T1; first cooling of cooling the hot-rolled steel sheet after the hot rolling at a cooling rate of 20° C./s to 80° C./s to a third temperature range of 600° C. to 650° C.; holding the hot-rolled steel sheet after the first cooling for time t seconds to 10.0 seconds determined by the following Equation (b) in the third temperature range of 600° C. to 650° C.; second cooling of cooling the hot-rolled steel sheet after the holding, to 600° C. or less; coiling the hot-rolled steel sheet at 600° C. or less so that in a microstructure of the hot-rolled steel sheet after coiling, the connection index E value of the pearlite is 0.40 or less, and in the bainitic ferrite, an area ratio of the bainitic ferrite in which an average value of a crystal orientation difference in a region surrounded by a boundary in which a crystal orientation difference is 15° or more is 0.5° or more and less than 3.0°, is 80.0% or more to obtain the hot-rolled steel sheet; pickling the hot-rolled steel sheet; cold rolling the hot-rolled steel sheet after the pickling so that a cumulative rolling reduction is 40.0% to 80.0% to obtain a cold-rolled steel sheet; annealing of holding the cold-rolled steel sheet after the cold rolling for 30 to 600 seconds in a fourth temperature range after raising the temperature to the fourth temperature range of T1−50° C. to 960° C.; third cooling of cooling the cold-rolled steel sheet after the annealing at a cooling rate of 1.0° C./s to 10.0° C./s to a fifth temperature range of 600° C. to 720° C.; and heat treating of holding the cold-rolled steel sheet for 30 seconds to 600 seconds after cooling the temperature to a sixth temperature range of 150° C. to 500° C. at the cooling rate of 10.0° C./s to 60.0° C./s.

$$T1(^\circ\,C.)=920+40\times C^2-80\times C+Si^2+0.5\times Si+0.4\times Mn^2-9\times Mn+10\times Al+200\times N^2-30\times N-15\times Ti \quad \text{Equation (a)}$$

$$t(\text{seconds})=1.6+(10\times C+Mn-20\times Ti)/8 \quad \text{Equation (b)}$$

here, element symbols in the equations indicate the amount of elements in % by mass.

(6) In the method of manufacturing a cold-rolled steel sheet according to (5), the steel sheet may be coiled at 100° C. or less in the coiling.

(7) The method of manufacturing a cold-rolled steel sheet according to (6) may include holding the hot-rolled steel sheet for 10 seconds to 10 hours after the temperature to a seventh temperature range of 400° C. to an Al transformation point between the coiling and the pickling.

(8) The method of manufacturing a cold-rolled steel sheet according to any one of (5) to (7) may include: reheating the cold-rolled steel sheet to a temperature range of 150° C. to 500° C. before holding the cold-rolled steel sheet for 1 second or more after cooling the cold-rolled steel sheet to the sixth temperature range in the heat treating.

(9) The method of manufacturing a cold-rolled steel sheet according to any one of (5) to (8) may further include: hot-dip galvanizing the cold-rolled steel sheet after the heat treating.

(10) The method of manufacturing a cold-rolled steel sheet according to (9) may include: alloying of performing the heat treatment within an eighth temperature range of 450° C. to 600° C. after the hot-dip galvanizing.

Effects of the Invention

According to the above-described aspects of the present invention, it is possible to provide a high-strength cold-rolled steel sheet which is appropriate as a structure member of a vehicle or the like, and in which a tensile strength is 980 MPa or more, 0.2% proof stress is 600 MPa or more, and punching fatigue properties, elongation, and hole expansibility are excellent.

EMBODIMENTS OF THE INVENTION

Figure 1:
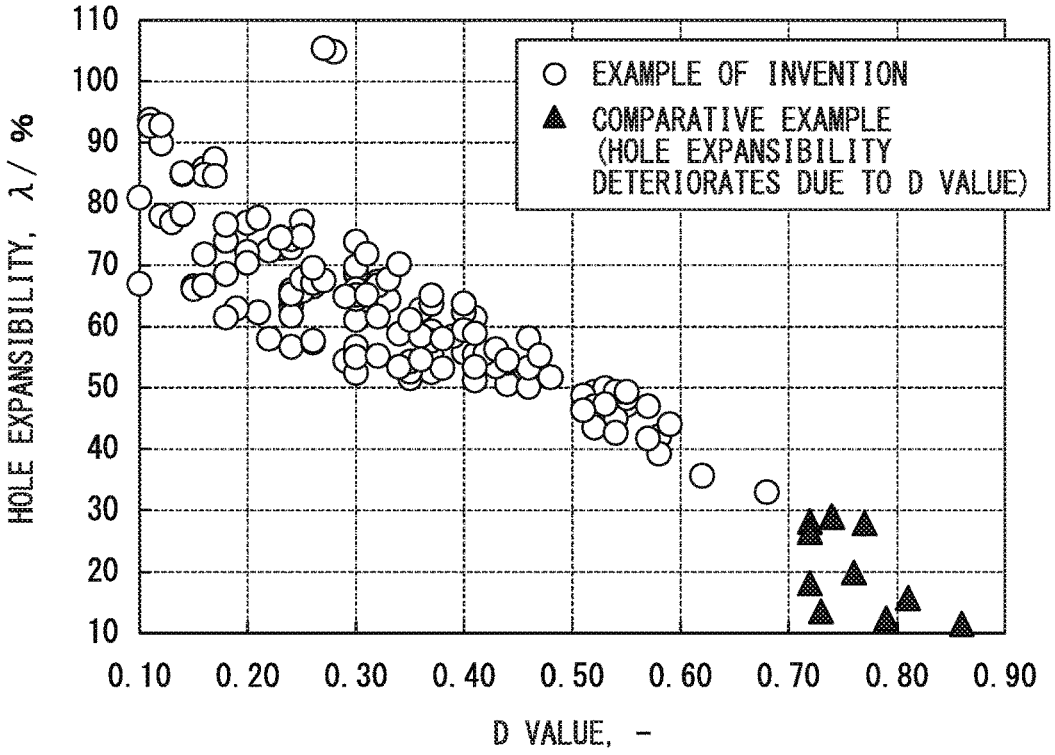
FIG. 1 is a graph illustrating a relationship between a D value and a hole expansion ratio (%).

Hereinafter, a cold-rolled steel sheet according to an embodiment of the present invention (hereinafter, sometimes referred to as steel sheet according to the embodiment) will be described.

First, a metallographic structure of the steel sheet according to the embodiment and a morphology thereof will be described.

[40.0% or More and Less than 60.0% of Polygonal Ferrite by Area Ratio]

Polygonal ferrite contained in the metallographic structure of the steel sheet is likely to be deformed since the structure is soft, and contributes to improving ductility. In order to improve both uniform elongation and local elongation, a lower limit of an area ratio of the polygonal ferrite is set to be 40.0%. Meanwhile, when the polygonal ferrite is 60.0% or more, 0.2% proof stress significantly deteriorates. Therefore, the area ratio of the polygonal ferrite is set to be less than 60.0%. The area ratio is preferably less than 55.0%, and is more preferably less than 50.0%.

Coarse ferrite that exceeds 15 μm yields in advance of fine ferrite, and causes micro plastic instability. Therefore, in the above-described polygonal ferrite, the maximum grain size is preferably 15 μm or less.

[10.0% or More and 25.0% or Less of Residual Austenite by Area Ratio]

Since residual austenite is strain-induced-transformed, the residual austenite is a metallographic structure that contributes to improving uniform elongation. In order to obtain the effect, the area ratio of the residual austenite is set to be 10.0% or more. The area ratio is preferably 15.0% or more. When the area ratio of the residual austenite is less than 10.0%, the effect is not sufficiently obtained, and it becomes difficult to obtain target ductility. Meanwhile, when the area ratio of the residual austenite exceeds 25.0%, the 0.2% proof stress becomes less than 600 MPa, and thus, the upper limit thereof is set to be 25.0%.

[30.0% or More of Bainitic Ferrite by Area Ratio]

Bainitic ferrite is efficient in ensuring 0.2% proof stress. In order to ensure 600 MPa or more of the 0.2% proof stress, the bainitic ferrite is set to be 30.0% or more. In addition, the bainitic ferrite is also a metallographic structure necessary for ensuring a predetermined amount of residual austenite. In the steel sheet according to the embodiment, as the result of transformation from the austenite to the bainitic ferrite, carbon diffuses to untransformed austenite and is concentrated. When the carbon concentration increases by the concentration of carbon, the temperature in which the austenite transforms to martensite becomes equal to or lower than room temperature, and thus, the residual austenite can stably exist at room temperature. In order to ensure 10.0% or more of the residual austenite by an area ratio as the metallographic structure of the steel sheet, it is preferable to ensure 30.0% or more of the bainitic ferrite by an area ratio.

When the area ratio of the bainitic ferrite becomes less than 30.0%, the 0.2% proof stress decreases, the carbon concentration in the residual austenite decreases, and the transformation to the martensite is likely to be caused at room temperature. In this case, it is not possible to obtain a predetermined amount of residual austenite, and it becomes difficult to obtain the target ductility.

Meanwhile, when the area ratio of the bainitic ferrite becomes 50.0% or more, it is not possible to ensure 40.0% or more of the polygonal ferrite and 10.0% or more of the residual austenite, and thus, the upper limit thereof is preferably 50.0% or less.

[15.0% or Less of Martensite by Area Ratio]

In the embodiment, the martensite indicates fresh martensite and tempered martensite. Hard martensite is likely to generate a crack on an interface during processing as being adjacent to a soft structure. Furthermore, the interface itself with the soft structure encourages crack progression, and significantly deteriorates the hole expansibility. Therefore, it is desirable to reduce the area ratio of the martensite as much as possible, and the upper limit of the area ratio is set to be 15.0%. The martensite may be 0%, that is, may not be contained.

By the area ratio across the entire sheet thickness, the martensite is preferably 10.0% or less, and the martensite is particularly preferably 10.0% or less within a range of 200 μm from a surface layer.

[In Residual Austenite, Proportion of Residual Austenite in which Aspect Ratio is 2.0 or Less, Length of Long Axis is 1.0 μm or Less, and Length of Short Axis is 1.0 μm or Less, is 80.0% or More]

During hole expansion, voids are generated on the interface between the soft structure and the hard structure. The voids generated from the interface are particularly likely to be generated from an edge of the austenite after the transformation to the martensite. The reason thereof is that the residual austenite contained in a high-strength steel sheet exists between laths of bainite, the morphology becomes a shape of a sheet, and thus, the stress is likely to be concentrated at the edge.

In the steel sheet according to the embodiment, by controlling the morphology of the residual austenite to be granular, the generation of voids from the interface between the soft structure and the hard structure is suppressed. By controlling the residual austenite to be granular, even when a ferrite fraction is high, it is possible to prevent deterioration of hole expansibility. More specifically, in a case where a proportion of the residual austenite in which the aspect ratio is 2.0 or less and the length of the long axis is 1.0 μm or less is 80.0% or more in the residual austenite, even in a case where the structure fraction of the polygonal ferrite is 40% or more, the hole expansibility does not deteriorate. Meanwhile, when a proportion of the residual austenite having the above-described properties is less than 80.0%, the hole expansibility significantly deteriorates. Therefore, in the residual austenite, the residual austenite in which the aspect ratio is 2.0 or less, the length of the long axis is 1.0 μm or less, and the length of the short axis is 1.0 μm or less, is 80.0% or more, and is preferably 85.0% or more. Here, the proportion of the residual austenite in which the length of the long axis is 1.0 μm or less is limited because strain is excessively concentrated during the deformation and generation of voids and deterioration of hole expansibility are caused in the residual austenite in which the length of the long axis exceeds 1.0 μm. The long axis is the maximum length of each residual austenite observed on two-dimensional section after polishing, and the short axis is the maximum length of the residual austenite in a direction orthogonal to the long axis.

In a case where an average carbon concentration in the residual austenite is less than 0.5%, stability with respect to the processing deteriorates, and thus, the average carbon concentration in the residual austenite is preferably 0.5% or more.

[In Bainitic Ferrite, Proportion of Bainitic Ferrite in which Aspect Ratio is 1.7 or Less and Average Value of Crystal Orientation Difference in Region Surrounded by Boundary in which Crystal Orientation Difference is 15° or More is 0.5° or More and Less than 3.0°, is 80.0% or More]

By controlling a crystal orientation difference of a region surrounded by a boundary in which a crystal orientation difference is 15° or more to be in an appropriate range, it is possible to improve the 0.2% proof stress.

In addition, the morphology of the residual austenite is largely influenced by the morphology of the bainitic ferrite. In other words, when the transformation from the untransformed austenite to the bainitic ferrite occurs, a region which remains not being transformed becomes the residual austenite. Therefore, from the viewpoint of the morphology control of the residual austenite, it is necessary to perform the morphology control of the bainitic ferrite.

When the bainitic ferrite is generated in a massive shape (that is, the aspect ratio is close to 1.0), the residual austenite remains in a granular shape on the interface of the bainitic ferrite. A case where the aspect ratio is 1.7 or less is called the massive shape. Furthermore, in the bainitic ferrite, by controlling the crystal orientation difference in the region surrounded by the boundary in which the crystal orientation difference is 15° or more to be 0.5° or more and less than 3.0°, the 0.2% proof stress increases as a subboundary that exists at a high density in a grain prevents the movement of dislocation. This is because the massive bainitic ferrite is a metallographic structure generated as a result of becoming one grain by recovery (generation of the subboundary) of dislocation in which a group of the bainitic ferrite (lath) having a small crystal orientation difference exists on the interface. In order to generate the bainitic ferrite having such a crystallographic characteristic, it is necessary to perform grain refining with respect to the austenite before the transformation.

In the bainitic ferrite, in a case where the proportion of the bainitic ferrite in which the aspect ratio is 1.7 or less and the average value of the crystal orientation difference in the region surrounded by the boundary in which the crystal orientation difference is 15° or more is 0.5° or more and less than 3.0°, is 80.0% or more, high 0.2% proof stress is obtained. In addition, in this case, in the morphology of the residual austenite, the aspect ratio is 2.0 or less, the length of the long axis is 1.0 μm or less, and the length of the short axis is 1.0 μm or less. Meanwhile, when the bainitic ferrite having the above-described properties becomes less than 80.0%, the high 0.2% proof stress cannot be obtained, and it is not possible to obtain a predetermined amount of the residual austenite having the target morphology. Therefore, the lower limit of the proportion of the bainitic ferrite in which the aspect ratio is 1.7 or less and the average value of the crystal orientation difference in the region surrounded by the boundary in which the crystal orientation difference is 15° or more is 0.5° or more and less than 3.0°, is set to be 80.0% or more. As the proportion of the bainitic ferrite increases, it is possible to ensure a large amount of residual austenite having the target morphology while improving the 0.2% proof stress, and thus, a preferable proportion of the bainitic ferrite having the above-described properties is 85% or more.

[Connection Index D Value of Martensite, Bainitic Ferrite, and Residual Austenite is 0.70 or Less]

The martensite, the bainitic ferrite, and the residual austenite which are contained in the microstructure of the steel sheet are structures necessary for ensuring the tensile strength and the 0.2% proof stress of the steel sheet. However, since the structures are hard compared to the polygonal ferrite, during the hole expansion, the voids are likely to be generated from the interface. In particular, when the hard structures are coupled and generated, the voids are likely to be generated from the connected portion. The generation of voids causes significant deterioration of the hole expansibility.

As described above, by controlling the morphology of the residual austenite, it is possible to control the generation of voids during the hole expansion to a certain extent. However, by controlling the disposition of the hard structure such that the connection index of the hard structures become low, it is possible to further improve the hole expansibility.

More specifically, as illustrated in FIG. 1, by controlling the D value that indicates the connection index of the martensite, the bainitic ferrite, and the residual austenite to be 0.70 or less, excellent hole expansibility is obtained. The connection index D value is an index indicating that the hard structures uniformly disperse as the value decreases. Since it is preferable that the D value be low, although it is not necessary to determine the lower limit, but since a numerical value which is smaller than 0 is physically not achievable, practically, the lower limit is 0. Meanwhile, when the connection index D value exceeds 0.70, the connected portion of the hard structures increases, the generation of voids is encouraged, and thus, the hole expansibility significantly deteriorates. Therefore, the D value is 0.70 or less. The D value is preferably 0.65 or less. Definition of the connection index D value and a measuring method will be described later.

Figure 3:
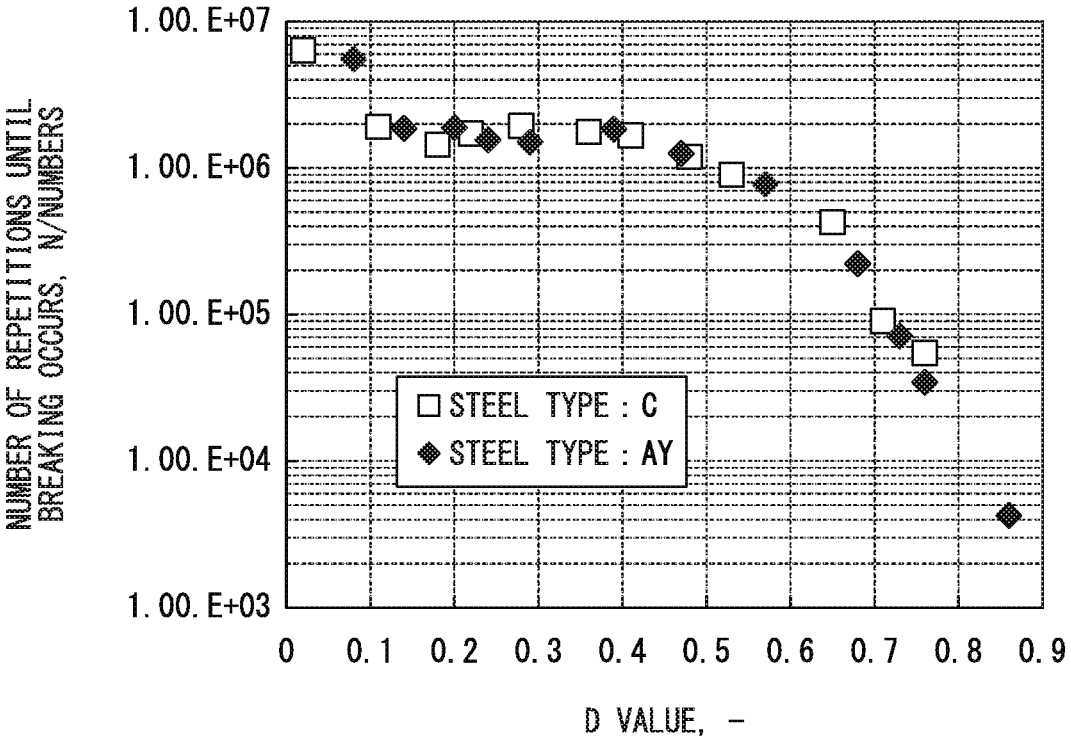
FIG. 3 is a graph illustrating a relationship between the D value and punching fatigue properties (test piece: sheet thickness is 1.4 mm).

In addition, in the steel sheet according to the embodiment, as illustrated in FIG. 3, in a case where the D value is 0.50 or less, the number of repetitions that exceeds $10^6$ and the punching fatigue properties are extremely excellent. In addition, it is ascertained that the number of repetitions exceeds $10^5$ when the D value exceeds 0.50 and 0.70 or less, and high punching fatigue properties are achieved. When the D value exceeds 0.70, the number of repetitions is less than $10^5$, breaking occurs, and the punching fatigue properties deteriorate. The punching fatigue properties cannot be evaluated in the hole expansibility test of the related art, and even when the hole expansibility is excellent, this does not mean that the punching fatigue properties are excellent. The punching fatigue properties can be evaluated for the number of repetitions until the breaking occurs, by preparing a test piece in which a width of a parallel portion is 20 mm, the length is 40 mm, and the entire length including a grip portion is 220 mm such that a stress loading direction and a rolling direction are parallel to each other, by punching a hole having 10 mm of a diameter at the center of the parallel portion under the condition that clearance is 12.5%, and by repeatedly giving a tensile stress that is 40% of tensile strength of each sample evaluated by JIS No. 5 test piece to the test piece by pulsating.

Identification of each structure and measurement of area ratio are performed in the following method. In the steel sheet according to the embodiment, the metallographic structure is evaluated within a range of a thickness ⅛ to ⅜ around (thickness ¼) a sheet thickness ¼ position considering that the metallographic structure is a representative metallographic structure.

In the embodiment, the samples for various tests are preferably collected from the vicinity of the center portion in a width direction orthogonal to the rolling direction when the sample is the steel sheet.

The area ratio of the polygonal ferrite can be calculated by observing the range of a thickness ⅛ to ⅜ around sheet thickness ¼ from an electron channeling contrast image obtained by using a scanning type electron microscope. The electron channeling contrast image is a method of detecting the crystal orientation difference in the grain as a difference of contrast of the image, and in the image, a part photographed by a uniform contrast is the polygonal ferrite in the structure determined as the ferrite not the pearlite, bainitic, martensite, and the residual austenite. In 8 visual fields of an electron channeling contrast image having 35×25 μm, by a method of an image analysis, the area ratio of the polygonal ferrite in each of the visual fields is calculated, and the average value is determined as an area ratio of the polygonal ferrite. In addition, it is possible to calculate a ferrite grain size from an equivalent circle diameter of an area of each polygonal ferrite calculated by the image analysis.

The area ratio and the aspect ratio of the bainitic ferrite can be calculated using an electron channeling contrast image obtained by using the scanning type electron microscope or a bright field image obtained by using a transmission type electron microscope. In the electron channeling contract image, in the structure determined as the ferrite, a region in which a difference in contrast exists in one grain is the bainitic ferrite. In addition, similar to that in the transmission type electron microscope, a region in which the difference in contrast exists in one grain becomes the bainitic ferrite. By confirming the presence and absence of the contrast of the image, it is possible to distinguish the polygonal ferrite and the bainitic ferrite from each other. Regarding the 8 visual fields of the electron channeling contrast image having 35×25 mm, by the method of the image analysis, the area ratio of the bainitic ferrite of each of the visual fields is calculated, and the average value is determined as the area ratio of the bainitic ferrite.

The crystal orientation difference in the region surrounded by a boundary in which the crystal orientation difference is 15° or more in the bainitic ferrite can be obtained by crystal orientation analysis by an FE-SEM-EBSD method [crystal orientation analysis method by using an EBSD: Electron Back-Scatter Diffraction included in FE-SEM: Field Emission Scanning Electron Microscope]. In the range of a thickness ⅛ to ⅜ around thickness ¼, by digitizing the data obtained by measuring the range of 35×25 μm with 0.05 μm of measurement pitch as an average value of the crystal orientation difference for each grain (grain average misorientation value), it is possible to determine the boundary in which the crystal orientation difference is 15° or more, and to obtain the average value of the crystal orientation difference in the range surrounded by the boundary in which the crystal orientation difference is 15° or more. In addition, considering a region surrounded by the boundary in which the crystal orientation difference is 15° or more as one grain, the aspect ratio of the bainitic ferrite can be calculated by dividing the length of the long axis of the grain by the length of the short axis.

The area ratio of the residual austenite can be calculated by observing the range of thickness ⅛ to ⅜ around sheet thickness ¼ by etched with LePera solution by the FE-SEM, or by performing the measurement using an X-ray. In the measurement that uses the X-ray, it is possible to calculate the area ratio of the residual austenite from an integrated intensity ratio of a diffraction peak of (200) and (211) of a bcc phase and (200), (220), and (311) of an fcc phase by removing a part to a depth ¼ position from a sheet surface of the sample by mechanical polishing and chemical polishing, and by using a MoKα line as a characteristic X-ray. In a case of using the X-ray, a volume percentage of the residual austenite is directly obtained but the volume percentage and the area ratio are considered to be equivalent to each other.

By the X-ray diffraction, it is also possible to obtain a carbon concentration "Cγ" in the residual austenite. Specifically, it is possible to obtain the "Cγ" using the following equation by obtaining a lattice constant "dγ" of the residual austenite from peak position of (200), (220), and (311) of the fcc phase, and further, and using a chemical composition value of each sample obtained by the chemical analysis.

$$C\gamma=(100\times d\gamma-357.3-0.095\times Mn+0.02\times Ni-0.06\times Cr-0.31\times Mo-0.18\times V-2.2\times N-0.56\times Al+0.04\times Co-0.15\times Cu-0.51\times Nb-0.39\times Ti-0.18\times W)/3.3$$

In addition, each of the element symbols in the equation correspond to % by mass of each of the elements contained in the sample.

The aspect ratio of the residual austenite can be calculated by observing the range of thickness ⅛ to ⅜ around thickness ¼ etched with LePera solution using the FE-SEM, or by using the bright field image obtained by using the transmission type electron microscope in a case where the size of the residual austenite is small. Since the residual austenite has a face-centered cubic structure, in a case of observation using the transmission type electron microscope, diffraction of the structure is obtained, and by comparison with a data base related to the crystal structure of metal, it is possible to distinguish the residual austenite. The aspect ratio can be calculated by dividing the length of the long axis of the residual austenite by the length of the short axis. Considering deviation, the aspect ratio is measured with respect to at least 100 or more pieces of residual austenite.

The area ratio of the martensite can be calculated by observing the range of thickness ⅛ to ⅜ around sheet thickness ¼ by performing etched with LePera solution by the FE-SEM, and by subtracting the area ratio of the residual austenite measured by using the X-ray from the area ratio of the region that is observed by the FE-SEM and is not corroded. Otherwise, it is possible to distinguish the structure from other metallographic structures by the electron channeling contrast image obtained by using the scanning type electron microscope. Since the martensite and the residual austenite contain a large amount of solid solution carbon and are unlikely to be melted with respect to an etchant, the distinguishing becomes possible. In the electron channeling contrast image, a region in which a dislocation density is high and has a lower structure which is called a block or a packet in the grain is the martensite.

In addition, the evaluation is also possible by a similar method in a case of acquiring the area ratio of the other sheet thickness positions. For example, in a case of evaluating the area ratio of the martensite in a range from a surface layer to 200 μm, at each position of 30, 60, 90, 120, 150, and 180 μm from the surface layer, by evaluating the range of 25 μm in the sheet thickness direction and 35 μm in the rolling direction by the same method as that described above, and by averaging the area ratio of the martensite obtained at each position, it is possible to obtain the area ratio of the martensite within a range from the surface layer to 200 μm.

The connection index D value of the martensite, the bainitic ferrite, and the residual austenite in the steel sheet according to the embodiment, will be described. The connection index D value is a value obtained by the following methods (A1) to (E1).

(A1) The electron channeling contrast image within a range of 35 μm in the direction parallel to the rolling direction and 25 μm in the direction orthogonal to the rolling direction, in the thickness ¼ on the section parallel to the rolling direction, is obtained by using the FE-SEM.

(B1) 24 lines parallel in the rolling direction are drawn at an interval of 1 μm in the obtained image.

(C1) The number of intersection points between the interfaces of all of the microstructures and the parallel lines is acquired.

(D1) A proportion of the intersection points between the interfaces in which the hard structures (the martensite, the bainitic ferrite, and the residual austenite) are adjacent each other and the parallel lines to all of the above-described intersection points (that is, the number of intersection points between the interfaces of the hard structures and the parallel lines/the number of intersection points between the parallel lines and all of the interfaces) is calculated.

(E1) The procedure from (A1) to (D1) is performed in 5 visual fields using the same sample, and the average value of the proportion of the interface of the hard structures in the 5 visual fields is the connection index D value of the hard structure of the sample.

Next, the amount (chemical composition) of elements contained for ensuring mechanical properties or chemical properties of the steel sheet according to the embodiment will be described. % related to the amount means % by mass.

[C: 0.100% or More and Less than 0.500%]

C is an element that contributes to ensuring the strength of the steel sheet and improving the elongation by improving stability of the residual austenite. When the amount of C is less than 0.100%, it is difficult to obtain 980 MPa or more of the tensile strength. In addition, the stability of the residual austenite is not sufficient and sufficient elongation is not obtained. Meanwhile, when the amount of C is 0.500% or more, the transformation from the austenite to the bainitic ferrite is delayed, and thus, it becomes difficult to ensure 30.0% or more by the area ratio of the bainitic ferrite. Therefore, the amount of C is set to be 0.100% or more and less than 0.500%. The amount of C is preferably 0.150% to 0.250%.

[Si: 0.8% or More and Less than 4.0%]

Si is an element efficient in improving the strength of the steel sheet. Furthermore, Si is an element which contributes to improving the elongation by improving the stability of the residual austenite. When the amount of Si is less than 0.8%, the above-described effect is not sufficiently obtained. Therefore, the amount of Si is 0.8% or more. The amount of Si is preferably 1.0% or more. Meanwhile, when the amount of Si is 4.0% or more, the residual austenite excessively increases and the 0.2% proof stress decreases. Therefore, the amount of Si is set to be less than 4.0%. The amount of Si is preferably less than 3.0%. The amount of Si is more preferably less than 2.0%.

[Mn: 1.0% or More and Less than 4.0%]

Mn is an element efficient in improving the strength of the steel sheet. In addition, Mn is an element which suppresses the ferrite transformation generated in the middle of cooling when performing heat treatment in a continuous annealing facility or in a continuous hot-dip galvanizing facility. When the amount of Mn is less than 1.0%, the above-described effect is not sufficiently obtained, the ferrite that exceeds a required area ratio is generated, and the 0.2% proof stress significantly deteriorates. Therefore, the amount of Mn is 1.0% or more. The amount of Mn is preferably 2.0% or more. Meanwhile, when the amount of Mn is 4.0% or more, the strength of the slab or the hot-rolled steel sheet excessively increases. Therefore, the amount of Mn is set to be less than 4.0%. The amount of Mn is preferably 3.0% or less.

[P: Less than 0.015%]

P is an impurity element, and is an element which deteriorates toughness or hole expansibility, or embrittles a welding portion by segregating the center portion of the sheet thickness of the steel sheet. When the amount of P is 0.015% or more, deterioration of the hole expansibility becomes significant, and thus, the amount of P is set to be less than 0.015%. The amount of P is preferably less than 0.010%. Since a smaller amount of P is more preferable, a lower limit thereof is not particularly limited, but the amount of P which is less than 0.0001% is economically disadvantageous in a practical steel sheet, and thus, the lower limit is practically 0.0001%.

[S: Less than 0.0500%]

S is an impurity element, and is an element that hinders weldability. In addition, S is an element which forms a coarse MnS and decreases the hole expansibility. When the amount of S is 0.0500% or more, the weldability deteriorates and the hole expansibility significantly deteriorates, and thus, the amount of S is set to be less than 0.0500%. The amount of S is preferably 0.00500%. Since a smaller amount of S is more preferable, a lower limit thereof is not particularly limited, but the amount of S which is less than 0.0001% is economically disadvantageous in a practical steel sheet, and thus, the lower limit is practically 0.0001%.

[N: Less than 0.0100%]

N is an element which forms coarse nitride, and becomes a cause of deterioration of bendability or hole expansibility or generation of a blowhole during the welding. When the amount of N is 0.0100% or more, the hole expansibility deteriorates or generation of the blowhole becomes significant, and thus, the amount of N is set to be less than 0.0100%. Since a smaller amount of N is more preferable, a lower limit thereof is not particularly limited, but the amount of N which is less than 0.0005% causes a substantial increase in manufacturing costs in a practical steel sheet, and thus, the lower limit is practically 0.0005%.

[Al: Less than 2.000%]

Al is an efficient element as a deoxidizing material. In addition, similar to Si, Al is an element having an action of suppressing precipitation of ferrous carbide in the austenite. In order to obtain the effects, the Al may be contained. However, in the steel sheet according to the embodiment that contains Si, Al may not be necessarily contained. However, since it is difficult to control the amount of Al to be less than 0.001% in a practical steel sheet, the lower limit thereof may be 0.001%. Meanwhile, when the amount of Al becomes 2.000% or more, the transformation from the austenite to the ferrite is promoted, the area ratio of the ferrite becomes excessive, and deterioration of the 0.2% proof stress is caused. Therefore, the amount of Al is set to be less than 2.000%. The amount of Al is preferably 1.000% or less.

[Si+Al: 1.000% or more]

Si and Al are elements which contribute to improving the elongation by improving the stability of the residual austenite. When the total amount of the elements is less than 1.000%, the effect cannot be sufficiently obtained, and thus, the total amount of Si and Al is set to be 1.000% or more. The total amount of Si and Al is more preferably 1.200% or more. The upper limit of Si+Al becomes less than 6.000% in total of each of the upper limits of Si and Al.

[Ti: 0.020% or More and Less than 0.150%]

Ti is an important element in the steel sheet according to the embodiment. Ti increases an intergranular area of the austenite by grain refining the austenite in the heat treatment process. Since the ferrite is likely to be nucleated from the boundary of the austenite, as the intergranular area of the austenite increases, the area ratio of the ferrite increases. Since an effect of grain refining of the austenite clearly appears when the amount of Ti is 0.020% or more, the amount of Ti is set to be 0.020% or more. The amount of Ti is preferably 0.040% or more, and is more preferably 0.050% or more. Meanwhile, when the amount of Ti is 0.150% or more, the total elongation deteriorates as a precipitation amount of carbonitride increases. Therefore, the amount of Ti is set to be less than 0.150%. The amount of Ti is preferably less than 0.010%, and is more preferably less than 0.070%.

The steel sheet according to the embodiment basically contains the above-described elements and the remainder of Fe and impurities. However, in addition to the above-described elements, one or two or more of Nb: 0.020% or more and less than 0.600%, V: 0.010% or more and less than 0.500%, B: 0.0001% or more and less than 0.0030%, Mo: 0.010% or more and less than 0.500%, Cr: 0.010% or more and less than 2.000%, Mg: 0.0005% or more and less than 0.0400%, Rem: 0.0005% or more and less than 0.0400%, and Ca: 0.0005% or more and less than 0.0400% may be appropriately contained. Since Nb, V, B, Mo, Cr, Mg, Rem, and Ca are not necessarily contained, the lower limits thereof are 0%. In addition, even in a case where the elements of which amounts are less than the range that will be described later are contained, the effect of the steel sheet according to the embodiment is not damaged.

[Nb: 0.005% or More and Less than 0.200%]

[V: 0.010% or More and Less than 0.500%]

Similar to Ti, Nb and V have an effect of increasing the intergranular area of the austenite by grain refining the austenite in the heat treatment process. In a case of obtaining the effect, regarding Nb, the amount of Nb is preferably 0.005% or more. In addition, regarding V, the amount of V is preferably 0.010% or more. Meanwhile, when the amount of Nb becomes 0.200% or more, the precipitation amount of the carbonitride increases and the total elongation deteriorates. Therefore, even in a case where Nb is contained, the amount of Nb is preferably less than 0.200%. In addition, when the amount of V becomes 0.500% or more, the precipitation amount of the carbonitride increases and the total elongation deteriorates. Therefore, even in a case where V is contained, the amount of V is preferably less than 0.500%.

[B: 0.0001% or More and Less than 0.0030%]

B has an effect of strengthening the grain boundary and performing a control such that the structure fraction of the polygonal ferrite does not exceed a predetermined amount by suppressing the ferrite deformation during the cooling after the annealing in the continuous annealing facility or in the continuous hot-dip galvanizing facility. In a case of obtaining the above-described effects, the amount of B is preferably 0.0001% or more. The amount of B is more preferably 0.0010% or more. Meanwhile, when the amount of B is 0.0030% or more, the effect of suppressing the ferrite deformation is excessively strong, and it is not possible to ensure a predetermined amount or more of polygonal ferrite. Therefore, even in a case where B is contained, the amount of B is preferably less than 0.0030%. The amount of B is more preferably less than 0.0025%.

[Mo: 0.010% or More and Less than 0.500%]

Mo is a strengthening element and has an effect of performing a control such that the structure fraction (area ratio) of the polygonal ferrite does not exceed a predetermined amount by suppressing the ferrite deformation during the cooling after the annealing in the continuous annealing facility or in the continuous hot-dip galvanizing facility. In a case where the amount of Mo is less than 0.010%, the effect is not obtained, and thus, the amount is preferably 0.010% or more. The amount of Mo is more preferably 0.020% or more. Meanwhile, when the amount of Mo becomes 0.500% or more, the effect of suppressing the ferrite deformation is excessively strong, and it is not possible to ensure a predetermined amount or more of polygonal ferrite. Therefore, even in a case where Mo is contained, the amount of Mo is preferably less than 0.500%, and is more preferably 0.200% or less.

[Cr: 0.010% or More and Less than 2.000%]

Cr is an element which contributes to increasing the strength of the steel sheet and has an effect of performing a control such that the structure fraction of the polygonal ferrite does not exceed a predetermined amount during the cooling after the annealing in the continuous annealing facility or in the continuous hot-dip galvanizing facility. In a case of obtaining the effect, the amount of Cr is preferably 0.010% or more. The amount of Cr is more preferably 0.020% or more. Meanwhile, when the amount of Cr becomes 2.000% or more, the effect of suppressing the ferrite deformation is excessively strong, and it is not possible to ensure a predetermined amount or more of polygonal ferrite. Therefore, even in a case where Cr is contained, the amount of Cr is preferably less than 2.000%, and is more preferably 0.100% or less.

[Mg: 0.0005% or More and Less than 0.0400%]

[Rem: 0.0005% or More and Less than 0.0400%]

[Ca: 0.0005% or More and Less than 0.0400%]

Ca, Mg, and REM are elements which control the morphology of oxide or sulfide and contribute to improving the hole expansibility. When the amount of any of the elements is less than 0.0005%, the above-described effect is not obtained, and thus, the amount is preferably 0.0005% or more. The amount is more preferably 0.0010% or more. Meanwhile, when the amount of any of the elements becomes 0.0400% or more, coarse oxide is formed and the hole expansibility deteriorates. Therefore, the amount of any of the elements is preferably less than 0.0400%. The amount is more preferably 0.010% or less.

In a case where REM (rare earth element) is contained, there are many cases where REM is added by misch metal, but multiple addition of lanthanoid-series elements in addition to La or Ce may be performed. In this case, the effect of the steel sheet according to the embodiment is not damaged. In addition, even when adding the metal REM, such as metal La or Ce, the effect of the steel sheet according to the embodiment is not damaged.

[Tensile Strength is 980 MPa or More, 0.2% Proof Stress is 600 MPa or More, Total Elongation is 21.0% or More, and Hole Expansion Ratio is 30.0% or More]

In the steel sheet according to the embodiment, the tensile strength is set to be 980 MPa or more and the 0.2% proof stress is set to be 600 MPa or more, as a range that can contribute to reducing the weight of the vehicle body while ensuring collision safety. In addition, considering employment to the frame components of the vehicle member, the total elongation is set to be 21.0% or more and the hole expansion ratio is set to be 30.0%. The total elongation is preferably 30.0% or more and the hole expansion ratio is preferably 50.0% or more.

In the embodiment, the values, particularly the total elongation and the hole expansibility, are also indices that indicate non-uniformity of the structure of the steel sheet that are difficult to be quantitatively measured by a general method.

Next, the method of manufacturing the steel sheet according to the embodiment will be described.

[Casting Process]

Molten steel made by melting to be within a composition range of the steel sheet according to the embodiment is cast into a steel ingot or slab. The cast slab used in hot rolling may be a cast slab, and is not limited to a certain cast slab. For example, a continuous cast slab or a slab manufactured by a thin slab caster may be employed. The cast slab is directly used in hot rolling, or is used in hot rolling being heated after being cooled one time.

[Hot Rolling Process]

In a hot rolling process, a hot-rolled steel sheet is obtained by performing rough rolling and finish rolling.

In the rough rolling, it is necessary that the total reduction (cumulative rolling reduction) within a temperature range (first temperature range) of 1000° C. to 1150° C. be 40% or more. When the reduction during the reduction within the temperature range is 40% or less, the austenite grain size after the finish rolling increases, non-uniformity of the steel sheet structure increases, and thus, formability deteriorates.

Meanwhile, when the total reduction within the first temperature range is less than 40%, the austenite grain size after the finish rolling excessively decreases, the transformation from the austenite to the ferrite is excessively promoted, non-uniformity of the steel sheet structure increases, and thus, formability after annealing deteriorates.

In addition, the temperature of the finish rolling and the total value of the reduction in the hot rolling process are important to control connection index of the hard structures after the heat treatment. By controlling the temperature of the finish rolling and the total value of the reduction, in the microstructure at a stage of the hot-rolled steel sheet, it is possible to uniformly disperse the pearlite. In the hot-rolled steel sheet, when uniformly dispersing the pearlite, in the cold-rolled steel sheet, the connection index of the hard structures can be deteriorated.

In order to uniformly disperse the pearlite in the structure of the steel sheet, it is important to obtain a finer recrystallized grain by storing a large amount of strain by the reduction. The present inventors have found that it is possible to determine the temperature range in which a grain becomes fine by recrystallization in a region of the austenite in the steel sheet having a predetermined composition using a temperature T1 acquired by the following Equation (1) as a standard. The temperature T1 is an index that indicates a precipitated state of a Ti compound in the austenite. In a non-equilibrium state in the hot rolling and in the cold rolling, the precipitation of the Ti compound reaches a saturated state in a case of T1−50° C. or lower, and the Ti compound is completely dissolved in the austenite in a case of T1+150° C.

Specifically, the present inventors have found that the grain of the austenite after the finish rolling can become fine by performing plural passes of rolling (finish rolling) within a temperature range (second temperature range) of T1° C. to T1+150° C. so as to set the cumulative rolling reduction to be 50% or more, and by suppressing growth of the fine recrystallized grain generated in the rolling using the Ti compound that is precipitated at the same time. A case where the cumulative rolling reduction is less than 50% is not preferable since the austenite grain size after the finish rolling becomes a duplex grain and non-uniformity of the steel sheet structure increases. It is desirable that the cumulative rolling reduction be 70% or more from the viewpoint of promoting the recrystallization by strain accumulation. Meanwhile, by controlling the upper limit of the cumulative rolling reduction, it is possible to more sufficiently ensure a rolling temperature, and to suppress a rolling load. Therefore, the cumulative rolling reduction may be 90% or less.

$$T1(^\circ\ C.)=920+40\times C^2-80\times C+Si^2+0.5\times Si+0.4\times Mn^2-9\times Mn+10\times Al+200\times N^2-30\times N-15\times Ti \quad (1)$$

here, element symbols indicate the amount of each element in % by mass.

By controlling the temperature range of the finish rolling and the cumulative rolling reduction, it is possible to uniformly disperse the pearlite in the microstructure of the hot-rolled steel sheet. The reason thereof is that, by the control of the finish rolling, the recrystallization of the austenite is promoted, the grain becomes fine, and as a result, it is possible to uniformly disperse the disposition of the pearlite. More specifically, in the steel sheet, generally, microsegregation of Mn formed in the casting process elongates by the rolling, and exists in a shape of a band. In this case, in the cooling process after the finish rolling, the ferrite is generated in a negative segregating zone of Mn when the temperature of the steel sheet decreases monotonously at a constant cooling rate during a period from completing the finish rolling to coiling, and C is concentrated at the untransformed austenite part that remains in a shape of a layer. In addition, in the cooling or coiling process after this, the austenite is transformed to the pearlite, and a pearlite band is generated. Since the ferrite generated in the cooling process is preferentially nucleated in the austenite boundary or at a triple point, in a case where the recrystallized austenite grain is coarse, it is considered that the number of nucleation sites of the ferrite is small and the pearlite band is likely to be generated.

Meanwhile, in a case where the recrystallized austenite grain is fine, the number of nucleation sites of the ferrite generated in the cooling process is large, the ferrite is also generated from the triple point of the austenite which is in a segregating zone of Mn, and accordingly, the austenite which remains in an untransformed state is unlikely to be formed in a shape of a layer. As a result, it is considered that the generation of the pearlite band is suppressed.

Figure 2:
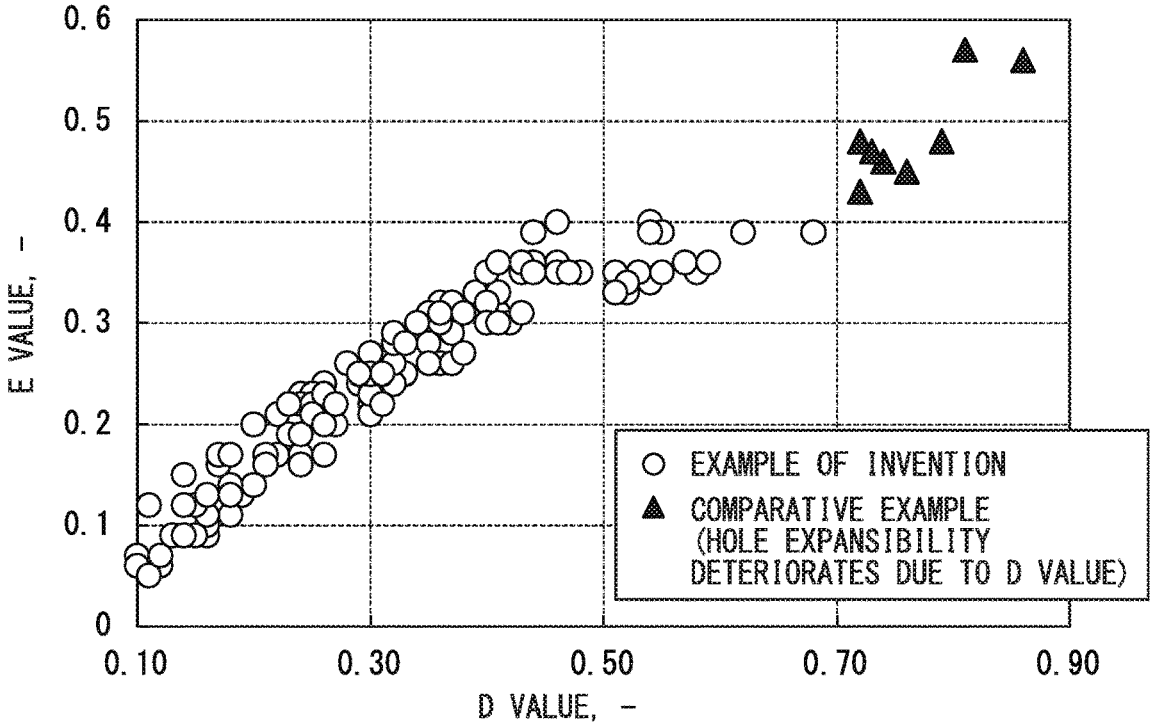
FIG. 2 is a graph illustrating a relationship between the D value and an E value.

The present inventors have found that it is efficient to use an index which is called a connection index E value of the pearlite for quantitatively evaluating the pearlite band. In addition, as a result of performing a thorough investigation by the present inventors, as illustrated in FIG. 2, it was found that a cold-rolled steel sheet in which the connection index D value of the hard structure is 0.70 or less is obtained in a case where the connection index E value of the pearlite is 0.40 or less. The fact that the connection index E value of the pearlite is small indicates that the connection index of the pearlite decreases and the pearlite uniformly disperses. When the connection index E value exceeds 0.40, the connection index of the pearlite increase and the connection index D value of the hard structure after the heat treatment cannot be controlled to be a predetermined value. Therefore, in a stage of the hot-rolled steel sheet, it is important to set an upper limit of the E value to be 0.40. A lower limit value of the E value is not particularly determined, but since a numerical value which is smaller than 0 is physically not achievable practically, the lower limit is 0. It is possible to distinguish the pearlite in the hot-rolled steel sheet when performing observation using an optical microscope that uses a nital or by a secondary electron image obtained by using a scanning type electron microscope, and by observing the range of thickness ⅛ to ⅜ around the sheet thickness ¼ (thickness ¼), the calculation can be performed.

The connection index E value of the pearlite can be acquired by the following methods (A2) to (E2).

(A2) The secondary electron image within a range of 35 μm in the direction parallel to the rolling direction and 25 μm in the direction orthogonal to the rolling direction, in the thickness ¼ on the section parallel to the rolling direction, is obtained by using the FE-SEM.

(B2) 6 lines parallel in the rolling direction are drawn at an interval of 5 μm in the obtained image.

(C2) The number of intersection points between the interfaces of all of the microstructures and the lines is obtained.

(D2) A proportion of the interfaces of the pearlite to all of the above-described intersection points is calculated by dividing the number of intersection points between the parallel line and interfaces on in which the pearlite are adjacent to each other by the number of intersection points between all of the parallel lines and all of the interface (that is, the number of intersection points between the interfaces of the pearlite and the parallel lines/the number of intersection points between the parallel lines and all of the interfaces).

(E2) The procedure from (A2) to (D2) is performed in 5 visual fields using the same sample, and the average value of the proportion of the interface of the pearlite in the 5 visual fields is the connection index E value of the hard structure of the sample.

In the annealing process after pickling and annealing that are performed after the hot rolling process, the austenite is reversely transformed from the periphery of the pearlite. Therefore, by making the disposition of the pearlite uniform in the hot rolling process, the austenite during the reverse transformation after this also uniformly disperses. When the austenite which uniformly disperses is transformed to the bainitic ferrite, the martensite, and the residual austenite, the disposition thereof is taken over, and the hard structures can uniformly disperse.

The finish rolling is completed at the temperature range of T1−40° C. or more. A finish rolling temperature (FT) is important from the viewpoint of structure control of the steel sheet. When the finish rolling temperature is T1−40° C. or more, the Ti compound is precipitated on a grain boundary of the austenite after the finish rolling, the growth of a grain of the austenite is suppressed, and it is possible to control the austenite after the finish rolling to be refined. Meanwhile, when the finish rolling temperature is less than T1−40° C., as the strain is applied after the precipitation of the Ti compound is close to the saturated state or achieves the saturated state, the grain of the austenite after the finish rolling becomes a duplex grain, and as a result, formability deteriorates.

In the hot rolling process, the hot rolling may be consecutively performed by joining rough rolling sheets to each other, or may be used in the next hot rolling by coiling the rough rolling sheet one time.

[First Cooling Process]

The hot-rolled steel sheet after the hot rolling is started to be cooled within 0 to 5.0 seconds after the hot rolling, and is cooled at a cooling temperature of 20° C./s to 80° C./s to a temperature range of 600 to 650° C.

After the hot rolling, a case where it takes 5.0 seconds until the start of the cooling is not preferable since a difference in grain size of the austenite is generated in the width direction of the steel sheet, unevenness of formability in the width direction of the steel sheet is generated in a product annealed after cold rolling and deterioration of a product value is caused. When the cooling rate is less than 20° C./s, the connection index E value of the pearlite on the hot-rolled steel sheet cannot be suppressed to be 0.40 or less, and formability deteriorates. Meanwhile, when the cooling rate exceeds 80° C./s, the vicinity of the surface layer of the sheet thickness of the hot-rolled steel sheet has a structure mainly including the martensite, or at the center of the sheet thickness a large amount of bainite exists, the structure in the sheet thickness direction becomes non-uniform, and formability deteriorates.

[Holding Process]

[Second Cooling Process]

[Coiling Process]

The hot-rolled steel sheet after the first cooling process is held for a time t seconds or longer determined by the following equation (2) in a temperature range (third temperature range) of 600 to 650° C., and after this, the hot-rolled steel sheet is cooled to 600° C. or less. In addition, the hot-rolled steel sheet after the cooling is coiled in the temperature range of 600° C. or less. By the coiling, in the microstructure of the steel sheet (hot-rolled steel sheet) after the coiling, the hot-rolled steel sheet in which the connection index E value of the pearlite is 0.4 or less, the metallographic structure contains the bainitic ferrite, and in the bainitic ferrite, the proportion of the bainitic ferrite in which an average value of the crystal orientation difference in the region surrounded by the boundary in which the crystal orientation difference is 15° or more is 0.5° or more and less than 3.0°, is 80.0% or more, is obtained.

Here, the term holding means that the steel sheet is held within the temperature range of 600 to 650° C. by heat-sinking caused by cooling water, mist, atmosphere, and a table roller of a hot rolling mill and recuperation caused by the transformation, and by receiving an increase in temperature by the heater.

The process from finishing of the finish rolling to the coiling is an important process for obtaining predetermined properties in the steel sheet according to the embodiment. In the microstructure of the hot-rolled steel sheet, a generation density of austenite grains can be increased in the heat treatment process that will be performed later by controlling the microstructure of the hot-rolled steel sheet such that the average value of the crystal orientation difference in the region surrounded by the boundary in which the crystal orientation difference is 15° or more is 0.5° or more and less than 3.0°, is 80.0% or more in the bainitic ferrite in the microstructure of the steel sheet.

In the hot-rolled steel sheet after the coiling process, in the bainitic ferrite, the untransformed austenite having a fine granular shape remains on the boundary of the bainitic ferrite when the bainitic ferrite in which the average value of the crystal orientation difference in the region surrounded by the boundary in which the crystal orientation difference is 15° or more is 0.5° or more and less than 3.0° is generated.

In other words, by finely dispersing the carbide or the residual austenite in the hot-rolled steel sheet, it is possible to increase the generation density of the austenite grain after the heat treatment, and as a result, it is possible to ensure the 0.2% proof stress. In the manufacturing method of the steel sheet according to the steel sheet, by controlling the microstructure of the hot-rolled steel sheet, the generation density of the austenite grain is increased in the annealing process which is post-processing, and further, by suppressing the grain growth of the austenite by the effect of Ti contained in the steel sheet, refining of the austenite can be realized. By achieving the two effects, in the cold-rolled steel sheet, it is possible to obtain a predetermined microstructure, and to satisfy the predetermined properties.

In the hot-rolled steel sheet, in order to control the bainitic ferrite in which the average value of the crystal orientation difference in the region surrounded by the boundary in which the crystal orientation difference is 15° or more is 0.5° or more and less than 3.0°, to be 80.0% or more in the bainitic ferrite, it is necessary to perform each process until the coiling under the above-described condition, and particularly, after finishing the finish rolling, it is particularly important to perform the coiling within the temperature range of 600° C. or less after holding the hot-rolled steel sheet for time t seconds determined by Equation (2) within the temperature range of 600 to 650° C. and cooling the hot-rolled steel sheet.

$$t(\text{seconds})=1.6+(10\times C+Mn-20\times Ti)/8 \qquad \text{Equation (b)}$$

here, element symbols in the equations indicate the amount of elements in % by mass.

When a holding temperature becomes less than 600° C., the bainitic ferrite having a large crystal orientation difference is generated, the proportion of the bainitic ferrite in which the average value of the crystal orientation difference in the region surrounded by the boundary in which the crystal orientation difference is 15° or more is 0.5° or more and less than 3.0°, becomes less than 80.0%. Meanwhile, when the holding temperature exceeds 650° C., the E value cannot be set to be 0.4 or less. Therefore, the holding temperature is 600 to 650° C.

The holding time at 600 to 650° C. is set to be t seconds or more. The bainitic ferrite in which the average value of the crystal orientation difference in the region surrounded by the boundary in which the crystal orientation difference is 15° or more is 0.5° or more and less than 3.0°, is a metallographic structure generated with the result that a group of bainitic ferrite (lath) having a small crystal orientation difference becomes one grain by the recovery of dislocation that exists on the interface. Therefore, it is necessary to hold the steel sheet at a certain temperature for a predetermined or more time. When the holding time is less than t seconds, it is not possible to ensure 80.0% or more of the bainitic ferrite in which the average value of the crystal orientation difference in the region surrounded by the boundary in which the crystal orientation difference is 15° or more is 0.5° or more and less than 3.0° in the hot-rolled steel sheet. Therefore, the lower limit is t seconds. Meanwhile, although there is no upper limit of the holding time, when holding exceeds 10.0 seconds, an increase in costs is caused, for example, it is necessary to install a large-scale heating device on a hot rolling runout table, and thus, the holding time is preferably 10.0 seconds or less.

After holding the hot-rolled steel sheet for t seconds or more in the temperature range of 600 to 650° C., the hot-rolled steel sheet is cooled to be 600° C. or less and is coiled at 600° C. or less. When a coiling temperature (CT) exceeds 600° C., the pearlite is generated, and it is not possible to ensure 80.0% or more of bainitic ferrite. Therefore, the upper limit thereof is set to be 600° C. A cooling stop temperature and the coiling temperature are substantially equivalent to each other.

As a result of through investigation of the present inventors, it was found that it is possible to further increase the area ratio of the residual austenite generated through the following cold rolling and the heat treatment process by setting the coiling temperature to be 100° C. or less. Therefore, the coiling temperature is preferably set to be 100° C. or less. A lower limit of the coiling temperature is not particularly limited, but coiling at room temperature or less is technically difficult, and thus, room temperature is practically the lower limit.

[Holding Process]

In a case where the hot-rolled steel sheet is obtained by the coiling in the temperature range of 100° C. or less, the temperature may increase to a temperature range (seventh temperature range) of 400° C. to an Al transformation point or less, and may hold the hot-rolled steel sheet for 10 seconds to 10 hours. The process is preferable since it is possible to soften the hot-rolled steel sheet to the strength at which the cold rolling is possible. The holding process does not affect the microstructure and does not damage the effect of increasing the structure fraction of the residual austenite generated via the cold rolling and the heat treatment process. The holding of the hot-rolled steel sheet may be performed in the atmosphere, in a hydrogen atmosphere, or in a mixed atmosphere of nitrogen and hydrogen.

When the heating temperature is less than 400° C., the softening effect of the hot-rolled steel sheet cannot be obtained. When the heating temperature exceeds the Al transformation point, the microstructure of the hot-rolled steel sheet is damaged, and it is not possible to generate the microstructure for obtaining the predetermined properties after the heat treatment. When the holding time after the increase in temperature is less than 10 seconds, the softening effect of the hot-rolled steel sheet cannot be obtained.

The Al transformation point can be acquired from a thermal expansion test, and it is desirable to set the temperature at which a volume percentage of the austenite acquired from a change in thermal expansion exceeds 5% to be the Al transformation point, for example, when heating the sample at 1° C./s.

[Pickling Process]

[Cold Rolling Process]

The hot-rolled steel sheet coiled at 600° C. or less is recoiled, the pickling is performed, and the hot-rolled steel sheet is used in the cold rolling. In the pickling, by removing the oxide on a surface of the hot-rolled steel sheet, chemical convertibility of the cold-rolled steel sheet or coating properties are improved. The pickling may be performed by a known method, may be performed one time, or may be performed plural times.

The cold rolling is performed with respect to the pickled hot-rolled steel sheet such that the cumulative rolling reduction is 40.0% to 80.0%. When the cumulative rolling reduction is less than 40.0%, it is difficult to maintain a flat shape of the cold-rolled steel sheet, and since the ductility of the final product deteriorates, the cumulative rolling reduction is 40.0% or more. The cumulative rolling reduction is preferably 50.0% or more. It is considered that this is because, for example, when the cumulative rolling reduction is not sufficient, the strain accumulated in the steel sheet is non-uniform, the ferrite becomes a duplex grain when heating the cold-rolled steel sheet to the temperature range of less than the Al transformation point from room temperature in the annealing process, and further, the austenite becomes the duplex grain when holding the cold-rolled steel sheet at the annealing temperature due to the morphology of the ferrite, and as a result, the structure becomes non-uniform. Meanwhile, when the cumulative rolling reduction exceeds 80.0%, the rolling load becomes excessive, and the rolling becomes difficult. In addition, the recrystallization of the ferrite becomes excessive, the coarse ferrite is formed, the area ratio of the ferrite exceeds 60.0%, and the hole expansibility or bendability of the final product deteriorates. Therefore, the cumulative rolling reduction is 80.0% or less, and is preferably 70.0% or less. In addition, the number of rolling passes and the reduction for each pass are not particularly limited. The setting may be appropriately performed within a range in which 40.0% to 80.0% of the cumulative rolling reduction can be ensured.

[Annealing Process]

The cold-rolled steel sheet after the cold rolling process is transferred to a continuous annealing line, and is annealed by heating to the temperature (fourth temperature range) of T1−50° C. to 960° C. When the annealing temperature is less than T1−50° C., the polygonal ferrite exceeds 60.0% as the metallographic structure, and it is not possible to ensure the predetermined amount of bainitic ferrite and the residual austenite. Furthermore, it is not possible to precipitate the Ti compound in the polygonal ferrite in the cold rolling process after the annealing, work hardenability of the polygonal ferrite deteriorates, and formability deteriorates. Therefore, the annealing temperature is set to be T1−50° C. Meanwhile, it is not necessary to determine the upper limit, but from the viewpoint of operation, when the annealing temperature exceeds 960° C., generation of defects on the surface of the steel sheet and breaking of the steel sheet in a furnace are caused, there is a concern that productivity deteriorates, and thus, the practical upper limit is 960° C.

The holding time in the annealing process is 30 seconds to 600 seconds. When the holding time of annealing is less than 30 seconds, dissolution of carbide to the austenite is not sufficient, distribution of solid solution carbon in the austenite is not uniform, and thus, the residual austenite having a small solid solution carbon concentration is generated after the annealing. Since such residual austenite has significantly low stability with respect to the processing, the hole expansibility of the cold-rolled steel sheet deteriorates. In addition, when the holding time exceeds 600 seconds, generation of defects on the surface of the steel sheet and breaking of the steel sheet in a furnace are caused, there is a concern that productivity deteriorates, and thus, the upper limit is 600 seconds.

[Third Cooling Process]

In order to control the area ratio of the polygonal ferrite with respect to the cold-rolled steel sheet after the annealing process, the cooling is performed at a cooling rate of 1.0° C./s to 10.0° C./s to the temperature range (fifth temperature range) of 600° C. to 720° C. When the cooling stop temperature is less than 600° C., the transformation from the austenite to the ferrite is delayed, and the polygonal ferrite becomes less than 40%. Therefore, the cooling stop temperature is set to be 600° C. or more. The cooling rate to the cooling stop temperature is set to be 1.0° C./s to 10.0° C./s. When the cooling rate is less than 1.0° C./s, the ferrite exceeds 60.0%, and thus, the cooling rate is set to be 1.0° C./second or more. When the cooling rate exceeds 10.0° C./second, the transformation from the austenite to the ferrite is delayed, the ferrite becomes less than 40.0%, and thus, the cooling rate is set to be 10.0° C./second or less. When the cooling stop temperature exceeds 720° C., the ferrite exceeds 60.0%, and thus, the cooling stop temperature becomes 720° C. or less.

[Heat Treatment Process]

the cold-rolled steel sheet after the third cooling process, is cooled to a temperature range (sixth temperature range) of 150° C. to 500° C. at the cooling rate of 10.0° C./s to 60.0° C./s, and the cold-rolled steel sheet is held for 30 seconds to 600 seconds. The cold-rolled steel sheet may be held for 30 seconds to 600 seconds after the reheating to the temperature range of 150° C. to 500° C.

The process is an important process for setting the bainitic ferrite to be 30.0% or more, the residual austenite to be 10.0% or more, and the martensite to be 15.0% or less. When the cooling rate is less than 10.0° C./s or the cooling stop temperature exceeds 500° C., the ferrite is generated, and 30.0% or more of the bainitic ferrite cannot be ensured.

In addition, when the cooling rate exceeds 60.0° C./s or the cooling stop temperature is less than 150° C., the martensite transformation is promoted, and the area ratio of the martensite exceeds 15%. Therefore, the cold-rolled steel sheet is cooled to the temperature range of 150° C. to 500° C. at the cooling rate of 10.0° C./s to 60.0° C./s.

After this, by holding the cold-rolled steel sheet for 30 seconds or more within the temperature range, diffusion of C into the residual austenite contained in the metallographic structure of the cold-rolled steel sheet is promoted, the stability of the residual austenite is improved, and 10.0% or more of the residual austenite by the area ratio can be ensured. Meanwhile, when the holding time exceeds 600 seconds, generation of defects on the surface of the cold-rolled steel sheet and breaking of the cold-rolled steel sheet in a furnace are caused, there is a concern that productivity deteriorates, and thus, the upper limit is 600 seconds.

After cooing the cold-rolled steel sheet to the temperature range of 150° C. to 500° C. at the cooling temperature of 10.0° C./s to 60.0° C./s, and after reheating the cold-rolled steel sheet to the temperature range of 150° C. to 500° C., the cold-rolled steel sheet may be held for 30 seconds to 600 seconds. By the reheating, a lattice strain is introduced by a change in volume due to thermal expansion, diffusion of C into the austenite contained in the metallographic structure of the steel sheet is promoted by the lattice strain, it is possible to further improve stability of the residual austenite, and thus, it is possible to further improve the elongation and the hole expansibility by performing the reheating.

After the heat treatment process, as necessary, the steel sheet may be coiled. In this manner, it is possible to manufacture the cold-rolled steel sheet according to the embodiment.

In order to improve corrosion resistance or the like, as necessary, hot-dip galvanizing may be performed with respect to the steel sheet after the heat treatment process. Even when the hot-dip galvanizing is performed, it is possible to sufficiently maintain the strength, the hole expansibility, and ductility of the cold-rolled steel sheet.

In addition, as necessary, the heat treatment may be performed with respect to the steel sheet to which the hot-dip galvanizing is performed within a temperature range (eighth temperature range) of 450° C. to 600° C., as alloying treatment. The reason why the temperature of the allying treatment is 450° C. to 600° C. is that the alloying is not sufficiently performed in a case where the alloying treatment is performed at 450° C. or less. In addition, this is because, when the heat treatment is performed at a temperature that is 600° C. or more, the alloying is excessively performed, and corrosion resistance deteriorates.

In addition, the surface treatment may be performed with respect to the obtained cold-rolled steel sheet. For example, it is possible to employ the surface treatment, such as electro coating, deposition coating, alloying treatment after the coating, organic film forming, film laminate, organic/inorganic salt type treatment, or non-chromium treatment, with respect to the obtained cold-rolled steel sheet. Even when performing the above-described surface treatment, it is possible to sufficiently maintain uniform deformability and local deformability.

In addition, as necessary, tempering treatment may be performed with respect to the obtained cold-rolled steel sheet. A tempering condition can be appropriately determined, but for example, the tempering treatment of holding the cold-rolled steel sheet at 120 to 300° C. for 5 to 600 seconds may be performed. According to the tempering treatment, it is possible to soften the martensite as the tempered martensite. As a result, a hardness difference of the ferrite, the bainite, and the martensite which are primary phases decreases, and the hole expansibility is further improved. The effect of the reheating treatment can also be obtained by heating or the like for the above-described hot-dip plating or alloying treatment.

By the above-described manufacturing method, it is possible to obtain a high-strength cold-rolled steel sheet having excellent punching fatigue properties in which the tensile strength is 980 MPa or more and the 0.2% proof stress is 600 MPa or more, and excellent ductility and the hole expansibility in which the total elongation is 21.0% or more and the hole expansibility is 30.0% or more.

Next, the hot-rolled steel sheet according to the embodiment will be described.

The hot-rolled steel sheet according to the embodiment is a hot-rolled steel sheet which is used for manufacturing the cold-rolled steel sheet according to the embodiment. Therefore, the hot-rolled steel sheet includes the same composition as that of the cold-rolled steel sheet according to the embodiment.

In the hot-rolled steel sheet according to the embodiment, the metallographic structure contains the bainitic ferrite, and the area ratio of the bainitic ferrite in which the average value of the crystal orientation difference in the region surrounded by the boundary in which the crystal orientation difference is 15° or more is 0.5° or more and less than 3.0°, is 80.0% or more in the bainitic ferrite. As described above, in the bainitic ferrite having the crystal orientation properties, subboundaries exist at a high density in the grain. In the subboundaries, the dislocation introduced to the steel structure is accumulated during the cold rolling. Therefore, the subboundaries which exist in the hot-rolled steel sheet become a nucleation site of the recrystallized ferrite generated in the temperature range which is less than the Al transformation point from room temperature in the annealing process with respect to the cold-rolled steel sheet, and contribute to refining the annealing structure. When the area ratio of the bainitic ferrite having the above-described properties is less than 80.0%, a yield strength of the cold-rolled steel sheet for preventing the refining of the annealing structure deteriorates. In addition, a movement degree of the subboundaries which exist in the hot-rolled steel sheet is relatively small compared to a large angle boundary. Therefore, in a case of holding for 10 hours or less within the temperature range of the A1 transformation point or less, a remarkable decrease in subboundaries does not occur.

Due to the above-described reasons, by performing the process after the above-described holding process by using the hot-rolled steel sheet, it is possible to obtain the cold-rolled steel sheet according to the embodiment having a predetermined structure and properties.

In addition, the hot-rolled steel sheet according to the embodiment is obtained by performing the processes before the coiling process among the method of manufacturing the steel sheet (cold-rolled steel sheet) according to the above-described embodiment.

EXAMPLE

Next, Example of the present invention will be described. However, the condition in the Example is an example of one condition employed for confirming the possibility of realization and effects of the present invention, and the present invention is not limited to the example of one condition. The present invention can employ various conditions as long as the object of the present invention is achieved without departing from the main idea of the present invention.

The hot-rolled steel sheets were obtained by heating the cast slab including compositions A to CL illustrated in Tables 1-1 to 1-3 at 1100 to 1300° C. after the casting, directly or after one cooling, by performing the hot rolling under the conditions illustrated in Tables 2-1 to 2-12 and Tables 3-1 to 3-20, and by coiling. The hot-rolled sheet annealing was performed with respect to some of the hot-rolled steel sheets.

Furthermore, the cold-rolled steel sheets were obtained by performing the holding, the annealing, and the heat treatment with respect to the hot-rolled steel sheets. Furthermore, one or more of the tempering, the hot-dip galvanizing, and the alloying treatment are performed within the above-described condition range with respect to some of the cold-rolled steel sheets.

TABLE 1-1

| STEEL | COMPOSITION (% BY MASS), REMAINDER OF Fe AND IMPURITIES | | | | | | | | | | | | | | | | | | |
|---|---|---|---|---|---|---|---|---|---|---|---|---|---|---|---|---|---|---|---|
| TYPE No | C | Si | Mn | P | S | N | Al | Si + Al | Ti | Nb | V | B | Mo | Cr | Mg | REM | Ca | T1 (° C.) | REFERENCE |
| A | 0.118 | 1.5 | 3.0 | 0.003 | 0.0059 | 0.0031 | 1.315 | 2.815 | 0.056 | | | | | | | | | 902.9 | STEEL OF INVENTION |
| B | 0.123 | 2.0 | 3.9 | 0.001 | 0.0167 | 0.0062 | 0.994 | 2.994 | 0.054 | | | | | | | | | 895.7 | STEEL OF INVENTION |
| C | 0.151 | 1.5 | 2.9 | 0.010 | 0.0424 | 0.0058 | 0.423 | 1.923 | 0.038 | | | | | | | | | 892.6 | STEEL OF INVENTION |
| D | 0.172 | 0.9 | 3.8 | 0.012 | 0.0099 | 0.0037 | 0.701 | 1.601 | 0.099 | | | | | | | | | 885.7 | STEEL OF INVENTION |
| E | 0.186 | 2.1 | 3.1 | 0.002 | 0.0263 | 0.0072 | 0.443 | 2.543 | 0.035 | | | | | | | | | 891.6 | STEEL OF INVENTION |
| F | 0.207 | 3.9 | 2.7 | 0.002 | 0.0474 | 0.0099 | 0.449 | 4.349 | 0.034 | | | | | | | | | 904.6 | STEEL OF INVENTION |
| G | 0.214 | 2.1 | 1.7 | 0.014 | 0.0171 | 0.0016 | 0.045 | 2.145 | 0.132 | | | | | | | | | 894.5 | STEEL OF INVENTION |
| H | 0.229 | 2.9 | 3.8 | 0.009 | 0.0001 | 0.0069 | 0.430 | 3.330 | 0.135 | | | | | | | | | 887.3 | STEEL OF INVENTION |
| I | 0.243 | 2.4 | 2.6 | 0.006 | 0.0044 | 0.0042 | 0.657 | 3.057 | 0.061 | | | | | | | | | 894.7 | STEEL OF INVENTION |
| J | 0.256 | 3.5 | 2.4 | 0.009 | 0.0287 | 0.0047 | 1.115 | 4.615 | 0.032 | | | | | | | | | 907.4 | STEEL OF INVENTION |
| K | 0.263 | 3.3 | 1.4 | 0.007 | 0.0007 | 0.0036 | 0.632 | 3.932 | 0.141 | | | | | | | | | 906.6 | STEEL OF INVENTION |
| L | 0.289 | 2.0 | 3.7 | 0.004 | 0.0373 | 0.0083 | 0.001 | 2.001 | 0.114 | | | | | | | | | 875.5 | STEEL OF INVENTION |
| M | 0.297 | 1.6 | 3.6 | 0.014 | 0.0361 | 0.0005 | 1.372 | 2.972 | 0.149 | | | | | | | | | 887.4 | STEEL OF INVENTION |
| N | 0.304 | 1.1 | 1.8 | 0.010 | 0.0371 | 0.0014 | 0.486 | 1.586 | 0.052 | | | | | | | | | 890.3 | STEEL OF INVENTION |
| O | 0.331 | 0.8 | 1.4 | 0.011 | 0.0003 | 0.0023 | 1.488 | 2.288 | 0.042 | | | | | | | | | 901.3 | STEEL OF INVENTION |
| P | 0.367 | 1.3 | 3.8 | 0.008 | 0.0016 | 0.0035 | 0.566 | 1.866 | 0.087 | | | | | | | | | 873.6 | STEEL OF INVENTION |
| Q | 0.391 | 3.1 | 2.2 | 0.013 | 0.0336 | 0.0056 | 0.179 | 3.279 | 0.030 | | | | | | | | | 889.3 | STEEL OF INVENTION |
| R | 0.401 | 2.1 | 1.9 | 0.008 | 0.0126 | 0.0008 | 0.962 | 3.062 | 0.045 | | | | | | | | | 893.1 | STEEL OF INVENTION |
| S | 0.411 | 2.4 | 1.2 | 0.003 | 0.0224 | 0.0023 | 0.340 | 2.740 | 0.031 | | | | | | | | | 893.5 | STEEL OF INVENTION |
| T | 0.419 | 2.7 | 3.3 | 0.004 | 0.0201 | 0.0082 | 0.470 | 3.170 | 0.036 | | | | | | | | | 880.7 | STEEL OF INVENTION |
| U | 0.432 | 2.3 | 2.1 | 0.006 | 0.0064 | 0.0032 | 1.639 | 3.939 | 0.075 | | | | | | | | | 897.4 | STEEL OF INVENTION |
| V | 0.452 | 1.4 | 3.6 | 0.014 | 0.0106 | 0.0011 | 1.885 | 3.285 | 0.118 | | | | | | | | | 884.5 | STEEL OF INVENTION |
| W | 0.462 | 3.8 | 1.1 | 0.006 | 0.0032 | 0.0007 | 0.574 | 4.374 | 0.021 | | | | | | | | | 903.9 | STEEL OF INVENTION |
| X | 0.487 | 1.8 | 1.6 | 0.004 | 0.0254 | 0.0031 | 1.746 | 3.546 | 0.028 | | | | | | | | | 898.2 | STEEL OF INVENTION |
| Y | 0.091 | 3.8 | 3.5 | 0.008 | 0.0293 | 0.0030 | 1.714 | 5.514 | 0.109 | | | | | | | | | 918.2 | STEEL FOR COMPARISON |
| Z | 0.133 | 1.9 | 3.4 | 0.013 | 0.0331 | 0.0107 | 1.744 | 3.644 | 0.126 | | | | | | | | | 903.9 | STEEL FOR COMPARISON |
| AA | 0.152 | 0.8 | 3.0 | 0.0100 | 0.0157 | 0.0097 | 0.154 | 0.954 | 0.072 | | | | | | | | | 886.6 | STEEL FOR COMPARISON |
| AB | 0.181 | 3.4 | 4.3 | 0.002 | 0.0082 | 0.0017 | 0.792 | 4.192 | 0.141 | | | | | | | | | 894.5 | STEEL FOR COMPARISON |
| AC | 0.243 | 1.2 | 3.7 | 0.016 | 0.0389 | 0.0036 | 1.811 | 3.011 | 0.130 | | | | | | | | | 893.2 | STEEL FOR COMPARISON |
| AD | 0.252 | 2.1 | 0.8 | 0.007 | 0.0013 | 0.0062 | 0.823 | 2.923 | 0.030 | | | | | | | | | 908.5 | STEEL FOR COMPARISON |
| AE | 0.273 | 0.7 | 2.1 | 0.002 | 0.0277 | 0.0075 | 0.372 | 1.072 | 0.058 | | | | | | | | | 887.5 | STEEL FOR COMPARISON |
| AF | 0.331 | 2.6 | 3.5 | 0.003 | 0.0010 | 0.0008 | 1.050 | 3.650 | 0.018 | | | | | | | | | 889.6 | STEEL FOR COMPARISON |
| AG | 0.343 | 1.5 | 3.3 | 0.011 | 0.0125 | 0.0092 | 2.097 | 3.597 | 0.135 | | | | | | | | | 893.6 | STEEL FOR COMPARISON |
| AH | 0.380 | 1.8 | 1.1 | 0.002 | 0.0514 | 0.0008 | 0.174 | 1.974 | 0.134 | | | | | | | | | 889.8 | STEEL FOR COMPARISON |

TABLE 1-1-continued

| STEEL TYPE No | C | Si | Mn | P | S | N | Al | Si + Al | Ti | Nb | V | B | Mo | Cr | Mg | REM | Ca | T1 (° C.) | REFERENCE |
|---|---|---|---|---|---|---|---|---|---|---|---|---|---|---|---|---|---|---|---|
| | COMPOSITION (% BY MASS), REMAINDER OF Fe AND IMPURITIES | | | | | | | | | | | | | | | | | | |
| AI | 0.395 | 4.2 | 3.4 | 0.002 | 0.0379 | 0.0051 | 0.088 | 4.288 | 0.102 | | | | | | | | | 887.6 | STEEL FOR COMPARISON |
| AJ | 0.488 | 2.9 | 3.9 | 0.009 | 0.0487 | 0.0009 | 0.200 | 3.100 | 0.155 | | | | | | | | | 871.0 | STEEL FOR COMPARISON |
| AK | 0.527 | 3.9 | 2.8 | 0.012 | 0.0246 | 0.0044 | 1.979 | 5.879 | 0.111 | | | | | | | | | 902.0 | STEEL FOR COMPARISON |

UNDERLINES INDICATE THAT VALUES FALL OUTSIDE THE RANGE OF THE PRESENT INVENTION.

TABLE 1-2

| STEEL TYPE No | C | Si | Mn | P | S | N | Al | Si + Al | Ti | Nb | V | B |
|---|---|---|---|---|---|---|---|---|---|---|---|---|
| | COMPOSITION (% BY MASS), REMAINDER OF Fe AND IMPURITIES | | | | | | | | | | | |
| AL | 0.112 | 3.7 | 3.4 | 0.012 | 0.0091 | 0.0039 | 1.782 | 5.482 | 0.067 | 0.117 | 0.084 | 0.0025 |
| AM | 0.115 | 1.3 | 1.8 | 0.001 | 0.0086 | 0.0069 | 0.619 | 1.919 | 0.057 | 0.167 | 0.059 | 0.0022 |
| AN | 0.121 | 3.8 | 3.4 | 0.006 | 0.0333 | 0.0011 | 1.743 | 5.543 | 0.040 | 0.074 | 0.362 | 0.0025 |
| AO | 0.128 | 1.7 | 1.6 | 0.009 | 0.0188 | 0.0032 | 0.358 | 2.058 | 0.053 | 0.193 | 0.493 | 0.0006 |
| AP | 0.154 | 1.2 | 3.8 | 0.009 | 0.0174 | 0.0099 | 0.282 | 1.482 | 0.088 | 0.039 | 0.395 | 0.0016 |
| AQ | 0.163 | 1.1 | 1.4 | 0.009 | 0.0014 | 0.0005 | 1.346 | 2.446 | 0.106 | 0.115 | 0.367 | 0.0028 |
| AR | 0.180 | 1.3 | 2.0 | 0.014 | 0.0447 | 0.0061 | 0.060 | 1.360 | 0.094 | 0.096 | 0.162 | 0.0017 |
| AS | 0.194 | 0.9 | 2.7 | 0.004 | 0.0315 | 0.0018 | 0.734 | 1.634 | 0.108 | 0.178 | 0.184 | 0.0028 |
| AT | 0.219 | 1.9 | 1.5 | 0.001 | 0.0198 | 0.0095 | 0.638 | 2.538 | 0.047 | 0.044 | 0.073 | 0.0015 |
| AU | 0.222 | 3.4 | 2.9 | 0.005 | 0.0004 | 0.0022 | 0.487 | 3.887 | 0.102 | 0.157 | 0.455 | 0.0012 |
| AV | 0.263 | 3.3 | 3.2 | 0.013 | 0.0269 | 0.0064 | 1.267 | 4.567 | 0.028 | 0.192 | 0.051 | 0.0020 |
| AW | 0.316 | 1.1 | 1.3 | 0.003 | 0.0211 | 0.0007 | 0.981 | 2.081 | 0.139 | 0.138 | 0.202 | 0.0015 |
| AX | 0.320 | 2.9 | 1.3 | 0.004 | 0.0054 | 0.0078 | 1.897 | 4.797 | 0.141 | 0.062 | 0.383 | 0.0026 |
| AY | 0.331 | 2.6 | 2.7 | 0.014 | 0.0017 | 0.0081 | 0.001 | 2.601 | 0.145 | 0.171 | 0.277 | 0.0023 |
| AZ | 0.337 | 2.1 | 2.4 | 0.001 | 0.0488 | 0.0009 | 1.466 | 3.566 | 0.066 | 0.128 | 0.413 | 0.0029 |
| BA | 0.360 | 3.3 | 1.3 | 0.008 | 0.0366 | 0.0041 | 1.666 | 4.966 | 0.064 | 0.187 | 0.294 | 0.0024 |
| BB | 0.365 | 1.9 | 1.2 | 0.010 | 0.0049 | 0.0014 | 1.088 | 2.988 | 0.130 | 0.106 | 0.331 | 0.0018 |
| BC | 0.378 | 2.3 | 1.2 | 0.007 | 0.0393 | 0.0051 | 1.979 | 4.279 | 0.034 | 0.019 | 0.117 | 0.0009 |
| BD | 0.398 | 1.5 | 1.3 | 0.002 | 0.0135 | 0.0055 | 1.056 | 2.556 | 0.052 | 0.145 | 0.221 | 0.0003 |
| BE | 0.452 | 3.6 | 3.3 | 0.004 | 0.0001 | 0.0014 | 1.225 | 4.825 | 0.143 | 0.096 | 0.336 | 0.0002 |
| BF | 0.454 | 3.7 | 3.2 | 0.010 | 0.0037 | 0.0092 | 1.575 | 5.275 | 0.021 | 0.028 | 0.458 | 0.0010 |
| BG | 0.466 | 0.9 | 1.9 | 0.003 | 0.0220 | 0.0047 | 1.365 | 2.265 | 0.116 | 0.082 | 0.256 | 0.0009 |
| BH | 0.470 | 2.5 | 3.9 | 0.013 | 0.0169 | 0.0085 | 1.255 | 3.755 | 0.077 | 0.013 | 0.400 | 0.0013 |
| BI | 0.493 | 3.9 | 3.4 | 0.004 | 0.0047 | 0.0023 | 1.008 | 4.908 | 0.064 | 0.045 | 0.434 | 0.0008 |

| STEEL TYPE No | Mo | Cr | Mg | REM | Ca | T1 (° C.) | REFERENCE |
|---|---|---|---|---|---|---|---|
| | COMPOSITION (% BY MASS), REMAINDER OF Fe AND IMPURITIES | | | | | | |
| AL | 0.030 | 1.044 | 0.0155 | 0.0145 | 0.0203 | 917.8 | STEEL OF INVENTION |
| AM | 0.076 | 0.937 | 0.0390 | 0.0354 | 0.0086 | 903.9 | STEEL OF INVENTION |
| AN | 0.385 | 0.322 | 0.0250 | 0.0050 | 0.0141 | 918.1 | STEEL OF INVENTION |
| AO | 0.046 | 1.719 | 0.0179 | 0.0183 | 0.0293 | 903.5 | STEEL OF INVENTION |
| AP | 0.225 | 1.131 | 0.0128 | 0.0123 | 0.0087 | 883.5 | STEEL OF INVENTION |
| AQ | 0.058 | 1.366 | 0.0070 | 0.0310 | 0.0201 | 909.8 | STEEL OF INVENTION |
| AR | 0.191 | 0.218 | 0.0094 | 0.0240 | 0.0317 | 891.9 | STEEL OF INVENTION |
| AS | 0.206 | 0.679 | 0.0331 | 0.0262 | 0.0035 | 891.5 | STEEL OF INVENTION |
| AT | 0.155 | 1.941 | 0.0291 | 0.0051 | 0.0271 | 901.8 | STEEL OF INVENTION |
| AU | 0.178 | 0.398 | 0.0277 | 0.0235 | 0.0248 | 898.0 | STEEL OF INVENTION |
| AV | 0.096 | 0.515 | 0.0256 | 0.0029 | 0.0381 | 901.6 | STEEL OF INVENTION |
| AW | 0.348 | 1.839 | 0.0074 | 0.0251 | 0.0166 | 897.2 | STEEL OF INVENTION |
| AX | 0.143 | 1.970 | 0.0093 | 0.0025 | 0.0146 | 914.0 | STEEL OF INVENTION |
| AY | 0.211 | 0.092 | 0.0049 | 0.0158 | 0.0201 | 882.2 | STEEL OF INVENTION |
| AZ | 0.113 | 1.486 | 0.0222 | 0.0282 | 0.0397 | 897.4 | STEEL OF INVENTION |
| BA | 0.015 | 0.698 | 0.0258 | 0.0012 | 0.0087 | 913.5 | STEEL OF INVENTION |
| BB | 0.317 | 0.115 | 0.0305 | 0.0314 | 0.0013 | 899.4 | STEEL OF INVENTION |
| BC | 0.032 | 1.302 | 0.0366 | 0.0063 | 0.0356 | 910.8 | STEEL OF INVENTION |
| BD | 0.192 | 0.473 | 0.0075 | 0.0006 | 0.0078 | 896.1 | STEEL OF INVENTION |
| BE | 0.335 | 1.651 | 0.0110 | 0.0298 | 0.0071 | 891.5 | STEEL OF INVENTION |
| BF | 0.294 | 1.408 | 0.0043 | 0.0164 | 0.0027 | 897.9 | STEEL OF INVENTION |
| BG | 0.249 | 0.826 | 0.0114 | 0.0092 | 0.0054 | 888.8 | STEEL OF INVENTION |
| BH | 0.119 | 0.577 | 0.0021 | 0.0395 | 0.0106 | 880.9 | STEEL OF INVENTION |
| BI | 0.269 | 1.267 | 0.0200 | 0.0211 | 0.0166 | 890.5 | STEEL OF INVENTION |

TABLE 1-3

| STEEL TYPE | COMPOSITION (% BY MASS), REMAINDER OF Fe AND IMPURITIES | | | | | | | | | | | |
|---|---|---|---|---|---|---|---|---|---|---|---|---|
| No | C | Si | Mn | P | S | N | Al | Si + Al | Ti | Nb | V | B |
| BJ | 0.082 | 1.2 | 2.2 | 0.014 | 0.0053 | 0.0050 | 1.212 | 2.412 | 0.022 | 0.186 | 0.014 | 0.0028 |
| BK | 0.108 | 4.1 | 1.3 | 0.002 | 0.0129 | 0.0086 | 1.240 | 5.340 | 0.080 | 0.033 | 0.481 | 0.0002 |
| BM | 0.128 | 1.7 | 1.1 | 0.002 | 0.0496 | 0.0094 | 1.428 | 3.128 | 0.089 | 0.126 | 0.344 | 0.0021 |
| BN | 0.157 | 3.1 | 3.8 | 0.007 | 0.0180 | 0.0098 | 0.894 | 3.994 | 0.049 | 0.113 | 0.522 | 0.0025 |
| BP | 0.165 | 0.7 | 1.1 | 0.003 | 0.0246 | 0.0014 | 0.330 | 1.030 | 0.026 | 0.123 | 0.176 | 0.0025 |
| BR | 0.183 | 3.0 | 2.7 | 0.013 | 0.0455 | 0.0086 | 1.055 | 4.055 | 0.125 | 0.156 | 0.191 | 0.0004 |
| BS | 0.201 | 2.9 | 1.3 | 0.006 | 0.0294 | 0.0118 | 0.677 | 3.577 | 0.031 | 0.166 | 0.380 | 0.0005 |
| BU | 0.226 | 1.9 | 1.9 | 0.009 | 0.0142 | 0.0099 | 1.183 | 3.083 | 0.102 | 0.046 | 0.467 | 0.0016 |
| BV | 0.270 | 2.9 | 1.7 | 0.016 | 0.0167 | 0.0034 | 0.115 | 3.015 | 0.072 | 0.093 | 0.240 | 0.0023 |
| BX | 0.303 | 2.9 | 1.9 | 0.004 | 0.0290 | 0.0085 | 1.316 | 4.216 | 0.019 | 0.184 | 0.488 | 0.0024 |
| BY | 0.318 | 1.2 | 3.2 | 0.009 | 0.0511 | 0.0044 | 1.430 | 2.630 | 0.141 | 0.090 | 0.134 | 0.0019 |
| BZ | 0.327 | 3.4 | 2.8 | 0.002 | 0.0183 | 0.0096 | 1.343 | 4.743 | 0.140 | 0.168 | 0.433 | 0.0029 |
| CA | 0.331 | 0.9 | 2.3 | 0.004 | 0.0464 | 0.0052 | 1.456 | 2.356 | 0.061 | 0.206 | 0.389 | 0.0020 |
| CC | 0.375 | 0.9 | 1.8 | 0.014 | 0.0473 | 0.0032 | 0.034 | 0.934 | 0.072 | 0.036 | 0.139 | 0.0003 |
| CE | 0.412 | 2.4 | 2.7 | 0.003 | 0.0155 | 0.0063 | 1.388 | 3.788 | 0.158 | 0.024 | 0.030 | 0.0028 |
| CF | 0.430 | 3.9 | 2.6 | 0.011 | 0.0293 | 0.0037 | 2.152 | 6.052 | 0.037 | 0.070 | 0.130 | 0.0026 |
| CG | 0.431 | 1.6 | 0.9 | 0.013 | 0.0498 | 0.0092 | 1.716 | 3.316 | 0.027 | 0.120 | 0.125 | 0.0016 |
| CI | 0.449 | 3.4 | 4.1 | 0.006 | 0.0442 | 0.0089 | 0.021 | 3.421 | 0.044 | 0.102 | 0.233 | 0.0002 |
| CJ | 0.459 | 1.5 | 2.0 | 0.011 | 0.0299 | 0.0067 | 0.477 | 1.977 | 0.032 | 0.081 | 0.093 | 0.0033 |
| CK | 0.481 | 2.5 | 3.5 | 0.006 | 0.0485 | 0.0045 | 1.849 | 4.349 | 0.054 | 0.064 | 0.027 | 0.0008 |
| CL | 0.513 | 1.3 | 1.4 | 0.009 | 0.0267 | 0.0082 | 0.980 | 2.280 | 0.128 | 0.155 | 0.419 | 0.0018 |

| STEEL TYPE | COMPOSITION (% BY MASS), REMAINDER OF Fe AND IMPURITIES | | | | | T1 | |
|---|---|---|---|---|---|---|---|
| No | Mo | Cr | Mg | REM | Ca | (° C.) | REFERENCE |
| BJ | 0.356 | 1.006 | 0.0252 | 0.0104 | 0.0240 | 909.5 | STEEL FOR COMPARISON |
| BK | 0.248 | 1.886 | 0.0290 | 0.0295 | 0.0031 | 930.6 | STEEL FOR COMPARISON |
| BM | 0.386 | 2.088 | 0.0335 | 0.0135 | 0.0149 | 917.4 | STEEL FOR COMPARISON |
| BN | 0.077 | 0.586 | 0.0111 | 0.0161 | 0.0080 | 899.1 | STEEL FOR COMPARISON |
| BP | 0.488 | 0.077 | 0.0188 | 0.0214 | 0.0141 | 902.2 | STEEL FOR COMPARISON |
| BR | 0.421 | 1.106 | 0.0131 | 0.0040 | 0.0431 | 904.2 | STEEL FOR COMPARISON |
| BS | 0.154 | 0.342 | 0.0112 | 0.0370 | 0.0154 | 910.4 | STEEL FOR COMPARISON |
| BU | 0.255 | 1.145 | 0.0416 | 0.0244 | 0.0381 | 902.9 | STEEL FOR COMPARISON |
| BV | 0.187 | 0.422 | 0.0211 | 0.0074 | 0.0255 | 897.0 | STEEL FOR COMPARISON |
| BX | 0.175 | 1.866 | 0.0287 | 0.0374 | 0.0043 | 906.3 | STEEL FOR COMPARISON |
| BY | 0.100 | 0.508 | 0.0398 | 0.0308 | 0.0096 | 888.0 | STEEL FOR COMPARISON |
| BZ | 0.059 | 1.567 | 0.0036 | 0.0424 | 0.0264 | 900.4 | STEEL FOR COMPARISON |
| CA | 0.423 | 1.411 | 0.0373 | 0.0157 | 0.0206 | 894.1 | STEEL FOR COMPARISON |
| CC | 0.162 | 0.284 | 0.0032 | 0.0345 | 0.0031 | 881.1 | STEEL FOR COMPARISON |
| CE | 0.201 | 1.109 | 0.0366 | 0.0174 | 0.0055 | 890.7 | STEEL FOR COMPARISON |
| CF | 0.237 | 0.744 | 0.0051 | 0.0360 | 0.0070 | 910.3 | STEEL FOR COMPARISON |
| CG | 0.271 | 0.628 | 0.0155 | 0.0368 | 0.0041 | 905.0 | STEEL FOR COMPARISON |
| CI | 0.475 | 1.739 | 0.0075 | 0.0096 | 0.0161 | 874.5 | STEEL FOR COMPARISON |
| CJ | 0.294 | 1.390 | 0.0026 | 0.0119 | 0.0144 | 882.4 | STEEL FOR COMPARISON |
| CK | 0.548 | 0.810 | 0.0296 | 0.0319 | 0.0155 | 889.2 | STEEL FOR COMPARISON |
| CL | 0.496 | 1.140 | 0.0136 | 0.0359 | 0.0138 | 887.7 | STEEL FOR COMPARISON |

UNDERLINES INDICATE THAT VALUES FALL OUTSIDE THE RANGE OF THE PRESENT INVENTION.

TABLE 2-1

| | | MANUFACTURING CONDITION HOT ROLLING CONDITION | | | | | | | |
|---|---|---|---|---|---|---|---|---|---|
| MANUFAC-TURING NO. | STEEL TYPE | HEATING TEMPERATURE (° C.) | HEATING TIME (hr) | NUMBER OF TIMES OF ROUGH ROLLING | REDUCTION AT 1000 TO 1150° C. (%) | ROLLING REDUCTION AT T1 TO T1 + 150° C. (%) | FT (° C.) | TIME PERIOD UNTIL STARTING COOLING | FIRST COOLING RATE (° C./s) |
| A-1 | A | 1200 | 2.7 | 3 | 51 | 96 | 905 | 0.6 | 44 |
| B-1 | B | 1204 | 2.1 | 5 | 56 | 91 | 929 | 4.2 | 49 |
| C-1 | C | 1205 | 0.5 | 7 | 57 | 97 | 897 | 0.9 | 42 |
| D-1 | D | 1215 | 1.9 | 5 | 52 | 96 | 891 | 1.6 | 42 |
| E-1 | E | 1201 | 2.5 | 7 | 53 | 90 | 886 | 4.8 | 50 |
| F-1 | F | 1194 | 2.4 | 6 | 55 | 94 | 906 | 4.8 | 41 |
| G-1 | G | 1175 | 1.3 | 5 | 58 | 88 | 932 | 1.3 | 46 |
| H-1 | H | 1168 | 2.3 | 3 | 57 | 95 | 891 | 2.3 | 49 |
| I-1 | I | 1207 | 2.0 | 7 | 56 | 93 | 928 | 2.3 | 46 |
| J-1 | J | 1204 | 1.6 | 3 | 58 | 91 | 950 | 3.7 | 44 |

TABLE 2-1-continued

| MANUFACTURING NO. | STEEL TYPE | MANUFACTURING CONDITION HOT ROLLING CONDITION HEATING TEMPERATURE (° C.) | HEATING TIME (hr) | NUMBER OF TIMES OF ROUGH ROLLING | REDUCTION AT 1000 TO 1150° C. (%) | ROLLING REDUCTION AT T1 TO T1 + 150° C. (%) | FT (° C.) | TIME PERIOD UNTIL STARTING COOLING | FIRST COOLING RATE (° C./s) |
|---|---|---|---|---|---|---|---|---|---|
| K-1 | K | 1210 | 1.2 | 3 | 50 | 87 | 889 | 2.0 | 42 |
| L-1 | L | 1168 | 2.2 | 7 | 56 | 88 | 913 | 1.9 | 50 |
| M-1 | M | 1185 | 0.7 | 3 | 58 | 90 | 925 | 4.9 | 42 |
| N-1 | N | 1210 | 2.6 | 5 | 50 | 96 | 902 | 0.3 | 46 |
| O-1 | O | 1183 | 2.5 | 7 | 51 | 93 | 957 | 0.9 | 47 |
| P-1 | P | 1163 | 2.4 | 3 | 56 | 87 | 932 | 4.8 | 44 |
| Q-1 | Q | 1167 | 1.0 | 3 | 50 | 90 | 916 | 4.2 | 45 |
| R-1 | R | 1208 | 1.2 | 5 | 57 | 97 | 914 | 1.7 | 43 |
| S-1 | S | 1180 | 0.6 | 3 | 58 | 88 | 915 | 4.6 | 42 |
| T-1 | T | 1195 | 2.1 | 5 | 56 | 92 | 912 | 4.9 | 44 |
| U-1 | U | 1177 | 1.3 | 3 | 51 | 97 | 966 | 1.1 | 47 |
| V-1 | V | 1218 | 1.7 | 5 | 53 | 95 | 921 | 0.1 | 48 |
| W-1 | W | 1169 | 1.8 | 3 | 54 | 92 | 905 | 4.3 | 49 |
| X-1 | X | 1171 | 1.1 | 7 | 56 | 87 | 901 | 4.8 | 43 |
| Y-1 | Y | 1191 | 1.2 | 3 | 57 | 89 | 932 | 1.6 | 43 |
| Z-1 | Z | 1180 | 0.7 | 7 | 53 | 95 | 885 | 2.8 | 45 |
| AA-1 | AA | 1218 | 1.8 | 3 | 51 | 90 | 925 | 1.0 | 44 |
| AB-1 | AB | 1166 | 2.3 | 5 | 53 | 95 | 890 | 2.4 | 48 |
| AC-1 | AC | 1182 | 1.0 | 3 | 55 | 97 | 931 | 3.1 | 45 |
| AD-1 | AD | 1172 | 2.6 | 5 | 52 | 88 | 948 | 2.4 | 42 |

TABLE 2-2

| MANUFACTURING NO. | STEEL TYPE | MANUFACTURING CONDITION HOT ROLLING CONDITION HEATING TEMPERATURE (° C.) | HEATING TIME (hr) | NUMBER OF TIMES OF ROUGH ROLLING | REDUCTION AT 1000 TO 1150° C. (%) | ROLLING REDUCTION AT T1 TO T1 + 150° C. (%) | FT (° C.) | TIME PERIOD UNTIL STARTING COOLING | FIRST COOLING RATE (° C./s) |
|---|---|---|---|---|---|---|---|---|---|
| AE-1 | AE | 1181 | 0.7 | 5 | 56 | 86 | 885 | 1.7 | 50 |
| AF-1 | AF | 1176 | 1.5 | 5 | 53 | 90 | 923 | 3.0 | 49 |
| AG-1 | AG | 1197 | 1.0 | 5 | 59 | 96 | 914 | 4.1 | 45 |
| AH-1 | AH | 1187 | 2.6 | 7 | 54 | 91 | 920 | 3.7 | 47 |
| AI-1 | AI | 1182 | 0.5 | 5 | 59 | 92 | 879 | 0.4 | 48 |
| AJ-1 | AJ | 1182 | 0.8 | 5 | 51 | 90 | 936 | 3.6 | 48 |
| AK-1 | AK | 1195 | 1.4 | 5 | 58 | 89 | 938 | 0.7 | 42 |
| AL-1 | AL | 1163 | 0.7 | 5 | 54 | 86 | 905 | 2.9 | 47 |
| AM-1 | AM | 1175 | 2.3 | 5 | 57 | 89 | 931 | 2.8 | 42 |
| AN-1 | AN | 1169 | 1.6 | 3 | 50 | 87 | 891 | 2.7 | 47 |
| AO-1 | AO | 1211 | 1.5 | 3 | 55 | 88 | 952 | 0.9 | 45 |
| AP-1 | AP | 1188 | 1.5 | 5 | 52 | 94 | 927 | 1.7 | 45 |
| AQ-1 | AQ | 1202 | 2.1 | 5 | 58 | 87 | 905 | 2.1 | 47 |
| AR-1 | AR | 1186 | 1.8 | 7 | 58 | 86 | 945 | 3.8 | 46 |
| AS-1 | AS | 1166 | 1.4 | 3 | 59 | 92 | 910 | 4.7 | 46 |
| AT-1 | AT | 1173 | 1.3 | 7 | 51 | 95 | 888 | 1.9 | 42 |
| AU-1 | AU | 1173 | 1.8 | 3 | 57 | 87 | 894 | 3.7 | 48 |
| AV-1 | AV | 1181 | 1.4 | 3 | 52 | 88 | 909 | 4.2 | 48 |
| AW-1 | AW | 1210 | 2.2 | 3 | 53 | 88 | 911 | 0.3 | 48 |
| AX-1 | AX | 1167 | 2.2 | 5 | 51 | 90 | 945 | 2.5 | 44 |
| AY-1 | AY | 1175 | 1.2 | 5 | 57 | 88 | 907 | 3.2 | 49 |
| AZ-1 | AZ | 1207 | 3.0 | 3 | 53 | 86 | 889 | 2.8 | 47 |
| BA-1 | BA | 1200 | 2.8 | 5 | 53 | 95 | 889 | 4.7 | 45 |
| BB-1 | BB | 1190 | 0.6 | 3 | 54 | 92 | 920 | 4.8 | 43 |
| BC-1 | BC | 1188 | 2.5 | 7 | 53 | 91 | 947 | 2.4 | 41 |
| BD-1 | BD | 1170 | 0.9 | 5 | 50 | 90 | 940 | 0.9 | 45 |
| BE-1 | BE | 1187 | 2.5 | 5 | 53 | 88 | 898 | 0.1 | 47 |
| BF-1 | BF | 1196 | 1.6 | 5 | 52 | 90 | 940 | 2.3 | 44 |
| BG-1 | BG | 1220 | 0.8 | 3 | 57 | 90 | 896 | 4.2 | 44 |
| BH-1 | BH | 1172 | 1.1 | 5 | 57 | 88 | 873 | 2.7 | 45 |

TABLE 2-3

| MANUFACTURING NO. | STEEL TYPE | MANUFACTURING CONDITION HOT ROLLING CONDITION HEATING TEMPERATURE (° C.) | HEATING TIME (hr) | NUMBER OF TIMES OF ROUGH ROLLING | REDUCTION AT 1000 TO 1150° C. (%) | ROLLING REDUCTION AT T1 TO T1 + 150° C. (%) | FT (° C.) | TIME PERIOD UNTIL STARTING COOLING | FIRST COOLING RATE (° C./s) |
|---|---|---|---|---|---|---|---|---|---|
| BI-1 | BI | 1200 | 2.2 | 3 | 56 | 94 | 929 | 4.8 | 41 |
| BJ-1 | BJ | 1196 | 1.6 | 7 | 54 | 95 | 898 | 4.7 | 43 |
| BL-1 | BL | 1178 | 0.7 | 7 | 56 | 86 | 940 | 2.3 | 48 |
| BM-1 | BM | 1219 | 1.7 | 5 | 53 | 90 | 980 | 2.1 | 45 |
| BN-1 | BN | 1215 | 1.5 | 7 | 59 | 92 | 929 | 4.1 | 44 |
| BO-1 | BO | 1174 | 0.7 | 5 | 50 | 94 | 962 | 4.5 | 44 |
| BP-1 | BP | 1214 | 0.8 | 5 | 54 | 88 | 901 | 0.2 | 43 |
| BR-1 | NR | 1201 | 2.5 | 3 | 57 | 94 | 905 | 2.5 | 47 |
| BS-1 | BS | 1167 | 2.2 | 5 | 50 | 88 | 946 | 1.4 | 48 |
| BU-1 | BU | 1168 | 2.7 | 7 | 57 | 86 | 911 | 1.3 | 42 |
| BV-1 | BV | 1195 | 1.8 | 5 | 56 | 90 | 896 | 4.6 | 45 |
| BX-1 | BX | 1193 | 2.8 | 3 | 52 | 94 | 889 | 0.7 | 48 |
| BY-1 | BY | 1208 | 2.6 | 5 | 54 | 97 | 936 | 3.9 | 44 |
| BZ-1 | BZ | 1174 | 1.5 | 5 | 53 | 96 | 959 | 4.2 | 48 |
| CA-1 | CA | 1176 | 1.0 | 7 | 56 | 89 | 893 | 4.7 | 41 |
| CC-1 | CC | 1192 | 2.5 | 7 | 51 | 91 | 947 | 1.8 | 47 |
| CE-1 | CE | 1197 | 2.6 | 3 | 55 | 89 | 912 | 0.8 | 47 |
| CF-1 | CF | 1201 | 2.6 | 5 | 51 | 94 | 915 | 2.8 | 48 |
| CG-1 | CG | 1211 | 2.9 | 5 | 58 | 91 | 952 | 1.9 | 45 |
| CI-1 | CI | 1196 | 2.7 | 7 | 58 | 92 | 886 | 3.4 | 46 |
| CJ-1 | CJ | 1202 | 1.8 | 5 | 57 | 87 | 900 | 3.7 | 43 |
| CK-1 | CK | 1180 | 0.9 | 3 | 53 | 93 | 891 | 4.1 | 45 |
| CL-1 | CL | 1196 | 1.9 | 7 | 51 | 86 | 914 | 4.0 | 47 |

TABLE 2-4

| MANUFACTURING NO. | MANUFACTURING CONDITION HOT ROLLING CONDITION t (s) | HOLDING TIME (s) | CT (° C.) | SHEET THICKNESS (mm) | COLD ROLLING CONDITION COLD ROLLING REDUCTION (%) | SHEET THICKNESS AFTER COLD ROLLING(mm) | ANNEALING CONDITION ANNEALING TEMPERATURE (° C.) | HOLDING TIME (s) |
|---|---|---|---|---|---|---|---|---|
| A-1 | 1.98 | 3.03 | 502 | 2.4 | 53.9 | 1.1 | 910 | 96 |
| B-1 | 2.11 | 3.92 | 507 | 2.2 | 54.8 | 1.0 | 910 | 110 |
| C-1 | 2.06 | 3.49 | 504 | 2.3 | 53.4 | 1.1 | 900 | 121 |
| D-1 | 2.04 | 3.63 | 501 | 2.4 | 53.6 | 1.1 | 900 | 114 |
| E-1 | 2.13 | 3.85 | 509 | 2.2 | 50.6 | 1.1 | 900 | 113 |
| F-1 | 2.11 | 3.14 | 513 | 2.4 | 56.2 | 1.1 | 910 | 93 |
| G-1 | 1.75 | 3.61 | 506 | 2.2 | 50.2 | 1.1 | 900 | 95 |
| H-1 | 2.02 | 3.43 | 511 | 2.3 | 55.4 | 1.0 | 900 | 110 |
| I-1 | 2.08 | 3.95 | 517 | 2.4 | 50.9 | 1.2 | 900 | 117 |
| J-1 | 2.14 | 3.54 | 516 | 2.4 | 54.4 | 1.1 | 920 | 97 |
| K-1 | 1.75 | 3.74 | 510 | 2.2 | 50.3 | 1.1 | 920 | 104 |
| L-1 | 2.14 | 3.78 | 519 | 2.3 | 58.0 | 1.0 | 890 | 110 |
| M-1 | 2.05 | 3.25 | 512 | 2.2 | 56.6 | 1.0 | 900 | 110 |
| N-1 | 2.08 | 3.31 | 515 | 2.4 | 54.1 | 1.1 | 900 | 95 |
| O-1 | 2.08 | 3.91 | 508 | 2.1 | 52.8 | 1.0 | 910 | 106 |
| P-1 | 2.33 | 3.72 | 513 | 2.5 | 59.8 | 1.0 | 880 | 98 |
| Q-1 | 2.29 | 3.73 | 514 | 2.3 | 58.1 | 1.0 | 900 | 124 |
| R-1 | 2.23 | 3.43 | 508 | 2.2 | 53.9 | 1.0 | 900 | 112 |
| S-1 | 2.19 | 3.73 | 520 | 2.5 | 57.7 | 1.1 | 900 | 106 |
| T-1 | 2.45 | 3.08 | 517 | 2.3 | 58.4 | 1.0 | 890 | 116 |
| U-1 | 2.22 | 3.1 | 502 | 2.3 | 59.8 | 0.9 | 910 | 128 |
| V-1 | 2.32 | 3.69 | 502 | 2.4 | 50.4 | 1.2 | 890 | 123 |
| W-1 | 2.26 | 3.68 | 504 | 2.2 | 56.4 | 1.0 | 910 | 117 |
| X-1 | 2.34 | 3.91 | 518 | 2.2 | 59.3 | 0.9 | 910 | 124 |
| Y-1 | 1.88 | 3.8 | 516 | 2.2 | 51.7 | 1.1 | 930 | 117 |
| Z-1 | 1.88 | 3.17 | 504 | 2.2 | 58.5 | 0.9 | 910 | 95 |
| AA-1 | 1.99 | 3.87 | 505 | 2.5 | 56.9 | 1.1 | 900 | 120 |
| AB-1 | 2.01 | 3.69 | 516 | 2.3 | 59.8 | 0.9 | 900 | 119 |
| AC-1 | 2.04 | 3.01 | 514 | 2.3 | 50.7 | 1.1 | 900 | 110 |
| AD-1 | 1.94 | 3.22 | 518 | 2.1 | 54.5 | 1.0 | 920 | 113 |

TABLE 2-4-continued

| MANUFACTURING NO. | MANUFACTURING CONDITION | | | |
|---|---|---|---|---|
| | THIRD COOLING RATE (° C./s) | THIRD COOLING STOP TEMPERATURE (° C.) | FOURTH COOLING RATE (° C./s) | FOURTH COOLING STOP TEMPERATURE (° C.) |
| A-1 | 3.6 | 673 | 32.9 | 238 |
| B-1 | 3.0 | 677 | 36.9 | 247 |
| C-1 | 2.6 | 689 | 34.7 | 249 |
| D-1 | 3.2 | 674 | 36.2 | 252 |
| E-1 | 3.3 | 680 | 39.8 | 268 |
| F-1 | 2.9 | 673 | 37.2 | 268 |
| G-1 | 2.7 | 683 | 32.4 | 251 |
| H-1 | 3.7 | 681 | 38.3 | 248 |
| I-1 | 3.4 | 683 | 33.0 | 242 |
| J-1 | 3.5 | 686 | 34.8 | 234 |
| K-1 | 2.8 | 672 | 37.4 | 253 |
| L-1 | 3.7 | 680 | 32.5 | 249 |
| M-1 | 3.7 | 684 | 36.5 | 236 |
| N-1 | 2.6 | 676 | 34.9 | 247 |
| O-1 | 2.6 | 685 | 35.3 | 239 |
| P-1 | 3.6 | 678 | 34.5 | 250 |
| Q-1 | 3.6 | 674 | 34.9 | 234 |
| R-1 | 3.8 | 689 | 37.1 | 256 |
| S-1 | 3.8 | 673 | 32.7 | 260 |
| T-1 | 3.0 | 680 | 39.7 | 239 |
| U-1 | 2.8 | 681 | 34.9 | 265 |
| V-1 | 3.7 | 690 | 36.6 | 269 |
| W-1 | 3.1 | 679 | 33.9 | 250 |
| X-1 | 2.6 | 684 | 37.1 | 261 |
| Y-1 | 3.1 | 688 | 35.6 | 265 |
| Z-1 | 2.9 | 689 | 35.9 | 255 |
| AA-1 | 3.5 | 679 | 34.4 | 237 |
| AB-1 | 4.0 | 688 | 38.4 | 244 |
| AC-1 | 3.5 | 679 | 34.1 | 244 |
| AD-1 | 3.2 | 682 | 39.6 | 261 |

TABLE 2-5

| MANUFACTURING NO. | MANUFACTURING CONDITION | | | | | | | |
|---|---|---|---|---|---|---|---|---|
| | HOT ROLLING CONDITION | | | | COLD ROLLING CONDITION | | ANNEALING CONDITION | |
| | t (s) | HOLDING TIME (s) | CT (° C.) | SHEET THICKNESS (mm) | COLD ROLLING REDUCTION (%) | SHEET THICKNESS AFTER COLD ROLLING (mm) | ANNEALING TEMPERATURE (° C.) | HOLDING TIME (s) |
| AE-1 | 2.06 | 3.29 | 513 | 2.1 | 55.9 | 0.9 | 900 | 121 |
| AF-1 | 2.41 | 3.32 | 513 | 2.4 | 56.4 | 1.0 | 900 | 126 |
| AG-1 | 2.10 | 3.19 | 505 | 2.2 | 51.5 | 1.1 | 900 | 122 |
| AH-1 | 1.88 | 3.77 | 517 | 2.4 | 57.3 | 1.0 | 900 | 116 |
| AI-1 | 2.26 | 3.21 | 519 | 2.3 | 59.0 | 0.9 | 900 | 98 |
| AJ-1 | 2.31 | 3.17 | 509 | 2.4 | 52.0 | 1.2 | 880 | 93 |
| AK-1 | 2.33 | 3.82 | 502 | 2.3 | 51.6 | 1.1 | 910 | 107 |
| AL-1 | 2.00 | 3.27 | 503 | 2.2 | 53.8 | 1.0 | 930 | 126 |
| AM-1 | 1.83 | 3.17 | 510 | 2.1 | 59.1 | 0.9 | 910 | 119 |
| AN-1 | 2.08 | 3.15 | 518 | 2.4 | 54.6 | 1.1 | 930 | 94 |
| AO-1 | 1.83 | 3.07 | 503 | 2.2 | 52.1 | 1.1 | 910 | 115 |
| AP-1 | 2.05 | 3.37 | 506 | 2.4 | 50.5 | 1.2 | 890 | 117 |
| AQ-1 | 1.71 | 3.69 | 515 | 2.4 | 51.5 | 1.2 | 920 | 103 |
| AR-1 | 1.84 | 3.69 | 509 | 2.4 | 52.0 | 1.2 | 900 | 91 |
| AS-1 | 1.91 | 3.16 | 505 | 2.2 | 53.0 | 1.0 | 900 | 129 |
| AT-1 | 1.94 | 3.06 | 502 | 2.3 | 50.8 | 1.1 | 910 | 128 |
| AU-1 | 1.99 | 3.26 | 512 | 2.3 | 59.1 | 0.9 | 910 | 115 |
| AV-1 | 2.26 | 3.4 | 509 | 2.2 | 53.3 | 1.0 | 910 | 109 |
| AW-1 | 1.81 | 3.32 | 513 | 2.5 | 57.7 | 1.1 | 910 | 102 |
| AX-1 | 1.81 | 3.08 | 511 | 2.5 | 55.0 | 1.1 | 920 | 110 |
| AY-1 | 1.99 | 3.73 | 512 | 2.1 | 57.4 | 0.9 | 890 | 105 |
| AZ-1 | 2.16 | 3.5 | 511 | 2.3 | 51.7 | 1.1 | 910 | 121 |
| BA-1 | 2.05 | 3.02 | 512 | 2.3 | 57.6 | 1.0 | 920 | 102 |
| BB-1 | 1.88 | 3.94 | 505 | 2.1 | 55.3 | 0.9 | 910 | 128 |
| BC-1 | 2.14 | 3.6 | 504 | 2.4 | 51.0 | 1.2 | 920 | 105 |
| BD-1 | 2.13 | 3.37 | 510 | 2.2 | 57.6 | 0.9 | 910 | 115 |

TABLE 2-5-continued

| | | | | | | | | |
|---|---|---|---|---|---|---|---|---|
| BE-1 | 2.22 | 3.87 | 509 | 2.5 | 55.5 | 1.1 | 900 | 109 |
| BF-1 | 2.52 | 3.71 | 514 | 2.1 | 53.7 | 1.0 | 910 | 121 |
| BG-1 | 2.13 | 3.37 | 513 | 2.4 | 55.2 | 1.1 | 900 | 106 |
| BH-1 | 2.48 | 3.25 | 503 | 2.1 | 50.2 | 1.0 | 890 | 127 |

| | MANUFACTURING CONDITION | | | |
|---|---|---|---|---|
| MANUFACTURING NO. | THIRD COOLING RATE (° C./s) | THIRD COOLING STOP TEMPERATURE (° C.) | FOURTH COOLING RATE (° C./s) | FOURTH COOLING STOP TEMPERATURE (° C.) |
| AE-1 | 3.5 | 683 | 33.6 | 258 |
| AF-1 | 3.8 | 675 | 39.7 | 268 |
| AG-1 | 3.3 | 687 | 36.0 | 270 |
| AH-1 | 3.1 | 689 | 31.7 | 265 |
| AI-1 | 3.4 | 673 | 35.3 | 242 |
| AJ-1 | 3.4 | 674 | 31.9 | 234 |
| AK-1 | 3.6 | 687 | 39.2 | 254 |
| AL-1 | 4.0 | 681 | 31.3 | 234 |
| AM-1 | 3.9 | 677 | 34.8 | 236 |
| AN-1 | 3.8 | 676 | 33.0 | 267 |
| AO-1 | 2.8 | 676 | 34.9 | 258 |
| AP-1 | 3.2 | 677 | 39.0 | 245 |
| AQ-1 | 3.4 | 675 | 33.6 | 238 |
| AR-1 | 3.1 | 684 | 38.7 | 258 |
| AS-1 | 3.2 | 685 | 38.9 | 240 |
| AT-1 | 3.1 | 673 | 36.7 | 254 |
| AU-1 | 2.5 | 689 | 32.6 | 239 |
| AV-1 | 3.8 | 684 | 36.9 | 242 |
| AW-1 | 3.4 | 674 | 38.9 | 240 |
| AX-1 | 3.3 | 677 | 38.9 | 257 |
| AY-1 | 2.9 | 689 | 33.2 | 235 |
| AZ-1 | 3.7 | 679 | 35.6 | 264 |
| BA-1 | 4.0 | 681 | 38.4 | 247 |
| BB-1 | 3.3 | 675 | 35.9 | 249 |
| BC-1 | 3.6 | 684 | 33.5 | 256 |
| BD-1 | 3.5 | 687 | 39.3 | 260 |
| BE-1 | 2.6 | 688 | 33.6 | 240 |
| BF-1 | 3.9 | 676 | 31.1 | 239 |
| BG-1 | 3.5 | 683 | 31.2 | 253 |
| BH-1 | 2.5 | 683 | 39.2 | 266 |

TABLE 2-6

| | MANUFACTURING CONDITION | | | | | | | |
|---|---|---|---|---|---|---|---|---|
| | HOT ROLLING CONDITION | | | | COLD ROLLING CONDITION | | ANNEALING CONDITION | |
| MANUFACTURING NO. | t (s) | HOLDING TIME (s) | CT (° C.) | SHEET THICKNESS (mm) | COLD ROLLING REDUCTION (%) | SHEET THICKNESS AFTER COLD ROLLING (mm) | ANNEALING TEMPERATURE (° C.) | HOLDING TIME (s) |
| BI-1 | 2.48 | 3.04 | 506 | 2.3 | 58.1 | 1.0 | 900 | 119 |
| BJ-1 | 1.92 | 3.27 | 514 | 2.5 | 59.2 | 1.0 | 920 | 130 |
| BL-1 | 1.79 | 3.96 | 509 | 2.2 | 52.2 | 1.1 | 910 | 107 |
| BM-1 | 1.68 | 3.38 | 505 | 2.4 | 53.2 | 1.1 | 930 | 103 |
| BN-1 | 2.15 | 3.6 | 508 | 2.1 | 57.1 | 0.9 | 910 | 94 |
| BO-1 | 1.73 | 3.24 | 518 | 2.4 | 57.0 | 1.0 | 920 | 93 |
| BP-1 | 1.88 | 3.92 | 502 | 2.3 | 56.3 | 1.0 | 910 | 93 |
| BR-1 | 1.85 | 3.41 | 503 | 2.5 | 57.5 | 1.1 | 910 | 119 |
| BS-1 | 1.94 | 3.09 | 516 | 2.3 | 59.2 | 0.9 | 920 | 114 |
| BU-1 | 1.87 | 3.68 | 505 | 2.5 | 52.0 | 1.2 | 910 | 97 |
| BV-1 | 1.97 | 3.14 | 514 | 2.3 | 52.0 | 1.1 | 910 | 115 |
| BX-1 | 2.17 | 3.55 | 518 | 2.4 | 50.9 | 1.2 | 920 | 118 |
| BY-1 | 2.05 | 3.92 | 508 | 2.3 | 54.9 | 1.0 | 900 | 116 |
| BZ-1 | 2.01 | 3.37 | 505 | 2.1 | 50.7 | 1.0 | 910 | 119 |
| CA-1 | 2.15 | 3.54 | 517 | 2.5 | 51.9 | 1.2 | 900 | 115 |
| CC-1 | 2.11 | 3.91 | 506 | 2.5 | 53.1 | 1.2 | 890 | 101 |
| CE-1 | 2.06 | 3.09 | 514 | 2.1 | 59.7 | 0.8 | 900 | 127 |
| CF-1 | 2.37 | 3.36 | 505 | 2.3 | 53.9 | 1.1 | 920 | 108 |
| CG-1 | 2.18 | 3.46 | 506 | 2.4 | 53.2 | 1.1 | 920 | 114 |
| CI-1 | 2.56 | 3.59 | 510 | 2.4 | 59.5 | 1.0 | 880 | 92 |
| CJ-1 | 2.34 | 3.27 | 513 | 2.2 | 51.2 | 1.1 | 890 | 110 |

TABLE 2-6-continued

| | | | | | | | | |
|---|---|---|---|---|---|---|---|---|
| CK-1 | 2.50 | 3.93 | 513 | 2.2 | 50.2 | 1.1 | 900 | 128 |
| CL-1 | 2.10 | 3.02 | 508 | 2.2 | 50.0 | 1.1 | 900 | 115 |

| | MANUFACTURING CONDITION | | | |
|---|---|---|---|---|
| MANUFACTURING NO. | THIRD COOLING RATE (° C./s) | THIRD COOLING STOP TEMPERATURE (° C.) | FOURTH COOLING RATE (° C./s) | FOURTH COOLING STOP TEMPERATURE (° C.) |
| BI-1 | 3.6 | 672 | 35.7 | 259 |
| BJ-1 | 3.4 | 689 | 34.9 | 245 |
| BL-1 | 2.6 | 683 | 38.3 | 235 |
| BM-1 | 3.5 | 678 | 37.1 | 240 |
| BN-1 | 3.8 | 682 | 32.9 | 258 |
| BO-1 | 3.6 | 676 | 31.0 | 231 |
| BP-1 | 3.8 | 678 | 31.2 | 259 |
| BR-1 | 3.2 | 686 | 35.7 | 235 |
| BS-1 | 3.1 | 679 | 37.1 | 266 |
| BU-1 | 2.6 | 675 | 32.5 | 256 |
| BV-1 | 3.0 | 689 | 32.8 | 267 |
| BX-1 | 3.1 | 674 | 31.9 | 238 |
| BY-1 | 2.8 | 679 | 39.9 | 247 |
| BZ-1 | 3.5 | 689 | 31.7 | 245 |
| CA-1 | 3.2 | 688 | 31.7 | 243 |
| CC-1 | 3.4 | 673 | 38.5 | 265 |
| CE-1 | 3.3 | 687 | 33.0 | 262 |
| CF-1 | 3.2 | 682 | 40.0 | 252 |
| CG-1 | 3.9 | 684 | 33.2 | 240 |
| CI-1 | 2.7 | 690 | 38.7 | 267 |
| CJ-1 | 2.9 | 687 | 34.2 | 235 |
| CK-1 | 3.8 | 679 | 34.5 | 258 |
| CL-1 | 3.6 | 672 | 34.9 | 232 |

TABLE 2-7

| | MANUFACTURING CONDITION | | | | | | | PROPERTIES | | | |
|---|---|---|---|---|---|---|---|---|---|---|---|
| | HEAT TREATMENT | | | | | | PRESENCE | STRUCTURE OF COLD-ROLLED STEEL SHEET | | | |
| | | PROCESS | | | | | OR ABSENCE | AREA RATIO | AREA RATIO | AREA RATIO | AREA RATIO |
| MANUFACTURING NO. | PRESENCE OR ABSENCE OF REHEATING | TEMPER-ATURE (° C.) | TIME (s) | PRESENCE OR ABSENCE OF TEMPERING | PRESENCE OR ABSENCE OF COATING | PRESENCE OR ABSENCE OF ALLOYING | OF HOT ROLLING ANNEALING | OF POLYGONAL FERRITE (%) | OF BANNITCFERRITE (%) | OF RESIDUAL AUSTENITE (%) | OF MARTENSITE (%) |
| A-1 | ABSENCE | 238 | 96 | ABSENCE | ABSENCE | ABSENCE | ABSENCE | 50.9 | 34.5 | 11.5 | 3.1 |
| B-1 | ABSENCE | 247 | 77 | ABSENCE | ABSENCE | ABSENCE | ABSENCE | 43.8 | 31.6 | 21.0 | 3.6 |
| C-1 | ABSENCE | 249 | 99 | ABSENCE | ABSENCE | ABSENCE | ABSENCE | 44.1 | 35.2 | 16.8 | 3.9 |
| D-1 | ABSENCE | 252 | 83 | ABSENCE | ABSENCE | ABSENCE | ABSENCE | 47.1 | 31.9 | 19.4 | 1.6 |
| E-1 | ABSENCE | 268 | 106 | ABSENCE | ABSENCE | ABSENCE | ABSENCE | 58.9 | 30.7 | 10.3 | 0.1 |
| F-1 | ABSENCE | 268 | 108 | ABSENCE | ABSENCE | ABSENCE | ABSENCE | 53.0 | 31.4 | 14.7 | 0.9 |
| G-1 | ABSENCE | 251 | 89 | ABSENCE | ABSENCE | ABSENCE | ABSENCE | 47.8 | 40.3 | 10.0 | 1.9 |
| H-1 | ABSENCE | 248 | 100 | ABSENCE | ABSENCE | ABSENCE | ABSENCE | 43.4 | 31.2 | 24.7 | 0.7 |
| I-1 | ABSENCE | 242 | 109 | ABSENCE | ABSENCE | ABSENCE | ABSENCE | 54.6 | 32.1 | 12.6 | 0.7 |
| J-1 | ABSENCE | 234 | 77 | ABSENCE | ABSENCE | ABSENCE | ABSENCE | 52.6 | 31.7 | 14.4 | 1.3 |
| K-1 | ABSENCE | 253 | 104 | ABSENCE | ABSENCE | ABSENCE | ABSENCE | 51.0 | 35.0 | 12.2 | 1.8 |
| L-1 | ABSENCE | 249 | 82 | ABSENCE | ABSENCE | ABSENCE | ABSENCE | 49.4 | 31.2 | 17.4 | 2.0 |
| M-1 | ABSENCE | 236 | 101 | ABSENCE | ABSENCE | ABSENCE | ABSENCE | 42.9 | 31.3 | 23.1 | 2.7 |
| N-1 | ABSENCE | 247 | 80 | ABSENCE | ABSENCE | ABSENCE | ABSENCE | 53.7 | 34.8 | 11.2 | 0.3 |
| O-1 | ABSENCE | 239 | 99 | ABSENCE | ABSENCE | ABSENCE | ABSENCE | 47.5 | 41.7 | 10.3 | 0.5 |
| P-1 | ABSENCE | 250 | 102 | ABSENCE | ABSENCE | ABSENCE | ABSENCE | 50.3 | 31.1 | 16.6 | 2.0 |
| Q-1 | ABSENCE | 234 | 76 | ABSENCE | ABSENCE | ABSENCE | ABSENCE | 51.7 | 31.4 | 15.1 | 1.8 |
| R-1 | ABSENCE | 256 | 98 | ABSENCE | ABSENCE | ABSENCE | ABSENCE | 52.1 | 32.0 | 14.2 | 1.7 |
| S-1 | ABSENCE | 260 | 97 | ABSENCE | ABSENCE | ABSENCE | ABSENCE | 50.3 | 34.2 | 13.8 | 1.7 |
| T-1 | ABSENCE | 239 | 102 | ABSENCE | ABSENCE | ABSENCE | ABSENCE | 55.8 | 31.0 | 11.8 | 1.4 |
| U-1 | ABSENCE | 265 | 72 | ABSENCE | ABSENCE | ABSENCE | ABSENCE | 51.1 | 31.5 | 15.6 | 1.8 |
| V-1 | ABSENCE | 269 | 88 | ABSENCE | ABSENCE | ABSENCE | ABSENCE | 42 0 | 31.1 | 24.1 | 2.8 |
| W-1 | ABSENCE | 250 | 105 | ABSENCE | ABSENCE | ABSENCE | ABSENCE | 49.0 | 32.0 | 17.0 | 2.0 |
| X-1 | ABSENCE | 261 | 102 | ABSENCE | ABSENCE | ABSENCE | ABSENCE | 50.5 | 32.1 | 15.6 | 1.8 |
| Y-1 | ABSENCE | 265 | 74 | ABSENCE | ABSENCE | ABSENCE | ABSENCE | 59.6 | 31.4 | 6.8 | 2.2 |
| Z-1 | ABSENCE | 255 | 83 | ABSENCE | ABSENCE | ABSENCE | ABSENCE | 30.3 | 30.3 | 11.2 | 1.2 |
| AA-1 | ABSENCE | 237 | 110 | ABSENCE | ABSENCE | ABSENCE | ABSENCE | 38.2 | 36.2 | 5.8 | 6.3 |
| AB-1 | ABSENCE | 244 | 104 | ABSENCE | ABSENCE | ABSENCE | ABSENCE | 43.6 | 31.1 | 24.0 | 1.3 |
| AC-1 | ABSENCE | 244 | 83 | ABSENCE | ABSENCE | ABSENCE | ABSENCE | 42.1 | 32.6 | 24.4 | 0.9 |
| AD-1 | ABSENCE | 261 | 94 | ABSENCE | ABSENCE | ABSENCE | ABSENCE | 61.7 | 34.1 | 2.0 | 2.2 |

UNDERLINES INDICATE THAT VALUES FALL OUTSIDE THE RANGE OF THE PRESENT INVENTION.

TABLE 2-8

| | MANUFACTURING CONDITION | | | | | | | PROPERTIES | | | |
|---|---|---|---|---|---|---|---|---|---|---|---|
| | | HEAT TREATMENT PROCESS | | | | | PRESENCE OR ABSENCE | STRUCTURE OF COLD-ROLLED STEEL SHEET | | | |
| MANUFACTURING NO. | PRESENCE OR ABSENCE OF REHEATING | TEMPER-ATURE (° C.) | TIME (s) | PRESENCE OR ABSENCE OF TEMPERING | PRESENCE OR ABSENCE OF COATING | PRESENCE OR ABSENCE OF ALLOYING | OF HOT ROLLING ANNEALING | AREA RATIO OF POLYGONAL FERRITE (%) | AREA RATIO OF BANNITCFERRITE (%) | AREA RATIO OF RESIDUAL AUSTENITE (%) | AREA RATIO OF MARTENSITE (%) |
| AE-1 | ABSENCE | 258 | 98 | ABSENCE | ABSENCE | ABSENCE | ABSENCE | 52.4 | 35.3 | 11.1 | 1.2 |
| AF-1 | ABSENCE | 268 | 83 | ABSENCE | ABSENCE | ABSENCE | ABSENCE | 35.2 | 41.1 | 15.9 | 7.8 |
| AG-1 | ABSENCE | 270 | 99 | ABSENCE | ABSENCE | ABSENCE | ABSENCE | 65.6 | 31.2 | 1.8 | 1.4 |
| AH-1 | ABSENCE | 265 | 104 | ABSENCE | ABSENCE | ABSENCE | ABSENCE | 51.1 | 37.5 | 10.3 | 1.1 |
| AI-1 | ABSENCE | 242 | 108 | ABSENCE | ABSENCE | ABSENCE | ABSENCE | 41.8 | 31.0 | 25.5 | 1.7 |
| AJ-1 | ABSENCE | 234 | 90 | ABSENCE | ABSENCE | ABSENCE | ABSENCE | 44.4 | 31.0 | 22.0 | 2.6 |
| AK-1 | ABSENCE | 254 | 100 | ABSENCE | ABSENCE | ABSENCE | ABSENCE | 50.6 | 28.4 | 4.4 | 16.6 |
| AL-1 | ABSENCE | 234 | 84 | ABSENCE | ABSENCE | ABSENCE | ABSENCE | 53.1 | 31.1 | 14.0 | 1.8 |
| AM-1 | ABSENCE | 236 | 72 | ABSENCE | ABSENCE | ABSENCE | ABSENCE | 48.4 | 38.2 | 10.1 | 3.3 |
| AN-1 | ABSENCE | 267 | 103 | ABSENCE | ABSENCE | ABSENCE | ABSENCE | 53.5 | 31.1 | 14.3 | 1.1 |
| AO-1 | ABSENCE | 258 | 105 | ABSENCE | ABSENCE | ABSENCE | ABSENCE | 52.0 | 33.6 | 12.4 | 2.0 |
| AP-1 | ABSENCE | 245 | 82 | ABSENCE | ABSENCE | ABSENCE | ABSENCE | 46.5 | 31.1 | 22.2 | 0.2 |
| AQ-1 | ABSENCE | 238 | 85 | ABSENCE | ABSENCE | ABSENCE | ABSENCE | 50.6 | 35.6 | 11.7 | 2.1 |
| AR-1 | ABSENCE | 258 | 100 | ABSENCE | ABSENCE | ABSENCE | ABSENCE | 53.7 | 30.8 | 14.0 | 1.5 |
| AS-1 | ABSENCE | 240 | 101 | ABSENCE | ABSENCE | ABSENCE | ABSENCE | 56.7 | 31.7 | 11.1 | 0.5 |
| AT-1 | ABSENCE | 254 | 99 | ABSENCE | ABSENCE | ABSENCE | ABSENCE | 50.3 | 31.6 | 17.8 | 0.3 |
| AU-1 | ABSENCE | 239 | 80 | ABSENCE | ABSENCE | ABSENCE | ABSENCE | 53.9 | 31.1 | 14.6 | 0.4 |
| AV-1 | ABSENCE | 242 | 88 | ABSENCE | ABSENCE | ABSENCE | ABSENCE | 53.2 | 31.1 | 14.0 | 1.7 |
| AW-1 | ABSENCE | 240 | 87 | ABSENCE | ABSENCE | ABSENCE | ABSENCE | 49.1 | 31.3 | 17.5 | 2.1 |
| AX-1 | ABSENCE | 257 | 94 | ABSENCE | ABSENCE | ABSENCE | ABSENCE | 48.1 | 31.2 | 18.5 | 2.2 |
| AY-1 | ABSENCE | 235 | 89 | ABSENCE | ABSENCE | ABSENCE | ABSENCE | 56.3 | 31.1 | 11.2 | 1.4 |
| AZ-1 | ABSENCE | 264 | 79 | ABSENCE | ABSENCE | ABSENCE | ABSENCE | 50.5 | 31.1 | 16.5 | 1.9 |
| BA-1 | ABSENCE | 247 | 79 | ABSENCE | ABSENCE | ABSENCE | ABSENCE | 49.3 | 31.8 | 16.9 | 2.0 |
| BB-1 | ABSENCE | 249 | 76 | ABSENCE | ABSENCE | ABSENCE | ABSENCE | 50.5 | 32.8 | 14.9 | 1.8 |
| BC-1 | ABSENCE | 256 | 85 | ABSENCE | ABSENCE | ABSENCE | ABSENCE | 48.8 | 31.8 | 17.4 | 2.0 |
| BD-1 | ABSENCE | 260 | 91 | ABSENCE | ABSENCE | ABSENCE | ABSENCE | 50.7 | 32.3 | 15.2 | 1.8 |
| BE-1 | ABSENCE | 240 | 84 | ABSENCE | ABSENCE | ABSENCE | ABSENCE | 50.1 | 31.0 | 16.9 | 2.0 |
| BF-1 | ABSENCE | 239 | 100 | ABSENCE | ABSENCE | ABSENCE | ABSENCE | 49.9 | 31.0 | 17.1 | 2.0 |
| BG-1 | ABSENCE | 253 | 105 | ABSENCE | ABSENCE | ABSENCE | ABSENCE | 50.3 | 31.2 | 16.5 | 2.0 |
| BH-1 | ABSENCE | 266 | 98 | ABSENCE | ABSENCE | ABSENCE | ABSENCE | 55.5 | 31.0 | 12.0 | 1.5 |

UNDERLINES INDICATE THAT VALUES FALL OUTSIDE THE RANGE OF THE PRESENT INVENTION.

TABLE 2-9

| MANUFACTURING CONDITION | | | | | | | | PROPERTIES STRUCTURE OF COLD-ROLLED STEEL SHEET | | | |
|---|---|---|---|---|---|---|---|---|---|---|---|
| MANUFACTURING NO. | PRESENCE OR ABSENCE OF REHEATING | HEAT TREATMENT PROCESS TEMPERATURE (° C.) | HEAT TREATMENT PROCESS TIME (s) | PRESENCE OR ABSENCE OF TEMPERING | PRESENCE OR ABSENCE OF COATING | PRESENCE OR ABSENCE OF ALLOYING | PRESENCE OR ABSENCE OF HOT ROLLING ANNEALING | AREA RATIO OF POLYGONAL FERRITE (%) | AREA RATIO OF BANNITCFERRITE (%) | AREA RATIO OF RESIDUAL AUSTENITE (%) | AREA RATIO OF MARTENSITE (%) |
| BI-1 | ABSENCE | 259 | 89 | ABSENCE | ABSENCE | ABSENCE | ABSENCE | 49.8 | 31.0 | 17.2 | 2.0 |
| BJ-1 | ABSENCE | 245 | 89 | ABSENCE | ABSENCE | ABSENCE | ABSENCE | 58.3 | 32.9 | 6.0 | 2.8 |
| BL-1 | ABSENCE | 235 | 101 | ABSENCE | ABSENCE | ABSENCE | ABSENCE | 36.5 | 32.9 | 24.3 | 6.3 |
| BM-1 | ABSENCE | 240 | 109 | ABSENCE | ABSENCE | ABSENCE | ABSENCE | 20.9 | 41.1 | 24.9 | 13.1 |
| BN-1 | ABSENCE | 258 | 80 | ABSENCE | ABSENCE | ABSENCE | ABSENCE | 56.1 | 31.1 | 11.4 | 1.4 |
| BO-1 | ABSENCE | 231 | 85 | ABSENCE | ABSENCE | ABSENCE | ABSENCE | 52.8 | 31.8 | 12.1 | 3.3 |
| BP-1 | ABSENCE | 259 | 106 | ABSENCE | ABSENCE | ABSENCE | ABSENCE | 42.4 | 42.2 | 12.1 | 3.3 |
| BR-1 | ABSENCE | 235 | 110 | ABSENCE | ABSENCE | ABSENCE | ABSENCE | 52.7 | 31.1 | 15.5 | 0.7 |
| BS-1 | ABSENCE | 266 | 108 | ABSENCE | ABSENCE | ABSENCE | ABSENCE | 51.6 | 35.2 | 11.1 | 2.1 |
| BU-1 | ABSENCE | 256 | 72 | ABSENCE | ABSENCE | ABSENCE | ABSENCE | 51.4 | 31.6 | 16.6 | 0.4 |
| BV-1 | ABSENCE | 267 | 75 | ABSENCE | ABSENCE | ABSENCE | ABSENCE | 52.2 | 32.0 | 15.7 | 0.1 |
| BX-1 | ABSENCE | 238 | 97 | ABSENCE | ABSENCE | ABSENCE | ABSENCE | 39.2 | 42.1 | 16.6 | 2.1 |
| BY-1 | ABSENCE | 247 | 85 | ABSENCE | ABSENCE | ABSENCE | ABSENCE | 55.2 | 31.1 | 12.2 | 1.5 |
| BZ-1 | ABSENCE | 245 | 107 | ABSENCE | ABSENCE | ABSENCE | ABSENCE | 50.6 | 31.0 | 16.5 | 1.9 |
| CA-1 | ABSENCE | 243 | 77 | ABSENCE | ABSENCE | ABSENCE | ABSENCE | 52.2 | 31.1 | 14.9 | 1.8 |
| CC-1 | ABSENCE | 265 | 86 | ABSENCE | ABSENCE | ABSENCE | ABSENCE | 54.5 | 32.2 | 8.1 | 5.2 |
| CE-1 | ABSENCE | 262 | 71 | ABSENCE | ABSENCE | ABSENCE | ABSENCE | 50.7 | 31.0 | 16.4 | 1.9 |
| CF-1 | ABSENCE | 252 | 76 | ABSENCE | ABSENCE | ABSENCE | ABSENCE | 60.6 | 31.0 | 6.4 | 2.0 |
| CG-1 | ABSENCE | 240 | 102 | ABSENCE | ABSENCE | ABSENCE | ABSENCE | 62.5 | 32.4 | 3.2 | 1.9 |
| CI-1 | ABSENCE | 267 | 107 | ABSENCE | ABSENCE | ABSENCE | ABSENCE | 57.7 | 31.0 | 10.1 | 1.2 |
| CJ-1 | ABSENCE | 235 | 80 | ABSENCE | ABSENCE | ABSENCE | ABSENCE | 28.4 | 37.6 | 20.6 | 13.4 |
| CK-1 | ABSENCE | 258 | 80 | ABSENCE | ABSENCE | ABSENCE | ABSENCE | 22.2 | 42.1 | 23.9 | 11.8 |
| CL-1 | ABSENCE | 232 | 108 | ABSENCE | ABSENCE | ABSENCE | ABSENCE | 46.5 | 27.1 | 8.9 | 17.5 |

UNDERLINES INDICATE THAT VALUES FALL OUTSIDE THE RANGE OF THE PRESENT INVENTION.

TABLE 2-10

| PROPERTIES | | | | | | | | | | | |
|---|---|---|---|---|---|---|---|---|---|---|---|
| | STRUCTURE OF COLD-ROLLED STEEL SHEET | | | STRUCTURE OF HOT-ROLLED STEEL SHEET | | MECHANICAL PROPERTIES | | | | | |
| MANUFACTURING NO. | (A) (%) | (B) (%) | (C) | (D) (%) | (E) | 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
| A-1 | 82.4 | 87.8 | 0.22 | 93.8 | 0.17 | 710.0 | 1027.5 | 21.9 | 58.0 | 1.8E+06 | EXAMPLE OF INVENTION |
| B-1 | 92.4 | 81.9 | 0.58 | 88.1 | 0.35 | 861.9 | 1131.1 | 21.3 | 42.0 | 7.0E+05 | EXAMPLE OF INVENTION |
| C-1 | 89.9 | 88.7 | 0.29 | 85.6 | 0.24 | 767.4 | 1011.1 | 23.0 | 54.4 | 1.7E+06 | EXAMPLE OF INVENTION |
| D-1 | 82.4 | 83.0 | 0.26 | 91.3 | 0.22 | 742.9 | 1019.0 | 23.4 | 57.7 | 1.7E+06 | EXAMPLE OF INVENTION |
| E-1 | 87.6 | 86.0 | 0.35 | 87.1 | 0.31 | 636.6 | 1041.9 | 23.3 | 51.5 | 1.7E+06 | EXAMPLE OF INVENTION |
| F-1 | 94.2 | 88.4 | 0.55 | 86.6 | 0.39 | 829.9 | 1238.6 | 21.1 | 47.2 | 9.2E+05 | EXAMPLE OF INVENTION |
| G-1 | 82.8 | 82.9 | 0.52 | 86.3 | 0.33 | 750.4 | 1039.3 | 24.0 | 49.3 | 9.3E+05 | EXAMPLE OF INVENTION |
| H-1 | 83.4 | 90.3 | 0.53 | 85.7 | 0.35 | 966.3 | 1261.5 | 21.2 | 49.9 | 9.4E+05 | EXAMPLE OF INVENTION |
| I-1 | 94.1 | 85.8 | 0.24 | 85.7 | 0.23 | 714.1 | 1091.9 | 23.6 | 63.4 | 1.7E+06 | EXAMPLE OF INVENTION |
| J-1 | 92.9 | 88.6 | 0.24 | 93.6 | 0.23 | 818.1 | 1213.8 | 21.7 | 64.7 | 1.7E+06 | EXAMPLE OF INVENTION |
| K-1 | 97.0 | 95.4 | 0.54 | 93.5 | 0.40 | 788.7 | 1143.0 | 23.1 | 45.0 | 9.5E+05 | EXAMPLE OF INVENTION |
| L-1 | 95.0 | 85.3 | 0.41 | 88.5 | 0.33 | 810.4 | 1147.9 | 23.5 | 51.2 | 1.5E+06 | EXAMPLE OF INVENTION |
| M-1 | 83.6 | 84.5 | 0.30 | 90.4 | 0.26 | 903.4 | 1171.7 | 23.3 | 61.1 | 1.7E+06 | EXAMPLE OF INVENTION |
| N-1 | 81.1 | 85.3 | 0.24 | 92.3 | 0.19 | 661.3 | 997.5 | 27.2 | 66.0 | 1.6E+06 | EXAMPLE OF INVENTION |
| O-1 | 91.8 | 84.9 | 0.34 | 81.5 | 0.30 | 763.5 | 1053.1 | 26.5 | 58.8 | 1.7E+06 | EXAMPLE OF INVENTION |
| P-1 | 82.9 | 81.5 | 0.36 | 86.5 | 0.32 | 781.7 | 1121.5 | 25.8 | 58.6 | 1.6E+06 | EXAMPLE OF INVENTION |
| Q-1 | 89.6 | 85.8 | 0.43 | 82.5 | 0.35 | 817.8 | 1197.4 | 24.8 | 53.6 | 1.5E+06 | EXAMPLE OF INVENTION |
| R-1 | 94.8 | 81.7 | 0.37 | 82.3 | 0.31 | 744.6 | 1096.6 | 27.1 | 59.2 | 1.7E+06 | EXAMPLE OF INVENTION |
| S-1 | 83.6 | 88.6 | 0.23 | 89.3 | 0.19 | 751.2 | 1077.7 | 27.8 | 72.8 | 1.6E+06 | EXAMPLE OF INVENTION |
| T-1 | 90.4 | 91.5 | 0.23 | 88.7 | 0.22 | 771.0 | 1201.0 | 25.3 | 73.5 | 1.7E+06 | EXAMPLE OF INVENTION |
| U-1 | 93.0 | 92.8 | 0.33 | 84.2 | 0.25 | 801.5 | 1163.3 | 26.3 | 64.4 | 1.7E+06 | EXAMPLE OF INVENTION |
| V-1 | 85.8 | 84.1 | 0.30 | 93.5 | 0.21 | 963.5 | 1235.3 | 25.3 | 68.6 | 1.6E+06 | EXAMPLE OF INVENTION |
| W-1 | 90.5 | 81.7 | 0.32 | 82.5 | 0.24 | 889.8 | 1253.2 | 25.2 | 67.3 | 1.6E+06 | EXAMPLE OF INVENTION |
| X-1 | 88.3 | 87.9 | 0.48 | 86.3 | 0.35 | 767.1 | 1103.7 | 28.9 | 51.7 | 1.2E+06 | EXAMPLE OF INVENTION |
| Y-1 | 73.7 | 78.4 | 0.33 | 77.9 | 0.29 | 570.5 | 944.6 | 21.4 | 28.9 | 8.2E+04 | COMPARATIVE EXAMPLE |
| Z-1 | 82.4 | 90.7 | 0.47 | 91.8 | 0.34 | 666.4 | 1062.9 | 21.6 | 20.6 | 1.3E+06 | COMPARATIVE EXAMPLE |
| AA-1 | 81.2 | 93.1 | 0.34 | 86.2 | 0.31 | 673.5 | 986.1 | 16.3 | 54.4 | 1.6E+06 | COMPARATIVE EXAMPLE |

TABLE 2-10-continued

| MANUFACTURING NO. | PROPERTIES: STRUCTURE OF COLD-ROLLED STEEL SHEET (A) (%) | (B) (%) | (C) | STRUCTURE OF HOT-ROLLED STEEL SHEET (D) (%) | (E) | MECHANICAL PROPERTIES: 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
|---|---|---|---|---|---|---|---|---|---|---|---|
| AB-1 | 95.8 | 83.9 | 0.72 | 87.6 | 0.43 | 921.2 | 1205.8 | 21.9 | 28.2 | 9.3E+04 | COMPARATIVE EXAMPLE |
| AC-1 | 86.0 | 81.9 | 0.22 | 85.3 | 0.16 | 874.9 | 1123.1 | 23.0 | 25.2 | 1.7E+06 | COMPARATIVE EXAMPLE |
| AD-1 | 85.5 | 81.8 | 0.56 | 90.5 | 0.33 | 552.4 | 1119.0 | 13.3 | 47.1 | 8.5E+04 | COMPARATIVE EXAMPLE |

UNDERLINES INDICATE THAT VALUES FALL OUTSIDE THE RANGE OF THE PRESENT INVENTION.

15

TABLE 2-11

| MANUFACTURING NO. | PROPERTIES: STRUCTURE OF COLD-ROLLED STEEL SHEET (A) (%) | (B) (%) | (C) | STRUCTURE OF HOT-ROLLED STEEL SHEET (D) (%) | (E) | MECHANICAL PROPERTIES: 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
|---|---|---|---|---|---|---|---|---|---|---|---|
| AE-1 | 72.3 | 88.7 | 0.21 | 92.0 | 0.15 | 697.2 | 919.3 | 22.5 | 27.1 | 1.8E+06 | COMPARATIVE EXAMPLE |
| AF-1 | 99.0 | 86.5 | 0.36 | 91.6 | 0.27 | 769.1 | 1186.9 | 13.7 | 27.4 | 1.7E+06 | COMPARATIVE EXAMPLE |
| AG-1 | 81.5 | 84.2 | 0.31 | 81.9 | 0.25 | 598.5 | 1100.2 | 15.7 | 62.1 | 6.1E+04 | COMPARATIVE EXAMPLE |
| AH-1 | 96.3 | 90.3 | 0.30 | 81.1 | 0.25 | 681.3 | 988.8 | 29.3 | 24.8 | 1.6E+06 | COMPARATIVE EXAMPLE |
| AI-1 | 82.2 | 90.5 | 0.42 | 89.6 | 0.35 | 562.9 | 1359.2 | 22.1 | 54.7 | 5.8E+04 | COMPARATIVE EXAMPLE |
| AJ-1 | 82.0 | 86.2 | 0.46 | 82.6 | 0.33 | 928.1 | 1227.6 | 18.2 | 54.4 | 1.4E+06 | COMPARATIVE EXAMPLE |
| AK-1 | 83.6 | 84.7 | 0.25 | 90.7 | 0.21 | 807.5 | 1443.6 | 18.2 | 77.1 | 1.6E+06 | COMPARATIVE EXAMPLE |
| AL-1 | 84.5 | 87.0 | 0.40 | 81.2 | 0.31 | 864.8 | 1292.7 | 21.9 | 55.8 | 1.6E+06 | EXAMPLE OF INVENTION |
| AM-1 | 82.4 | 87.4 | 0.24 | 83.5 | 0.17 | 734.9 | 1026.4 | 21.9 | 56.7 | 1.7E+06 | EXAMPLE OF INVENTION |
| AN-1 | 84.0 | 87.4 | 0.41 | 87.6 | 0.31 | 862.7 | 1297.3 | 21.7 | 55.4 | 1.6E+06 | EXAMPLE OF INVENTION |
| AO-1 | 87.0 | 86.8 | 0.58 | 86.2 | 0.35 | 706.0 | 1038.2 | 21.9 | 39.2 | 6.9E+05 | EXAMPLE OF INVENTION |
| AP-1 | 98.9 | 86.0 | 0.26 | 82.2 | 0.21 | 820.7 | 1116.6 | 21.1 | 57.4 | 1.6E+06 | EXAMPLE OF INVENTION |
| AQ-1 | 94.3 | 84.1 | 0.26 | 93.7 | 0.24 | 731.4 | 1053.9 | 22.5 | 57.7 | 1.7E+06 | EXAMPLE OF INVENTION |
| AR-1 | 82.5 | 81.2 | 0.21 | 84.5 | 0.17 | 693.8 | 1046.4 | 23.0 | 62.3 | 1.7E+06 | EXAMPLE OF INVENTION |
| AS-1 | 81.0 | 81.3 | 0.30 | 81.0 | 0.22 | 668.1 | 1055.5 | 23.2 | 55.9 | 1.7E+06 | EXAMPLE OF INVENTION |
| AT-1 | 88.2 | 83.9 | 0.24 | 89.6 | 0.16 | 733.9 | 1053.0 | 23.8 | 61.8 | 1.7E+06 | EXAMPLE OF INVENTION |
| AU-1 | 81.3 | 89.4 | 0.39 | 82.8 | 0.33 | 845.5 | 1279.1 | 22.9 | 58.4 | 1.6E+06 | EXAMPLE OF INVENTION |
| AV-1 | 91.8 | 88.9 | 0.26 | 91.4 | 0.23 | 851.0 | 1274.0 | 22.7 | 69.6 | 1.6E+06 | EXAMPLE OF INVENTION |
| AW-1 | 87.8 | 91.5 | 0.37 | 83.9 | 0.30 | 741.6 | 1046.0 | 26.3 | 55.4 | 1.6E+06 | EXAMPLE OF INVENTION |
| AX-1 | 92.1 | 87.4 | 0.51 | 93.2 | 0.35 | 907.8 | 1262.6 | 22.2 | 46.6 | 9.0E+05 | EXAMPLE OF INVENTION |
| AY-1 | 87.7 | 82.7 | 0.26 | 89.8 | 0.17 | 753.3 | 1182.6 | 23.8 | 66.5 | 1.7E+06 | EXAMPLE OF INVENTION |
| AZ-1 | 92.1 | 82.2 | 0.44 | 84.2 | 0.39 | 844.7 | 1215.4 | 23.3 | 50.6 | 1.4E+06 | EXAMPLE OF INVENTION |
| BA-1 | 90.8 | 81.1 | 0.30 | 89.3 | 0.21 | 895.3 | 1266.4 | 22.9 | 64.5 | 1.7E+06 | EXAMPLE OF INVENTION |
| BB-1 | 90.7 | 84.1 | 0.37 | 87.5 | 0.32 | 760.7 | 1094.6 | 26.3 | 57.7 | 1.6E+06 | EXAMPLE OF INVENTION |
| BC-1 | 84.8 | 92.8 | 0.46 | 83.5 | 0.36 | 821.4 | 1153.6 | 25.4 | 50.1 | 1.4E+06 | EXAMPLE OF INVENTION |
| BD-1 | 98.7 | 89.1 | 0.45 | 82.8 | 0.36 | 736.6 | 1062.9 | 27.8 | 51.5 | 1.4E+06 | COMPARATIVE EXAMPLE |
| BE-1 | 93.7 | 89.4 | 0.32 | 88.1 | 0.26 | 842.4 | 1205.2 | 25.9 | 66.7 | 1.7E+06 | EXAMPLE OF INVENTION |
| BF-1 | 85.1 | 81.7 | 0.30 | 92.3 | 0.24 | 846.7 | 1207.9 | 25.9 | 68.8 | 1.7E+06 | EXAMPLE OF INVENTION |
| BG-1 | 88.7 | 91.5 | 0.36 | 89.3 | 0.31 | 758.0 | 1087.5 | 28.8 | 62.8 | 1.7E+06 | EXAMPLE OF INVENTION |
| BH-1 | 97.1 | 88.4 | 0.30 | 81.7 | 0.24 | 838.3 | 1299.7 | 24.5 | 69.8 | 1.6E+06 | EXAMPLE OF INVENTION |

UNDERLINES INDICATE THAT VALUES FALL OUTSIDE THE RANGE OF THE PRESENT INVENTION.

TABLE 2-12

| MANUFACTURING NO. | PROPERTIES: STRUCTURE OF COLD-ROLLED STEEL SHEET (A) (%) | (B) (%) | (C) | STRUCTURE OF HOT-ROLLED STEEL SHEET (D) (%) | (E) | MECHANICAL PROPERTIES: 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
|---|---|---|---|---|---|---|---|---|---|---|---|
| BI-1 | 87.0 | 93.7 | 0.37 | 81.3 | 0.32 | 869.7 | 1238.9 | 26.1 | 63.7 | 1.7E+06 | EXAMPLE OF INVENTION |
| BJ-1 | 75.3 | 76.0 | 0.66 | 74.5 | 0.39 | 587.7 | 952.5 | 21.5 | 26.8 | 7.4E+04 | COMPARATIVE EXAMPLE |

TABLE 2-12-continued

| MANUFACTURING NO. | PROPERTIES: STRUCTURE OF COLD-ROLLED STEEL SHEET (A) (%) | (B) (%) | (C) | STRUCTURE OF HOT-ROLLED STEEL SHEET (D) (%) | (E) | MECHANICAL PROPERTIES: 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
|---|---|---|---|---|---|---|---|---|---|---|---|
| BL-1 | 95.2 | 84.2 | 0.33 | 88.0 | 0.28 | 653.5 | 1014.8 | 16.1 | 26.5 | 1.6E+06 | COMPARATIVE EXAMPLE |
| BM-1 | 83.0 | 90.2 | 0.24 | 86.2 | 0.16 | 716.8 | 1037.4 | 15.0 | 29.4 | 1.6E+06 | COMPARATIVE EXAMPLE |
| BN-1 | 91.7 | 85.1 | 0.38 | 81.7 | 0.28 | 809.1 | 1266.2 | 20.1 | 56.5 | 1.7E+06 | COMPARATIVE EXAMPLE |
| BO-1 | 82.9 | 82.3 | 0.22 | 88.1 | 0.15 | 781.1 | 1162.4 | 22.4 | 27.7 | 1.7E+06 | COMPARATIVE EXAMPLE |
| BP-1 | 76.0 | 91.6 | 0.28 | 87.5 | 0.23 | 771.7 | 973.3 | 21.3 | 25.8 | 1.7E+06 | COMPARATIVE EXAMPLE |
| BR-1 | 83.2 | 89.0 | 0.30 | 85.4 | 0.27 | 825.6 | 1226.8 | 22.0 | 23.0 | 1.6E+06 | COMPARATIVE EXAMPLE |
| BS-1 | 94.5 | 86.6 | 0.48 | 84.3 | 0.36 | 773.1 | 1130.3 | 21.9 | 19.2 | 1.3E+06 | COMPARATIVE EXAMPLE |
| BU-1 | 92.2 | 86.8 | 0.25 | 87.8 | 0.17 | 762.1 | 1111.0 | 22.8 | 23.3 | 1.6E+06 | COMPARATIVE EXAMPLE |
| BV-1 | 97.3 | 93.6 | 0.35 | 92.7 | 0.25 | 781.3 | 1152.4 | 23.0 | 27.4 | 1.6E+06 | COMPARATIVE EXAMPLE |
| BX-1 | 91.5 | 90.7 | 0.33 | 93.6 | 0.26 | 906.0 | 1279.7 | 13.2 | 29.3 | 1.7E+06 | COMPARATIVE EXAMPLE |
| BY-1 | 90.7 | 90.6 | 0.43 | 92.7 | 0.36 | 700.4 | 1080.9 | 25.5 | 22.4 | 1.5E+06 | COMPARATIVE EXAMPLE |
| BZ-1 | 82.7 | 85.3 | 0.39 | 86.2 | 0.31 | 788.1 | 1135.6 | 24.6 | 26.8 | 1.E+066 | COMPARATIVE EXAMPLE |
| CA-1 | 90.5 | 91.1 | 0.52 | 88.0 | 0.34 | 735.0 | 1084.0 | 19.8 | 48.9 | 9.3E+05 | COMPARATIVE EXAMPLE |
| CC-1 | 88.9 | 85.3 | 0.51 | 86.5 | 0.39 | 682.9 | 1042.6 | 18.7 | 48.3 | 9.3E+05 | COMPARATIVE EXAMPLE |
| CE-1 | 98.0 | 85.2 | 0.27 | 86.3 | 0.22 | 859.5 | 1240.2 | 17.4 | 69.8 | 1.6E+06 | COMPARATIVE EXAMPLE |
| CF-1 | 84.9 | 85.9 | 0.24 | 91.1 | 0.23 | 591.3 | 1163.8 | 21.3 | 73.4 | 7.2E+04 | COMPARATIVE EXAMPLE |
| CG-1 | 87.9 | 93.6 | 0.39 | 91.5 | 0.31 | 520.1 | 904.5 | 11.9 | 58.4 | 6.7E+04 | COMPARATIVE EXAMPLE |
| CI-1 | 85.0 | 86.7 | 0.74 | 86.4 | 0.46 | 778.8 | 1250.1 | 25.0 | 29.0 | 8.8E+04 | COMPARATIVE EXAMPLE |
| CJ-1 | 98.0 | 90.1 | 0.36 | 88.3 | 0.30 | 797.1 | 1129.1 | 17.7 | 28.7 | 1.6E+06 | COMPARATIVE EXAMPLE |
| CK-1 | 94.9 | 82.1 | 0.35 | 83.8 | 0.25 | 845.7 | 1247.4 | 15.7 | 24.2 | 1.7E+06 | COMPARATIVE EXAMPLE |
| CL-1 | 90.6 | 86.2 | 0.34 | 86.8 | 0.24 | 863.9 | 1175.4 | 17.8 | 67.2 | 1.6E+06 | COMPARATIVE EXAMPLE |

UNDERLINES INDICATE THAT VALUES FALL OUTSIDE THE RANGE OF THE PRESENT INVENTION.

TABLE 3-1

| MANUFACTURING NO. | STEEL TYPE | MANUFACTURING CONDITION HOT ROLLING CONDITION: HEATING TEMPERATURE (° C.) | HEATING TIME (hr) | NUMBER OF TIMES OF ROUGH ROLLING | REDUCTION AT 1000 TO 1150° C. (%) | ROLLING REDUCTION AT T1 TO T1 + 150° C. (%) | FT (° C.) | TIME PERIOD UNTIL STARTING COOLING | FIRST COOLING RATE (° C./s) |
|---|---|---|---|---|---|---|---|---|---|
| A-2 | A | 1200 | 2.7 | 3 | 87 | 81 | 933 | 3.6 | 73 |
| B-2 | B | 1204 | 2.1 | 5 | 52 | 71 | 961 | 3.6 | 57 |
| C-2 | C | 1205 | 0.5 | 5 | 48 | 63 | 884 | 3.2 | 60 |
| D-2 | D | 1215 | 1.9 | 5 | 86 | 58 | 937 | 4.2 | 67 |
| E-2 | E | 1201 | 2.5 | 3 | 56 | 68 | 913 | 2.0 | 75 |
| F-2 | F | 1194 | 2.4 | 5 | 62 | 65 | 920 | 4.3 | 64 |
| G-2 | G | 1175 | 1.3 | 3 | 46 | 56 | 928 | 4.4 | 69 |
| H-2 | H | 1168 | 2.3 | 7 | 87 | 64 | 904 | 0.3 | 76 |
| I-2 | I | 1207 | 2.0 | 7 | 86 | 55 | 888 | 4.1 | 78 |
| J-2 | J | 1204 | 1.6 | 7 | 65 | 53 | 958 | 1.3 | 79 |
| K-2 | K | 1210 | 1.2 | 5 | 93 | 60 | 893 | 3.9 | 63 |
| L-2 | L | 1168 | 2.2 | 5 | 77 | 76 | 832 | 2.3 | 23 |
| M-2 | M | 1185 | 0.7 | 5 | 81 | 44 | 886 | 3.6 | 58 |
| N-2 | N | 1210 | 2.6 | 5 | 61 | 77 | 837 | 4.3 | 71 |
| O-2 | O | 1183 | 2.5 | 7 | 45 | 81 | 919 | 4.7 | 45 |
| P-2 | P | 1163 | 2.4 | 3 | 86 | 76 | 890 | 2.1 | 43 |
| Q-2 | Q | 1167 | 1.0 | 7 | 69 | 67 | 901 | 5.1 | 83 |
| R-2 | R | 1208 | 1.2 | 3 | 59 | 74 | 937 | 3.3 | 51 |
| S-2 | S | 1180 | 0.6 | 7 | 50 | 93 | 905 | 3.4 | 80 |
| T-2 | T | 1195 | 2.1 | 1 | 68 | 56 | 882 | 1.3 | 66 |
| U-2 | U | 1177 | 1.3 | 3 | 49 | 86 | 815 | 2.9 | 71 |
| V-2 | V | 1218 | 1.7 | 7 | 53 | 96 | 934 | 2.9 | 59 |
| W-2 | W | 1169 | 1.8 | 5 | 72 | 81 | 973 | 3.1 | 49 |
| X-2 | X | 1171 | 1.1 | 5 | 58 | 94 | 931 | 0.7 | 63 |
| AL-2 | AL | 1191 | 1.2 | 7 | 50 | 86 | 928 | 1.1 | 64 |
| AM-2 | AM | 1180 | 0.7 | 3 | 42 | 89 | 905 | 4.6 | 43 |
| AN-2 | AN | 1166 | 2.3 | 1 | 47 | 80 | 944 | 2.0 | 91 |
| AO-2 | AO | 1182 | 1.0 | 1 | 86 | 55 | 897 | 0.8 | 43 |
| AP-2 | AP | 1172 | 2.6 | 1 | 51 | 58 | 945 | 2.5 | 44 |
| AQ-2 | AQ | 1181 | 0.7 | 7 | 65 | 55 | 942 | 0.3 | 43 |

UNDERLINES INDICATE THAT VALUES FALL OUTSIDE THE RANGE OF THE PRESENT INVENTION.

TABLE 3-2

| MANU-FACTUR-ING NO. | STEEL TYPE | MANUFACTURING CONDITION HOT ROLLING CONDITION HEATING TEMPER-ATURE (° C.) | HEATING TIME (hr) | NUMBER OF TIMES OF ROUGH ROLLING | REDUCTION AT 1000 TO 1150° C. (%) | ROLLING REDUCTION AT T1 TO T1 + 150° C. (%) | FT (° C.) | TIME PERIOD UNTIL STARTING COOLING | FIRST COOLING RATE (° C./s) |
|---|---|---|---|---|---|---|---|---|---|
| AR-2 | AR | 1176 | 1.5 | 7 | 89 | 93 | 912 | 0.6 | 30 |
| AS-2 | AS | 1197 | 1.0 | 3 | 53 | 84 | 945 | 0.4 | 58 |
| AT-2 | AT | 1187 | 2.6 | 1 | 63 | 53 | 901 | 3.6 | 24 |
| AU-2 | AU | 1182 | 0.5 | 5 | 82 | 93 | 967 | 1.3 | 79 |
| AV-2 | AV | 1182 | 0.8 | 7 | 82 | 75 | 906 | 2.9 | 42 |
| AW-2 | AW | 1195 | 1.4 | 5 | 44 | 86 | 920 | 3.5 | 25 |
| AX-2 | AX | 1163 | 0.7 | 5 | 93 | 55 | 959 | 0.6 | 65 |
| AY-2 | AY | 1175 | 2.3 | 3 | 59 | 93 | 928 | 0.6 | 56 |
| AZ-2 | AZ | 1169 | 1.6 | 1 | 81 | 71 | 945 | 1.7 | 77 |
| BA-2 | BA | 1211 | 1.5 | 1 | 58 | 57 | 925 | 2.2 | 60 |
| BB-2 | BB | 1188 | 1.5 | 7 | 57 | 88 | 907 | 1.8 | 48 |
| BC-2 | BC | 1202 | 2.1 | 5 | 93 | 67 | 969 | 3.4 | 58 |
| BD-2 | BD | 1186 | 1.8 | 3 | 38 | 92 | 909 | 1.9 | 32 |
| BE-2 | BE | 1166 | 1.4 | 3 | 70 | 69 | 906 | 3.8 | 51 |
| BF-2 | BF | 1173 | 1.3 | 1 | 89 | 75 | 948 | 3.0 | 53 |
| BG-2 | BG | 1173 | 1.8 | 7 | 42 | 59 | 886 | 4.3 | 32 |
| BH-2 | BH | 1181 | 1.4 | 3 | 87 | 73 | 906 | 0.7 | 28 |
| BI-2 | BI | 1210 | 2.2 | 1 | 88 | 55 | 874 | 2.5 | 41 |
| A-3 | A | 1187 | 2.2 | 1 | 69 | 89 | 892 | 4.2 | 76 |
| B-3 | B | 1175 | 1.2 | 5 | 57 | 94 | 912 | 4.3 | 47 |
| C-3 | C | 1207 | 3.0 | 3 | 70 | 82 | 909 | 0.7 | 44 |
| D-3 | D | 1200 | 2.8 | 3 | 46 | 61 | 934 | 4.1 | 37 |
| E-3 | E | 1190 | 0.6 | 7 | 85 | 83 | 907 | 1.3 | 62 |
| F-3 | F | 1188 | 2.5 | 5 | 36 | 91 | 950 | 0.6 | 46 |
| G-3 | G | 1170 | 0.9 | 5 | 69 | 61 | 958 | 3.2 | 76 |
| H-3 | H | 1188 | 0.8 | 3 | 48 | 93 | 891 | 1.5 | 73 |
| I-3 | I | 1187 | 2.5 | 5 | 52 | 83 | 946 | 1.4 | 21 |
| J-3 | J | 1196 | 1.6 | 5 | 52 | 67 | 952 | 4.5 | 37 |
| K-3 | K | 1220 | 0.8 | 1 | 48 | 75 | 960 | 0.6 | 30 |
| L-3 | L | 1172 | 1.1 | 3 | 92 | 52 | 888 | 1.1 | 66 |

35

TABLE 3-3

| MANU-FACTUR-ING NO. | STEEL TYPE | MANUFACTURING CONDITION HOT ROLLING CONDITION HEATING TEMPER-ATURE (° C.) | HEATING TIME (hr) | NUMBER OF TIMES OF ROUGH ROLLING | REDUCTION AT 1000 TO 1150° C. (%) | ROLLING REDUCTION AT T1 TO T1 + 150° C. (%) | FT (° C.) | TIME PERIOD UNTIL STARTING COOLING | FIRST COOLING RATE (° C./s) |
|---|---|---|---|---|---|---|---|---|---|
| M-3 | M | 1200 | 2.2 | 5 | 85 | 61 | 876 | 1.3 | 41 |
| N-3 | N | 1196 | 1.6 | 3 | 82 | 58 | 886 | 1.9 | 35 |
| O-3 | O | 1174 | 0.8 | 5 | 77 | 73 | 942 | 1.1 | 60 |
| P-3 | P | 1178 | 0.7 | 7 | 53 | 69 | 894 | 0.8 | 62 |
| Q-3 | Q | 1219 | 1.7 | 5 | 91 | 65 | 882 | 0.5 | 38 |
| R-3 | R | 1215 | 1.5 | 1 | 87 | 72 | 931 | 0.5 | 22 |
| S-3 | S | 1174 | 0.7 | 5 | 73 | 52 | 929 | 0.3 | 29 |
| T-3 | T | 1214 | 0.8 | 3 | 90 | 82 | 876 | 0.0 | 42 |
| U-3 | U | 1186 | 2.4 | 1 | 92 | 85 | 897 | 2.9 | 41 |
| V-3 | V | 1201 | 2.5 | 7 | 64 | 94 | 891 | 2.3 | 52 |
| W-3 | W | 1167 | 2.2 | 3 | 92 | 55 | 887 | 2.5 | 57 |
| X-3 | X | 1201 | 1.8 | 7 | 93 | 64 | 916 | 0.8 | 63 |
| AL-3 | AL | 1168 | 2.7 | 5 | 83 | 61 | 911 | 0.2 | 51 |
| AM-3 | AM | 1195 | 1.8 | 7 | 64 | 68 | 969 | 0.9 | 37 |
| AN-3 | AN | 1187 | 1.5 | 1 | 58 | 78 | 926 | 4.4 | 51 |
| AO-3 | AO | 1193 | 2.8 | 7 | 47 | 65 | 971 | 3.6 | 69 |
| AP-3 | AP | 1208 | 2.6 | 3 | 93 | 95 | 944 | 2.1 | 22 |
| AQ-3 | AQ | 1174 | 1.5 | 1 | 77 | 68 | 936 | 2.7 | 24 |
| AR-3 | AR | 1167 | 8.9 | 5 | 40 | 73 | 893 | 2.9 | 65 |
| AS-3 | AS | 1200 | 3.0 | 5 | 52 | 77 | 939 | 2.2 | 37 |
| AT-3 | AT | 1129 | 4.0 | 3 | 86 | 61 | 967 | 0.9 | 13 |
| AU-3 | AU | 1239 | 9.0 | 5 | 52 | 94 | 955 | 5.5 | 77 |
| AV-3 | AV | 1171 | 8.1 | 5 | 43 | 56 | 956 | 2.0 | 52 |
| AW-3 | AW | 1106 | 0.3 | 5 | 59 | 67 | 886 | 1.0 | 64 |
| AX-3 | AX | 1175 | 9.4 | 3 | 91 | 93 | 917 | 3.1 | 27 |

TABLE 3-3-continued

| MANU-FACTURING NO. | STEEL TYPE | MANUFACTURING CONDITION HOT ROLLING CONDITION HEATING TEMPERATURE (° C.) | HEATING TIME (hr) | NUMBER OF TIMES OF ROUGH ROLLING | REDUCTION AT 1000 TO 1150° C. (%) | ROLLING REDUCTION AT T1 TO T1 + 150° C. (%) | FT (° C.) | TIME PERIOD UNTIL STARTING COOLING | FIRST COOLING RATE (° C./s) |
|---|---|---|---|---|---|---|---|---|---|
| AY-3 | AY | 1219 | 1.1 | 3 | 44 | 90 | 909 | 4.5 | 44 |
| AZ-3 | AZ | 1230 | 9.3 | 5 | 86 | 63 | 947 | 2.8 | 79 |
| BA-3 | BA | 1112 | 6.3 | 7 | 55 | 68 | 902 | 1.9 | 78 |
| BB-3 | BB | 1228 | 5.2 | 5 | 85 | 89 | 961 | 1.6 | 41 |
| BC-3 | BC | 1179 | 2.7 | 5 | 79 | 41 | 890 | 0.7 | 31 |

UNDERLINES INDICATE THAT VALUES FALL OUTSIDE THE RANGE OF THE PRESENT INVENTION..

TABLE 3-4

| MANU-FACTURING NO. | STEEL TYPE | MANUFACTURING CONDITION HOT ROLLING CONDITION HEATING TEMPERATURE (° C.) | HEATING TIME (hr) | NUMBER OF TIMES OF ROUGH ROLLING | REDUCTION AT 1000 TO 1150° C. (%) | ROLLING REDUCTION AT T1 TO T1 + 150° C. (%) | FT (° C.) | TIME PERIOD UNTIL STARTING COOLING | FIRST COOLING RATE (° C./s) |
|---|---|---|---|---|---|---|---|---|---|
| BD-3 | BD | 1148 | 6.5 | 3 | 91 | 80 | 922 | 4.1 | 36 |
| BE-3 | BE | 1197 | 4.3 | 3 | 46 | 53 | 918 | 1.6 | 24 |
| BF-3 | BF | 1171 | 1.7 | 5 | 93 | 97 | 919 | 3.4 | 69 |
| BG-3 | BG | 1155 | 4.6 | 1 | 73 | 55 | 948 | 1.0 | 32 |
| BH-3 | BH | 1124 | 9.8 | 3 | 47 | 73 | 828 | 2.5 | 76 |
| BI-3 | BI | 1139 | 6.9 | 3 | 74 | 92 | 888 | 3.6 | 46 |
| A-4 | A | 1174 | 4.2 | 1 | 60 | 83 | 928 | 0.5 | 28 |
| B-4 | B | 1219 | 8.3 | 5 | 75 | 91 | 925 | 3.0 | 54 |
| C-4 | C | 1235 | 6.3 | 3 | 60 | 73 | 888 | 3.6 | 66 |
| D-4 | D | 1176 | 7.4 | 3 | 55 | 80 | 915 | 2.0 | 62 |
| E-4 | E | 1223 | 0.5 | 3 | 86 | 89 | 945 | 4.4 | 44 |
| F-4 | F | 1221 | 2.1 | 1 | 52 | 52 | 914 | 3.4 | 23 |
| G-4 | G | 1125 | 6.2 | 5 | 91 | 58 | 934 | 2.3 | 17 |
| H-4 | H | 1120 | 2.8 | 3 | 69 | 82 | 949 | 3.6 | 36 |
| I-4 | I | 1205 | 2.9 | 7 | 94 | 77 | 915 | 1.9 | 51 |
| J-4 | J | 1132 | 3.4 | 5 | 84 | 88 | 904 | 2.7 | 61 |
| K-4 | K | 1152 | 3.3 | 1 | 50 | 82 | 886 | 2.5 | 54 |
| L-4 | L | 1199 | 3.7 | 7 | 83 | 93 | 875 | 2.6 | 25 |
| M-4 | M | 1128 | 1.3 | 7 | 45 | 78 | 882 | 4.0 | 31 |
| N-4 | N | 1215 | 9.8 | 3 | 72 | 85 | 924 | 3.8 | 60 |
| O-4 | O | 1199 | 4.9 | 1 | 65 | 96 | 917 | 3.9 | 62 |
| P-4 | P | 1184 | 1.5 | 1 | 83 | 53 | 879 | 2.3 | 43 |
| Q-4 | Q | 1138 | 7.3 | 3 | 45 | 67 | 914 | 2.5 | 33 |
| R-4 | R | 1144 | 5.0 | 3 | 60 | 76 | 914 | 1.1 | 21 |
| S-4 | S | 1225 | 1.7 | 3 | 74 | 84 | 888 | 0.2 | 48 |
| T-4 | T | 1116 | 6.6 | 3 | 41 | 95 | 906 | 1.7 | 69 |
| U-4 | U | 1161 | 4.8 | 3 | 91 | 73 | 897 | 3.3 | 54 |
| V-4 | V | 1206 | 3.2 | 5 | 80 | 52 | 924 | 4.3 | 34 |
| W-4 | W | 1244 | 3.4 | 1 | 53 | 93 | 926 | 2.0 | 46 |
| X-4 | X | 1169 | 5.0 | 3 | 75 | 95 | 925 | 2.9 | 37 |

UNDERLINES INDICATE THAT VALUES FALL OUTSIDE THE RANGE OF THE PRESENT INVENTION.

TABLE 3-5

| MANU-FACTURING NO. | STEEL TYPE | MANUFACTURING CONDITION HOT ROLLING CONDITION HEATING TEMPERATURE (° C.) | HEATING TIME (hr) | NUMBER OF TIMES OF ROUGH ROLLING | REDUCTION AT 1000 TO 1150° C. (%) | ROLLING REDUCTION AT T1 TO T1 + 150° C. (%) | FT (° C.) | TIME PERIOD UNTIL STARTING COOLING | FIRST COOLING RATE (° C./s) |
|---|---|---|---|---|---|---|---|---|---|
| AL-4 | AL | 1238 | 2.1 | 7 | 88 | 66 | 956 | 0.6 | 64 |
| AM-4 | AM | 1240 | 4.7 | 7 | 87 | 79 | 909 | 4.3 | 60 |
| AN-4 | AN | 1221 | 3.4 | 3 | 66 | 66 | 885 | 0.1 | 55 |
| AO-4 | AO | 1228 | 2.5 | 5 | 49 | 72 | 917 | 1.2 | 38 |
| AP-4 | AP | 1239 | 7.6 | 5 | 48 | 85 | 919 | 2.1 | 27 |
| AQ-4 | AQ | 1193 | 1.5 | 3 | 64 | 96 | 927 | 2.7 | 75 |
| AR-4 | AR | 1233 | 9.7 | 3 | 44 | 63 | 945 | 2.4 | 40 |
| AS-4 | AS | 1196 | 1.0 | 5 | 82 | 94 | 908 | 3.2 | 74 |
| AT-4 | AT | 1181 | 6.3 | 7 | 67 | 91 | 930 | 2.1 | 34 |
| AU-4 | AU | 1103 | 0.6 | 7 | 79 | 79 | 953 | 1.9 | 48 |
| AV-4 | AV | 1150 | 9.8 | 5 | 85 | 61 | 915 | 4.5 | 37 |
| AW-4 | AW | 1148 | 2.1 | 5 | 64 | 65 | 903 | 3.4 | 23 |
| AX-4 | AX | 1171 | 2.5 | 3 | 94 | 93 | 937 | 2.2 | 49 |
| AY-4 | AY | 1198 | 5.1 | 5 | 86 | 62 | 905 | 1.7 | 23 |
| AZ-4 | AZ | 1239 | 5.3 | 7 | 74 | 83 | 955 | 1.2 | 35 |
| BA-4 | BA | 1190 | 4.0 | 3 | 92 | 85 | 891 | 0.3 | 34 |
| BB-4 | BB | 1148 | 4.8 | 1 | 66 | 87 | 899 | 4.7 | 35 |
| BC-4 | BC | 1181 | 6.9 | 3 | 43 | 58 | 902 | 0.3 | 64 |
| BD-4 | BD | 1188 | 8.8 | 5 | 60 | 67 | 943 | 2.8 | 58 |
| BE-4 | BE | 1242 | 8.8 | 3 | 88 | 62 | 880 | 2.8 | 76 |
| BF-4 | BF | 1101 | 6.9 | 3 | 83 | 83 | 918 | 3.2 | 61 |
| BG-4 | BG | 1109 | 7.9 | 3 | 68 | 75 | 954 | 1.0 | 55 |
| BH-4 | BH | 1215 | 7.4 | 5 | 56 | 78 | 903 | 1.6 | 59 |
| BI-4 | BI | 1198 | 8.0 | 3 | 70 | 61 | 886 | 3.4 | 22 |

UNDERLINES INDICATE THAT VALUES FALL OUTSIDE THE RANGE OF THE PRESENT INVENTION.

TABLE 3-6

| MANU FACTURING NO. | t (s) | MANUFACTURING CONDITION HOT ROLLING CONDITION HOLDING TIME (s) | CT (° C.) | SHEET THICKNESS (mm) | COLD ROLLING CONDITION COLD ROLLING REDUCTION (%) | SHEET THICKNESS AFTER COLD ROLLING (mm) | ANNEALING CONDITION ANNEALING TEMPERATURE (° C.) | HOLDING TIME (s) | THIRD COOLING THIRD COOLING RATE (° C./s) | STOP TEMPERATURE (° C.) | FOURTH COOLING FOURTH COOLING RATE (° C./s) | STOP TEMPERATURE (° C.) |
|---|---|---|---|---|---|---|---|---|---|---|---|---|
| A-2 | 1.98 | 3.60 | 541 | 1.4 | 42.0 | 0.8 | 901 | 57 | 5.9 | 717 | 32.0 | 268 |
| B-2 | 2.11 | 6.50 | 574 | 3.9 | 82.5 | 0.7 | 873 | 296 | 7.8 | 620 | 15.3 | 317 |
| C-2 | 2.06 | 2.39 | 507 | 1.6 | 49.1 | 0.8 | 926 | 541 | 5.1 | 641 | 54.4 | 494 |
| D-2 | 2.04 | 6.97 | 588 | 3.5 | 63.0 | 1.3 | 869 | 580 | 5.4 | 685 | 53.1 | 192 |
| E-2 | 2.13 | 6.46 | 572 | 2.0 | 48.2 | 1.0 | 932 | 568 | 2.1 | 708 | 18.3 | 461 |
| F-2 | 2.11 | 3.42 | 583 | 1.9 | 59.2 | 0.8 | 911 | 521 | 5.9 | 708 | 23.1 | 461 |
| G-2 | 1.75 | 7.58 | 422 | 3.8 | 77.8 | 0.8 | 935 | 341 | 6.9 | 704 | 35.3 | 156 |
| H-2 | 2.02 | 9.70 | 591 | 2.9 | 64.3 | 1.0 | 857 | 216 | 4.0 | 642 | 18.7 | 145 |
| I-2 | 2.08 | 7.29 | 562 | 1.5 | 72.4 | 0.4 | 888 | 531 | 5.8 | 637 | 36.0 | 194 |
| J-2 | 2.14 | 5.12 | 337 | 3.3 | 65.8 | 1.1 | 884 | 284 | 2.7 | 692 | 16.9 | 175 |
| K-2 | 1.75 | 5.76 | 413 | 3.5 | 52.8 | 1.7 | 849 | 314 | 2.3 | 705 | 31.8 | 315 |
| L-2 | 2.14 | 5.87 | 561 | 3.2 | 71.7 | 0.9 | 848 | 410 | 1.8 | 692 | 47.0 | 343 |
| M-2 | 2.05 | 5.06 | 458 | 3.6 | 63.2 | 1.3 | 841 | 421 | 2.1 | 690 | 19.2 | 332 |
| N-2 | 2.08 | 2.42 | 571 | 2.4 | 56.4 | 1.0 | 930 | 80 | 6.3 | 631 | 8.2 | 385 |
| O-2 | 2.08 | 7.53 | 514 | 2.3 | 44.9 | 1.3 | 882 | 149 | 8.2 | 699 | 52.4 | 212 |
| P-2 | 2.33 | 5.01 | 547 | 1.6 | 48.3 | 0.8 | 909 | 82 | 5.5 | 608 | 48.0 | 314 |
| Q-2 | 2.29 | 2.73 | 345 | 3.0 | 43.3 | 1.7 | 916 | 383 | 8.7 | 709 | 43.5 | 322 |
| R-2 | 2.23 | 3.87 | 570 | 1.7 | 38.4 | 1.0 | 864 | 169 | 3.7 | 658 | 17.1 | 220 |
| 3-2 | 2.19 | 5.59 | 49 | 3.0 | 41.9 | 1.7 | 910 | 94 | 8.6 | 673 | 39.8 | 291 |
| T-2 | 2.45 | 5.13 | 497 | 3.1 | 43.0 | 1.8 | 881 | 21 | 5.6 | 684 | 12.9 | 251 |
| U-2 | 2.22 | 9.53 | 334 | 3.5 | 78.6 | 0.7 | 858 | 174 | 10.0 | 654 | 59.7 | 376 |
| V-2 | 2.32 | 4.12 | 572 | 2.1 | 57.8 | 0.9 | 904 | 305 | 9.9 | 708 | 37.2 | 176 |
| W-2 | 2.26 | 6.34 | 365 | 1.3 | 55.8 | 0.6 | 939 | 38 | 9.2 | 619 | 40.9 | 316 |
| X-2 | 2.34 | 2.09 | 512 | 2.3 | 45.7 | 1.2 | 920 | 181 | 5.0 | 709 | 32.6 | 383 |

TABLE 3-6-continued

| MANUFACTURING CONDITION | | | | | | | | | | | | |
|---|---|---|---|---|---|---|---|---|---|---|---|---|
| | | HOT ROLLING CONDITION | | | COLD ROLLING CONDITION | | ANNEALING CONDITION | | | THIRD COOLING | | FOURTH COOLING |
| MANUFACTURING NO. | t (s) | HOLDING TIME (s) | CT (° C.) | SHEET THICKNESS (mm) | COLD ROLLING REDUCTION (%) | SHEET THICKNESS AFTER COLD ROLLING (mm) | ANNEALING TEMPERATURE (° C.) | HOLDING TIME (s) | THIRD COOLING RATE (° C./s) | STOP TEMPERATURE (° C.) | FOURTH COOLING RATE (° C./s) | STOP TEMPERATURE (° C.) |
| AL-2 | 2.00 | 2.95 | 471 | 1.8 | 74.8 | 0.5 | 948 | 472 | 3.1 | 656 | 26.9 | 277 |
| AM-2 | 1.83 | 2.00 | 338 | 3.2 | 45.2 | 1.8 | 889 | 174 | 6.4 | 602 | 47.7 | 355 |
| AN-2 | 2.09 | 5.65 | 481 | 1.6 | 79.3 | 0.3 | 951 | 444 | 5.0 | 650 | 59.6 | 342 |
| AO-2 | 1.83 | 8.22 | 94 | 3.3 | 72.6 | 0.9 | 894 | 442 | 4.8 | 641 | 33.1 | 358 |
| AP-2 | 2.05 | 4.73 | 366 | 1.6 | 56.0 | 0.7 | 912 | 460 | 5.9 | 676 | 18.5 | 429 |
| AQ-2 | 1.71 | 6.03 | 516 | 4.0 | 64.9 | 1.4 | 924 | 276 | 8.4 | 718 | 37.2 | 288 |

UNDERLINES INDICATE THAT VALUES FALL OUTSIDE THE RANGE OF THE PRESENT INVENTION.

TABLE 3-7

| MANUFACTURING CONDITION | | | | | | | | | | | | |
|---|---|---|---|---|---|---|---|---|---|---|---|---|
| | | HOT ROLLING CONDITION | | | COLD ROLLING CONDITION | | ANNEALING CONDITION | | | THIRD COOLING | | FOURTH COOLING |
| MANUFACTURING NO. | t (s) | HOLDING TIME (s) | CT (° C.) | SHEET THICKNESS (mm) | COLD ROLLING REDUCTION (%) | SHEET THICKNESS AFTER COLD ROLLING (mm) | ANNEALING TEMPERATURE (° C.) | HOLDING TIME (s) | THIRD COOLING RATE (° C./s) | STOP TEMPERATURE (° C.) | FOURTH COOLING RATE (° C./s) | STOP TEMPERATURE (° C.) |
| AR-2 | 1.84 | 9.17 | 541 | 3.2 | 45.1 | 1.8 | 933 | 497 | 3.7 | 629 | 55.0 | 273 |
| AS-2 | 1.91 | 9.18 | 423 | 2.6 | 41.6 | 1.5 | 919 | 65 | 4.7 | 652 | 52.1 | 495 |
| AT-2 | 1.94 | 9.79 | 344 | 2.1 | 62.3 | 0.8 | 920 | 419 | 9.4 | 709 | 12.7 | 210 |
| AU-2 | 1.99 | 7.46 | 459 | 1.7 | 57.4 | 0.7 | 930 | 24 | 7.2 | 669 | 18.4 | 386 |
| AV-2 | 2.26 | 4.17 | 353 | 1.3 | 63.1 | 0.5 | 931 | 130 | 5.9 | 687 | 19.1 | 225 |
| AW-2 | 1.81 | 9.29 | 385 | 4.0 | 58.2 | 1.7 | 918 | 57 | 3.1 | 605 | 64.5 | 233 |
| AX-2 | 1.81 | 2.62 | 466 | 2.2 | 34.2 | 1.4 | 905 | 546 | 4.4 | 697 | 31.6 | 177 |
| AY-2 | 1.99 | 4.10 | 387 | 2.5 | 60.7 | 1.0 | 917 | 416 | 5.1 | 650 | 28.2 | 511 |
| AZ-2 | 2.16 | 8.53 | 595 | 3.8 | 47.4 | 2.0 | 888 | 430 | 1.6 | 601 | 24.8 | 489 |
| BA-2 | 2.05 | 9.23 | 561 | 3.2 | 74.4 | 0.8 | 894 | 381 | 8.9 | 639 | 20.6 | 467 |
| BB-2 | 1.88 | 6.57 | 555 | 3.9 | 64.7 | 1.4 | 910 | 64 | 7.6 | 636 | 48.0 | 236 |
| BC-2 | 2.14 | 9.38 | 525 | 2.1 | 53.6 | 1.0 | 912 | 585 | 10.0 | 617 | 21.8 | 461 |
| BD-2 | 2.13 | 3.44 | 460 | 3.1 | 67.3 | 1.0 | 866 | 297 | 7.3 | 657 | 37.3 | 477 |
| BE-2 | 2.22 | 7.77 | 450 | 2.1 | 75.3 | 0.5 | 930 | 243 | 7.1 | 625 | 23.0 | 187 |
| BF-2 | 2.52 | 3.78 | 459 | 2.7 | 81.2 | 0.5 | 898 | 451 | 8.0 | 620 | 43.9 | 322 |
| BG-2 | 2.13 | 6.34 | 368 | 1.9 | 77.7 | 0.4 | 850 | 441 | 0.8 | 642 | 30.9 | 195 |
| BH-2 | 2.48 | 8.54 | 301 | 1.5 | 55.1 | 0.7 | 856 | 81 | 9.4 | 622 | 44.3 | 260 |
| BI-2 | 2.48 | 9.38 | 554 | 3.0 | 59.8 | 1.2 | 862 | 449 | 7.1 | 677 | 33.9 | 214 |
| A-3 | 1.98 | 6.06 | 537 | 2.2 | 52.0 | 1.1 | 944 | 462 | 4.0 | 636 | 55.8 | 312 |
| B-3 | 2.11 | 7.96 | 374 | 3.3 | 78.6 | 0.7 | 892 | 476 | 4.6 | 714 | 49.3 | 314 |
| C-3 | 2.06 | 2.86 | 383 | 3.7 | 43.6 | 2.1 | 876 | 333 | 10.9 | 618 | 44.9 | 230 |
| D-3 | 2.04 | 7.69 | 587 | 3.0 | 73.9 | 0.8 | 877 | 223 | 0.5 | 618 | 23.7 | 167 |
| E-3 | 2.13 | 8.93 | 431 | 1.5 | 69.2 | 0.5 | 893 | 361 | 9.3 | 654 | 48.8 | 241 |
| F-3 | 2.11 | 8.01 | 380 | 1.7 | 75.8 | 0.4 | 907 | 435 | 10.0 | 630 | 39.8 | 334 |
| G-3 | 1.75 | 2.03 | 305 | 2.2 | 72.3 | 0.6 | 901 | 373 | 3.5 | 693 | 14.8 | 449 |
| H-3 | 2.02 | 9.36 | 535 | 3.9 | 67.7 | 1.3 | 871 | 592 | 7.3 | 658 | 30.1 | 349 |
| I-3 | 2.08 | 5.35 | 341 | 2.2 | 65.4 | 0.8 | 848 | 204 | 5.4 | 684 | 31.6 | 439 |
| J-3 | 2.14 | 4.71 | 541 | 3.6 | 60.6 | 1.4 | 877 | 34 | 5.3 | 690 | 62.5 | 384 |
| K-3 | 1.75 | 6.23 | 598 | 1.7 | 41.9 | 1.0 | 912 | 95 | 3.0 | 672 | 52.2 | 260 |
| L-3 | 2.14 | 6.72 | 576 | 3.2 | 75.5 | 0.8 | 901 | 477 | 4.9 | 679 | 38.3 | 405 |

UNDERLINES INDICATE THAT VALUES FALL OUTSIDE THE RANGE OF THE PRESENT INVENTION.

TABLE 3-8

| | MANUFACTURING CONDITION | | | | | | | |
|---|---|---|---|---|---|---|---|---|
| | | | | | COLD ROLLING CONDITION | | | |
| | HOT ROLLING CONDITION | | | | COLD | SHEET | ANNEALING CONDITION | |
| MANUFACTURING NO. | t (s) | HOLDING TIME (s) | CT (° C.) | SHEET THICKNESS (mm) | ROLLING REDUCTION (%) | THICKNESS AFTER COLD ROLLING (mm) | ANNEALING TEMPERATURE (° C.) | HOLDING TIME (s) |
| M-3 | 2.05 | 2.99 | 555 | 2.7 | 57.8 | 1.1 | 852 | 457 |
| N-3 | 2.08 | 4.11 | 432 | 2.8 | 69.7 | 0.8 | 854 | 546 |
| O-3 | 2.08 | 6.04 | 330 | 3.5 | 52.6 | 1.7 | 915 | 508 |
| P-3 | 2.33 | 6.83 | 461 | 2.0 | 57.9 | 0.8 | 849 | 110 |
| Q-3 | 2.29 | 9.58 | 510 | 1.6 | 71.7 | 0.5 | 845 | 294 |
| R-3 | 2.23 | 7.56 | 509 | 3.0 | 52.4 | 1.4 | 877 | 274 |
| S-3 | 2.19 | 2.37 | 591 | 2.3 | 66.4 | 0.8 | 897 | 496 |
| T-3 | 2.45 | 3.08 | 544 | 3.6 | 56.4 | 1.6 | 857 | 327 |
| U-3 | 2.22 | 9.61 | 495 | 1.7 | 72.2 | 0.5 | 918 | 514 |
| V-3 | 2.32 | 6.28 | 572 | 2.2 | 57.3 | 0.9 | 868 | 380 |
| W-3 | 2.26 | 6.88 | 614 | 1.3 | 53.6 | 0.6 | 897 | 575 |
| X-3 | 2.34 | 5.70 | 449 | 3.4 | 59.6 | 1.4 | 861 | 496 |
| AL-3 | 2.00 | 5.33 | 518 | 3.0 | 57.6 | 1.3 | 903 | 324 |
| AM-3 | 1.83 | 8.14 | 463 | 3.0 | 69.5 | 0.9 | 929 | 351 |
| AN-3 | 2.08 | 2.99 | 545 | 2.0 | 68.3 | 0.6 | 935 | 434 |
| AO-3 | 1.83 | 9.90 | 537 | 1.4 | 46.5 | 0.7 | 863 | 402 |
| AP-3 | 2.05 | 6.02 | 431 | 2.6 | 52.1 | 1.2 | 848 | 128 |
| AQ-3 | 1.71 | 5.43 | 364 | 3.5 | 52.3 | 1.7 | 864 | 355 |
| AR-3 | 1.84 | 4.68 | 374 | 1.9 | 41.7 | 1.1 | 964 | 540 |
| AS-3 | 1.91 | 3.33 | 425 | 1.7 | 66.9 | 0.6 | 851 | 303 |
| AT-S | 1.94 | 6.11 | 528 | 3.4 | 41.6 | 2.0 | 936 | 516 |
| AU-3 | 1.99 | 4.10 | 581 | 1.4 | 45.2 | 0.8 | 873 | 301 |
| AV-3 | 2.26 | 9.05 | 503 | 1.9 | 50.8 | 0.9 | 854 | 221 |
| AW-3 | 1.81 | 1.95 | 554 | 1.7 | 71.0 | 0.5 | 930 | 454 |
| AX-3 | 1.81 | 5.42 | 326 | 3.2 | 57.5 | 1.4 | 886 | 314 |
| AY-3 | 1.99 | 6.03 | 374 | 3.7 | 49.4 | 1.9 | 920 | 116 |
| AZ-3 | 2.16 | 9.67 | 377 | 2.8 | 67.9 | 0.9 | 869 | 535 |
| BA-3 | 2.05 | 5.55 | 473 | 1.3 | 58.7 | 0.5 | 888 | 561 |
| BB-3 | 1.88 | 4.64 | 594 | 3.0 | 75.9 | 0.7 | 922 | 47 |
| BC-3 | 2.14 | 6.67 | 587 | 1.8 | 66.6 | 0.6 | 950 | 408 |

| | MANUFACTURING CONDITION | | | |
|---|---|---|---|---|
| MANUFACTURING NO. | THIRD COOLING RATE (° C.)/(s) | THIRD COOLING STOP TEMPERATURE (° C.) | FOURTH COOLING RATE (° C.)/(s) | FOURTH COOLING STOP TEMPERATURE (° C.) |
| M-3 | 4.9 | 603 | 56.5 | 391 |
| N-3 | 6.0 | 604 | 56.0 | 300 |
| O-3 | 9.5 | 659 | 34.4 | 343 |
| P-3 | 9.6 | 710 | 32.4 | 344 |
| Q-3 | 4.6 | 714 | 44.5 | 498 |
| R-3 | 1.4 | 645 | 38.4 | 171 |
| S-3 | 1.0 | 640 | 20.4 | 184 |
| T-3 | 3.2 | 726 | 17.8 | 420 |
| U-3 | 7.5 | 701 | 40.1 | 404 |
| V-3 | 2.5 | 651 | 16.9 | 444 |
| W-3 | 8.3 | 696 | 17.0 | 446 |
| X-3 | 2.4 | 629 | 15.3 | 395 |
| AL-3 | 12.6 | 702 | 33.2 | 417 |
| AM-3 | 5.8 | 700 | 37.5 | 211 |
| AN-3 | 9.5 | 637 | 24.2 | 361 |
| AO-3 | 8.5 | 671 | 54.7 | 413 |
| AP-3 | 8.2 | 629 | 41.7 | 153 |
| AQ-3 | 5.3 | 670 | 33.1 | 455 |
| AR-3 | 7.1 | 678 | 26.0 | 499 |
| AS-3 | 2.5 | 682 | 12.9 | 494 |
| AT-S | 9.4 | 693 | 46.9 | 156 |
| AU-3 | 1.9 | 690 | 7.5 | 208 |
| AV-3 | 7.2 | 694 | 13.6 | 203 |
| AW-3 | 3.7 | 690 | 30.5 | 297 |
| AX-3 | 1.9 | 652 | 25.4 | 314 |
| AY-3 | 8.8 | 637 | 42.5 | 204 |

TABLE 3-8-continued

| | | | | |
|---|---|---|---|---|
| AZ-3 | 2.8 | 719 | 15.7 | 263 |
| BA-3 | 7.5 | 674 | 27.4 | 192 |
| BB-3 | 8.0 | 711 | 22.5 | 476 |
| BC-3 | 7.0 | 642 | 40.4 | 479 |

UNDERLINES INDICATE THAT VALUES FALL OUTSIDE THE RANGE OF THE PRESENT INVENTION.

TABLE 3-9

| | MANUFACTURING CONDITION | | | | | | | |
|---|---|---|---|---|---|---|---|---|
| | | | | | COLD ROLLING CONDITION | | | |
| | HOT ROLLING CONDITION | | | | COLD | SHEET | ANNEALING CONDITION | |
| MANUFACTURING NO. | t (s) | HOLDING TIME (s) | CT (° C.) | SHEET THICKNESS (mm) | ROLLING REDUCTION (%) | THICKNESS AFTER COLD ROLLING (mm) | ANNEALING TEMPERATURE (° C.) | HOLDING TIME (s) |
| BD-3 | 2.13 | 8.28 | 373 | 1.7 | 79.3 | 0.4 | 856 | 432 |
| BE-3 | 2.22 | 9.45 | 608 | 3.3 | 46.2 | 1.8 | 881 | 108 |
| BF-3 | 2.52 | 5.16 | 547 | 1.7 | 58.0 | 0.7 | 923 | 376 |
| BG-3 | 2.13 | 7.85 | 391 | 1.4 | 46.7 | 0.7 | 918 | 338 |
| BH-3 | 2.48 | 2.64 | 448 | 3.5 | 66.7 | 1.2 | 862 | 190 |
| BI-3 | 2.48 | 5.87 | 571 | 3.6 | 60.8 | 1.4 | 883 | 517 |
| A-4 | 1.98 | 9.81 | 348 | 2.2 | 54.3 | 1.0 | 867 | 583 |
| B-4 | 2.11 | 7.86 | 343 | 2.5 | 41.4 | 1.5 | 926 | 101 |
| C-4 | 2.06 | 5.56 | 474 | 2.0 | 68.4 | 0.6 | 900 | 272 |
| D-4 | 2.04 | 8.88 | 390 | 2.4 | 43.1 | 1.4 | 922 | 458 |
| E-4 | 2.13 | 9.98 | 456 | 3.1 | 70.8 | 0.9 | 858 | 400 |
| F-4 | 2.11 | 3.44 | 545 | 2.6 | 62.2 | 1.0 | 905 | 134 |
| G-4 | 1.75 | 4.28 | 442 | 1.9 | 59.9 | 0.8 | 879 | 60 |
| H-4 | 2.02 | 2.74 | 509 | 1.4 | 63.6 | 0.5 | 922 | 304 |
| I-4 | 2.08 | 8.55 | 507 | 3.9 | 65.7 | 1.3 | 935 | 286 |
| J-4 | 2.14 | 5.15 | 384 | 2.1 | 57.9 | 0.9 | 884 | 520 |
| K-4 | 1.75 | 7.04 | 506 | 2.3 | 46.4 | 1.2 | 917 | 575 |
| L-4 | 2.14 | 3.43 | 335 | 1.7 | 53.5 | 0.8 | 900 | 121 |
| M-4 | 2.05 | 5.97 | 564 | 2.6 | 71.2 | 0.7 | 876 | 409 |
| N-4 | 2.08 | 8.03 | 546 | 2.0 | 76.4 | 0.5 | 924 | 85 |
| O-4 | 2.08 | 5.69 | 572 | 2.3 | 70.6 | 0.7 | 856 | 347 |
| P-4 | 2.33 | 7.05 | 461 | 3.4 | 65.3 | 1.2 | 968 | 292 |
| Q-4 | 2.29 | 5.69 | 596 | 1.2 | 50.5 | 0.6 | 924 | 332 |
| R-4 | 2.23 | 8.37 | 488 | 3.9 | 72.0 | 1.1 | 917 | 103 |
| S-4 | 2.19 | 6.37 | 476 | 2.6 | 68.1 | 0.8 | 923 | 301 |
| T-4 | 2.45 | 9.51 | 369 | 3.9 | 56.5 | 1.7 | 843 | 440 |
| U-4 | 2.22 | 5.87 | 312 | 3.3 | 76.5 | 0.8 | 866 | 468 |
| V-4 | 2.32 | 9.42 | 479 | 3.4 | 40.1 | 2.0 | 849 | 634 |
| W-4 | 2.26 | 7.68 | 380 | 2.8 | 48.9 | 1.4 | 906 | 338 |
| X-4 | 2.34 | 9.44 | 432 | 3.9 | 45.7 | 2.1 | 867 | 455 |

| | MANUFACTURING CONDITION | | | |
|---|---|---|---|---|
| MANUFACTURING NO. | THIRD COOLING RATE (° C.)/(s) | THIRD COOLING STOP TEMPERATURE (° C.) | FOURTH COOLING RATE (° C.)/(s) | FOURTH COOLING STOP TEMPERATURE (° C.) |
| BD-3 | 4.8 | 645 | 26.3 | 259 |
| BE-3 | 9.4 | 644 | 49.7 | 167 |
| BF-3 | 7.9 | 689 | 12.8 | 447 |
| BG-3 | 9.3 | 720 | 11.2 | 228 |
| BH-3 | 4.9 | 623 | 12.3 | 164 |
| BI-3 | 6.1 | 693 | 20.4 | 339 |
| A-4 | 5.6 | 710 | 16.8 | 245 |
| B-4 | 4.4 | 667 | 42.8 | 182 |
| C-4 | 8.6 | 707 | 23.4 | 241 |
| D-4 | 1.1 | 707 | 38.6 | 176 |
| E-4 | 3.8 | 656 | 16.3 | 527 |
| F-4 | 7.8 | 635 | 32.9 | 165 |
| G-4 | 2.8 | 660 | 41.5 | 169 |
| H-4 | 4.7 | 617 | 32.3 | 214 |
| I-4 | 2.6 | 581 | 48.4 | 448 |
| J-4 | 2.8 | 713 | 12.7 | 291 |
| K-4 | 1.6 | 608 | 50.8 | 288 |
| L-4 | 2.6 | 706 | 29.2 | 279 |
| M-4 | 5.0 | 686 | 42.2 | 166 |
| N-4 | 6.8 | 711 | 33.6 | 226 |

TABLE 3-9-continued

| | | | | | | |
|---|---|---|---|---|---|---|
| | | O-4 | 8.8 | 605 | 13.4 | 387 |
| | | P-4 | 8.1 | 670 | 44.4 | 176 |
| | | Q-4 | 8.3 | 609 | 51.9 | 448 |
| | | R-4 | 7.3 | 709 | 14.6 | 397 |
| | | S-4 | 2.5 | 628 | 17.0 | 276 |
| | | T-4 | 2.3 | 658 | 25.8 | 182 |
| | | U-4 | 5.2 | 661 | 47.6 | 261 |
| | | V-4 | 5.4 | 700 | 17.3 | 259 |
| | | W-4 | 6.3 | 657 | 48.6 | 348 |
| | | X-4 | 9.9 | 666 | 44.2 | 263 |

UNDERLINES INDICATE THAT VALUES FALL OUTSIDE THE RANGE OF THE PRESENT INVENTION.

TABLE 3-10

| | MANUFACTURING CONDITION | | | | | | | |
|---|---|---|---|---|---|---|---|---|
| | | | | | COLD ROLLING CONDITION | | | |
| | HOT ROLLING CONDITION | | | | COLD | SHEET | ANNEALING CONDITION | |
| MANUFACTURING NO. | t (s) | HOLDING TIME (s) | CT (° C.) | SHEET THICKNESS (mm) | ROLLING REDUCTION (%) | THICKNESS AFTER COLD ROLLING(mm) | ANNEALING TEMPERATURE (° C.) | HOLDING TIME (s) |
| AL-4 | 2.00 | 7.57 | 479 | 2.4 | 58.2 | 1.0 | 941 | 470 |
| AM-4 | 1.83 | 4.66 | 590 | 3.1 | 71.6 | 0.9 | 871 | 67 |
| AN-4 | 2.08 | 9.90 | 433 | 1.5 | 55.8 | 0.7 | 909 | 72 |
| AO-4 | 1.83 | 8.58 | 364 | 2.3 | 72.7 | 0.6 | 922 | 182 |
| AP-4 | 2.05 | 9.31 | 332 | 1.9 | 57.7 | 0.8 | 902 | 84 |
| AQ-4 | 1.71 | 7.87 | 528 | 3.9 | 59.5 | 1.6 | 927 | 304 |
| AR-4 | 1.84 | 8.62 | 372 | 2.1 | 63.6 | 0.8 | 888 | 448 |
| AS-4 | 1.91 | 3.60 | 576 | 1.2 | 78.6 | 0.3 | 881 | 188 |
| AT-4 | 1.94 | 7.37 | 548 | 2.8 | 41.9 | 1.6 | 855 | 236 |
| AU-4 | 1.99 | 6.04 | 430 | 1.3 | 58.6 | 0.5 | 921 | 210 |
| AV-4 | 2.26 | 8.58 | 377 | 2.9 | 49.0 | 1.5 | 875 | 352 |
| AW-4 | 1.81 | 1.88 | 425 | 2.0 | 76.8 | 0.5 | 869 | 337 |
| AX-4 | 1.81 | 6.25 | 518 | 3.2 | 53.2 | 1.5 | 932 | 80 |
| AY-4 | 1.99 | 3.60 | 589 | 2.5 | 53.5 | 1.2 | 894 | 235 |
| AZ-4 | 2.16 | 2.56 | 340 | 1.6 | 43.5 | 0.9 | 849 | 324 |
| BA-4 | 2.05 | 1.35 | 598 | 2.5 | 73.5 | 0.7 | 884 | 127 |
| BB-4 | 1.88 | 5.74 | 406 | 1.8 | 61.1 | 0.7 | 917 | 107 |
| BC-4 | 2.14 | 7.70 | 307 | 3.9 | 64.6 | 1.4 | 914 | 185 |
| BD-4 | 2.13 | 6.83 | 335 | 2.9 | 75.6 | 0.7 | 885 | 59 |
| BE-4 | 2.22 | 2.58 | 545 | 1.5 | 68.9 | 0.5 | 919 | 438 |
| BF-4 | 2.52 | 3.58 | 530 | 3.8 | 46.8 | 2.0 | 923 | 616 |
| BG-4 | 2.13 | 4.97 | 458 | 1.4 | 76.0 | 0.3 | 906 | 36 |
| BH-4 | 2.48 | 7.67 | 590 | 2.2 | 57.2 | 0.9 | 851 | 376 |
| BI-4 | 2.48 | 3.28 | 304 | 3.2 | 44.0 | 1.8 | 826 | 548 |

| | MANUFACTURING CONDITION | | | |
|---|---|---|---|---|
| MANUFACTURING NO. | THIRD COOLING RATE (° C./s) | THIRD COOLING STOP TEMPERATURE (° C.) | FOURTH COOLING RATE (° C./s) | FOURTH COOLING STOP TEMPERATURE (° C.) |
| AL-4 | 9.4 | 684 | 41.9 | 383 |
| AM-4 | 3.4 | 633 | 35.9 | 464 |
| AN-4 | 1.6 | 605 | 39.2 | 175 |
| AO-4 | 7.0 | 639 | 47.5 | 320 |
| AP-4 | 9.8 | 707 | 49.0 | 263 |
| AQ-4 | 8.8 | 705 | 35.8 | 139 |
| AR-4 | 8.1 | 664 | 24.5 | 228 |
| AS-4 | 6.7 | 737 | 19.2 | 252 |
| AT-4 | 1.0 | 701 | 34.6 | 296 |
| AU-4 | 9.3 | 602 | 13.4 | 483 |
| AV-4 | 7.3 | 660 | 31.1 | 309 |
| AW-4 | 8.0 | 657 | 13.6 | 168 |
| AX-4 | 6.4 | 630 | 41.5 | 413 |
| AY-4 | 6.0 | 611 | 51.4 | 441 |
| AZ-4 | 8.2 | 606 | 38.2 | 336 |
| BA-4 | 8.7 | 715 | 42.8 | 321 |
| BB-4 | 4.0 | 597 | 19.9 | 446 |
| BC-4 | 9.1 | 651 | 36.0 | 256 |
| BD-4 | 1.3 | 680 | 11.6 | 374 |
| BE-4 | 5.8 | 633 | 31.0 | 379 |

TABLE 3-10-continued

| | | | | |
|---|---|---|---|---|
| BF-4 | 5.0 | 616 | 22.4 | 471 |
| BG-4 | 1.1 | 640 | 31.3 | 210 |
| BH-4 | 6.8 | 629 | 32.4 | 238 |
| BI-4 | 4.6 | 636 | 44.2 | 242 |

UNDERLINES INDICATE THAT VALUES FALL OUTSIDE THE RANGE OF THE PRESENT INVENTION.

TABLE 3-11

| | MANUFACTURING CONDITION | | | | | | |
|---|---|---|---|---|---|---|---|
| | PRESENCE OR ABSENCE | HEAT TREATMENT PROCESS | | PRESENCE OR ABSENCE | PRESENCE | PRESENCE | PRESENCE OR ABSENCE OF HOT |
| MANUFACTURING NO. | OF REHEATING | TEMPERATURE (° C.) | TIME (s) | OF TEMPERING | OR ABSENCE OF COATING | OR ABSENCE OF ALLOYING | ROLLING ANNEALING |
| A-2 | PRESENCE | 468 | 127 | ABSENCE | ABSENCE | PRESENCE | ABSENCE |
| B-2 | ABSENCE | 317 | 184 | ABSENCE | ABSENCE | ABSENCE | ABSENCE |
| C-2 | ABSENCE | 494 | 134 | ABSENCE | ABSENCE | ABSENCE | ABSENCE |
| D-2 | PRESENCE | 310 | 38 | ABSENCE | ABSENCE | ABSENCE | ABSENCE |
| E-2 | ABSENCE | 461 | 42 | ABSENCE | ABSENCE | ABSENCE | ABSENCE |
| F-2 | ABSENCE | 461 | 581 | ABSENCE | PRESENCE | ABSENCE | ABSENCE |
| G-2 | ABSENCE | 156 | 292 | ABSENCE | PRESENCE | ABSENCE | ABSENCE |
| H-2 | ABSENCE | 145 | 559 | ABSENCE | ABSENCE | ABSENCE | ABSENCE |
| I-2 | ABSENCE | 194 | 513 | PRESENCE | ABSENCE | ABSENCE | ABSENCE |
| J-2 | PRESENCE | 461 | 571 | PRESENCE | PRESENCE | ABSENCE | ABSENCE |
| K-2 | ABSENCE | 315 | 537 | ABSENCE | ABSENCE | ABSENCE | ABSENCE |
| L-2 | ABSENCE | 343 | 250 | ABSENCE | ABSENCE | ABSENCE | ABSENCE |
| M-2 | ABSENCE | 332 | 435 | ABSENCE | ABSENCE | ABSENCE | ABSENCE |
| N-2 | ABSENCE | 385 | 116 | ABSENCE | ABSENCE | ABSENCE | ABSENCE |
| O-2 | PRESENCE | 282 | 376 | PRESENCE | PRESENCE | ABSENCE | ABSENCE |
| P-2 | ABSENCE | 314 | 317 | ABSENCE | ABSENCE | ABSENCE | ABSENCE |
| Q-2 | ABSENCE | 322 | 92 | ABSENCE | ABSENCE | ABSENCE | ABSENCE |
| R-2 | ABSENCE | 220 | 140 | ABSENCE | ABSENCE | ABSENCE | ABSENCE |
| S-2 | ABSENCE | 291 | 105 | ABSENCE | ABSENCE | ABSENCE | ABSENCE |
| T-2 | ABSENCE | 251 | 33 | ABSENCE | ABSENCE | ABSENCE | ABSENCE |
| U-2 | ABSENCE | 376 | 373 | ABSENCE | ABSENCE | ABSENCE | ABSENCE |
| V-2 | ABSENCE | 176 | 65 | ABSENCE | ABSENCE | ABSENCE | ABSENCE |
| W-2 | ABSENCE | 316 | 563 | PRESENCE | ABSENCE | PRESENCE | ABSENCE |
| X-2 | ABSENCE | 383 | 599 | ABSENCE | ABSENCE | ABSENCE | ABSENCE |
| AL-2 | PRESENCE | 381 | 323 | PRESENCE | ABSENCE | ABSENCE | ABSENCE |
| AM-2 | ABSENCE | 355 | 112 | ABSENCE | ABSENCE | ABSENCE | ABSENCE |
| AN-2 | ABSENCE | 342 | 119 | ABSENCE | ABSENCE | ABSENCE | ABSENCE |
| AO-2 | ABSENCE | 358 | 297 | ABSENCE | ABSENCE | ABSENCE | ABSENCE |
| AP-2 | ABSENCE | 429 | 277 | ABSENCE | ABSENCE | ABSENCE | ABSENCE |
| AQ-2 | ABSENCE | 288 | 233 | ABSENCE | ABSENCE | ABSENCE | ABSENCE |

| | PROPERTIES STRUCTURE OF COLD-ROLLEDSTEEL SHEET | | | |
|---|---|---|---|---|
| MANUFACTURING NO. | AREA RATIO OF POLYGONAL FERRITE (%) | AREA RATIO OF BAINITICFERRITE (%) | AREA RATIO OF RESIDUAL AUSTENITE (%) | AREA RATIO OF MARTENSITE (%) |
| A-2 | 44.0 | 36.6 | 17.5 | 1.9 |
| B-2 | 65.5 | 30.2 | 3.9 | 0.4 |
| C-2 | 55.7 | 32.6 | 10.5 | 1.2 |
| D-2 | 45.7 | 31.7 | 20.3 | 2.3 |
| E-2 | 44.5 | 34.0 | 19.3 | 2.2 |
| F-2 | 55.3 | 31.7 | 11.7 | 1.3 |
| G-2 | 45.9 | 39.0 | 10.6 | 4.5 |
| H-2 | 41.4 | 31.2 | 11.1 | 16.3 |
| I-2 | 53.7 | 31.9 | 12.2 | 2.2 |
| J-2 | 53.5 | 32.4 | 12.7 | 1.4 |
| K-2 | 61.3 | 35.8 | 2.6 | 0.3 |
| L-2 | 46.1 | 31.2 | 20.4 | 2.3 |
| M-2 | 43.0 | 31.7 | 22.8 | 2.5 |
| N-2 | 58.6 | 26.3 | 13.6 | 1.5 |
| O-2 | 50.6 | 38.1 | 10.2 | 1.1 |
| P-2 | 56.0 | 31.0 | 11.7 | 1.3 |
| Q-2 | 56.0 | 31.2 | 11.5 | 1.3 |
| R-2 | 53.1 | 32.8 | 12.7 | 1.4 |
| S-2 | 43.0 | 33.1 | 22.5 | 1.4 |
| T-2 | 56.0 | 31.1 | 11.6 | 1.3 |
| U-2 | 52.3 | 31.2 | 14.8 | 1.7 |

TABLE 3-11-continued

| | | | | |
|---|---|---|---|---|
| V-2 | 43.9 | 31.1 | 22.5 | 2.5 |
| W-2 | 49.5 | 31.6 | 17.0 | 1.9 |
| X-2 | 53.8 | 32.0 | 12.8 | 1.4 |
| AL-2 | 52.4 | 31.1 | 16.1 | 0.4 |
| AM-2 | 52.2 | 34.7 | 11.8 | 1.3 |
| AN-2 | 52.8 | 31.0 | 14.6 | 1.6 |
| AO-2 | 42.3 | 32.3 | 24.0 | 1.4 |
| AP-2 | 44.1 | 31.2 | 22.2 | 2.5 |
| AQ-2 | 51.2 | 37.4 | 10.8 | 0.6 |

UNDERLINES INDICATE THAT VALUES FALL OUTSIDE THE RANGE OF THE PRESENT INVENTION.

TABLE 3-12

| | MANUFACTURING CONDITION | | | | | | |
|---|---|---|---|---|---|---|---|
| | PRESENCE OR ABSENCE | HEAT TREATMENT PROCESS | | PRESENCE OR ABSENCE | PRESENCE | PRESENCE | PRESENCE OR ABSENCE OF HOT |
| MANUFACTURING NO. | OF REHEATING | TEMPERATURE (° C.) | TIME (s) | OF TEMPERING | OR ABSENCE OF COATING | OR ABSENCE OF ALLOYING | ROLLING ANNEALING |
| AR-2 | PRESENCE | 444 | 183 | PRESENCE | ABSENCE | ABSENCE | ABSENCE |
| AS-2 | ABSENCE | 495 | 526 | ABSENCE | PRESENCE | ABSENCE | ABSENCE |
| AT-2 | ABSENCE | 210 | 44 | ABSENCE | ABSENCE | ABSENCE | ABSENCE |
| AU-2 | ABSENCE | 386 | 542 | ABSENCE | ABSENCE | ABSENCE | ABSENCE |
| AV-2 | ABSENCE | 225 | 141 | ABSENCE | ABSENCE | ABSENCE | ABSENCE |
| AW-2 | ABSENcE | 233 | 196 | ABSENCE | ABSENCE | ABSENCE | ABSENCE |
| AX-2 | ABSENCE | 177 | 437 | ABSENCE | ABSENCE | ABSENCE | ABSENCE |
| AY-2 | ABSENCE | 511 | 418 | ABSENCE | ABSENCE | ABSENCE | ABSENCE |
| AZ-2 | ABSENCE | 489 | 410 | PRESENCE | PRESENCE | ABSENCE | ABSENCE |
| BA-2 | ABSENCE | 467 | 428 | ABSENCE | ABSENCE | PRESENCE | ABSENCE |
| BB-2 | PRESENCE | 364 | 95 | ABSENCE | ABSENCE | PRESENCE | ABSENCE |
| BC-2 | ABSENCE | 461 | 475 | ABSENCE | ABSENCE | ABSENCE | ABSENCE |
| BD-2 | ABSENCE | 477 | 408 | ABSENCE | ABSENCE | ABSENCE | ABSENCE |
| BE-2 | ABSENCE | 187 | 71 | PRESENCE | ABSENCE | ABSENCE | ABSENCE |
| BF-2 | ABSENcE | 322 | 230 | ABSENCE | ABSENCE | ABSENCE | ABSENCE |
| BG-2 | ABSENCE | 195 | 73 | ABSENCE | ABSENCE | ABSENCE | ABSENCE |
| BH-2 | ABSENCE | 260 | 304 | ABSENCE | ABSENCE | ABSENCE | ABSENCE |
| BI-2 | PRESENCE | 346 | 376 | PRESENCE | PRESENCE | ABSENCE | ABSENCE |
| A-3 | ABSENCE | 312 | 598 | ABSENCE | ABSENCE | ABSENCE | 610° C. × 20 s |
| B-3 | PRESENCE | 399 | 190 | PRESENCE | ABSENCE | PRESENCE | ABSENCE |
| C-3 | ABSENCE | 230 | 596 | ABSENCE | ABSENCE | ABSENCE | ABSENCE |
| D-3 | ABSENCE | 167 | 474 | ABSENCE | ABSENCE | ABSENCE | ABSENCE |
| E-3 | PRESENCE | 414 | 448 | PRESENCE | ABSENCE | ABSENCE | ABSENCE |
| F-3 | ABSENCE | 334 | 82 | ABSENCE | ABSENCE | ABSENCE | ABSENCE |
| G-3 | ABSENCE | 449 | 294 | ABSENCE | ABSENCE | ABSENCE | ABSENCE |
| H-3 | ABSENCE | 349 | 131 | ABSENCE | ABSENCE | ABSENCE | ABSENCE |
| I-3 | ABSENCE | 439 | 270 | ABSENCE | ABSENCE | ABSENCE | ABSENCE |
| J-3 | ABSENCE | 384 | 534 | ABSENCE | ABSENCE | ABSENCE | ABSENCE |
| K-3 | ABSENCE | 260 | 138 | ABSENCE | ABSENCE | ABSENCE | ABSENCE |
| L-3 | ABSENCE | 405 | 344 | ABSENCE | ABSENCE | PRESENCE | ABSENCE |

| | PROPERTIES STRUCTURE OF COLD-ROLLEDSTEEL SHEET | | | |
|---|---|---|---|---|
| MANUFACTURING NO. | AREA RATIO OF POLYGONAL FERRITE (%) | AREA RATIO OF BAINITICFERRITE (%) | AREA RATIO OF RESIDUAL AUSTENITE (%) | AREA RATIO OF MARTENSITE (%) |
| AR-2 | 53.5 | 33.4 | 11.8 | 1.3 |
| AS-2 | 55.2 | 31.5 | 12.0 | 1.3 |
| AT-2 | 53.7 | 32.6 | 12.6 | 1.1 |
| AU-2 | 54.1 | 31.2 | 13.2 | 1.5 |
| AV-2 | 54.4 | 31.1 | 13.0 | 1.5 |
| AW-2 | 40.5 | 31.2 | 12.7 | 15.6 |
| AX-2 | 49.8 | 31.2 | 17.9 | 1.1 |
| AY-2 | 54.9 | 26.4 | 17.3 | 1.4 |
| AZ-2 | 50.8 | 31.1 | 16.3 | 1.8 |
| BA-2 | 49.1 | 32.2 | 16.8 | 1.9 |
| BB-2 | 51.6 | 32.0 | 14.8 | 1.6 |
| BC-2 | 48.8 | 31.9 | 17.4 | 1.9 |
| BD-2 | 52.3 | 32.0 | 14.1 | 1.6 |
| BE-2 | 51.1 | 31.0 | 16.1 | 1.8 |
| BF-2 | 61.6 | 31.0 | 6.7 | 0.7 |
| BG-2 | 62.4 | 31.2 | 5.8 | 0.6 |

TABLE 3-12-continued

| | | | | |
|---|---|---|---|---|
| BH-2 | 53.9 | 31.0 | 13.6 | 1.5 |
| BI-2 | 52.9 | 31.0 | 14.5 | 1.6 |
| A-3 | 54.6 | 32.8 | 11.9 | 0.7 |
| B-3 | 46.4 | 31.5 | 19.9 | 2.2 |
| C-3 | 34.7 | 32.7 | 30.3 | 2.3 |
| D-3 | 64.7 | 31.8 | 2.8 | 0.7 |
| E-3 | 56.2 | 31.6 | 11.0 | 1.2 |
| F-3 | 52.4 | 31.3 | 14.7 | 1.6 |
| G-3 | 48.2 | 40.2 | 10.5 | 1.1 |
| H-3 | 57.1 | 31.1 | 10.6 | 1.2 |
| I-3 | 55.8 | 32.1 | 10.9 | 1.2 |
| J-3 | 41.4 | 31.4 | 12.0 | 15.2 |
| K-3 | 52.1 | 33.7 | 12.8 | 1.4 |
| L-3 | 44.9 | 31.2 | 21.5 | 2.4 |

UNDERLINES INDICATE THAT VALUES FALL OUTSIDE THE RANGE OF THE PRESENT INVENTION.

TABLE 3-13

| | MANUFACTURING CONDITION | | | | | | |
|---|---|---|---|---|---|---|---|
| | PRESENCE OR ABSENCE | HEAT TREATMENT PROCESS | | PRESENCE OR ABSENCE | PRESENCE | PRESENCE | PRESENCE OR ABSENCE OF HOT |
| MANUFACTURING NO. | OF REHEATING | TEMPERATURE (° C.) | TIME (s) | OF TEMPERING | OR ABSENCE OF COATING | OR ABSENCE OF ALLOYING | ROLLING ANNEALING |
| M-3 | ABSENCE | 391 | 127 | ABSENCE | ABSENCE | ABSENCE | ABSENCE |
| N-3 | ABSENCE | 300 | 423 | ABSENCE | ABSENCE | ABSENCE | ABSENCE |
| O-3 | ABSENCE | 343 | 614 | ABSENCE | ABSENCE | ABSENCE | ABSENCE |
| P-3 | ABSENCE | 344 | 24 | ABSENCE | ABSENCE | ABSENCE | ABSENCE |
| Q-3 | ABSENCE | 498 | 176 | ABSENCE | ABSENCE | ABSENCE | ABSENCE |
| R-3 | PRESENCE | 392 | 457 | ABSENCE | PRESENCE | ABSENCE | ABSENCE |
| S-3 | PRESENCE | 416 | 41 | PRESENCE | ABSENCE | ABSENCE | ABSENCE |
| T-3 | ABSENCE | 420 | 142 | ABSENCE | ABSENCE | ABSENCE | ABSENCE |
| U-3 | ABSENCE | 404 | 171 | PRESENCE | ABSENCE | PRESENCE | ABSENCE |
| V-3 | ABSENCE | 444 | 144 | ABSENCE | ABSENCE | ABSENCE | 450° C. × 9 hr |
| W-3 | ABSENCE | 446 | 110 | ABSENCE | ABSENCE | ABSENCE | ABSENCE |
| X-3 | ABSENCE | 395 | 181 | ABSENCE | ABSENCE | ABSENCE | ABSENCE |
| AL-3 | ABSENCE | 417 | 297 | ABSENCE | ABSENCE | ABSENCE | ABSENCE |
| AM-3 | PRESENCE | 428 | 537 | ABSENCE | ABSENCE | ABSENCE | ABSENCE |
| AN-3 | ABSENCE | 361 | 317 | ABSENCE | ABSENCE | ABSENCE | ABSENCE |
| AO-3 | ABSENCE | 413 | 447 | ABSENCE | ABSENCE | ABSENCE | 640° C. × 90 s |
| AP-3 | ABSENCE | 153 | 73 | PRESENCE | ABSENCE | PRESENCE | ABSENCE |
| AQ-3 | ABSENCE | 455 | 359 | ABSENCE | ABSENCE | PRESENCE | ABSENCE |
| AR-3 | ABSENCE | 499 | 72 | ABSENCE | ABSENCE | ABSENCE | ABSENCE |
| AS-3 | ABSENCE | 494 | 481 | ABSENCE | ABSENCE | ABSENCE | ABSENCE |
| AT-3 | ABSENCE | 156 | 248 | ABSENCE | ABSENCE | ABSENCE | ABSENCE |
| AU-3 | ABSENCE | 208 | 42 | ABSENCE | ABSENCE | ABSENCE | ABSENCE |
| AV-3 | PRESENCE | 396 | 404 | ABSENCE | ABSENCE | ABSENCE | ABSENCE |
| AW-3 | ABSENCE | 297 | 576 | ABSENCE | ABSENCE | ABSENCE | ABSENCE |
| AX-3 | ABSENCE | 314 | 437 | ABSENCE | ABSENCE | ABSENCE | 520° C. × 2 hr |
| AY-3 | PRESENCE | 397 | 587 | PRESENCE | PRESENCE | ABSENCE | ABSENCE |
| AZ-3 | ABSENCE | 263 | 605 | ABSENCE | ABSENCE | ABSENCE | ABSENCE |
| BA-3 | ABSENCE | 192 | 484 | ABSENCE | ABSENCE | ABSENCE | ABSENCE |
| BB-3 | ABSENCE | 476 | 448 | ABSENCE | ABSENCE | ABSENCE | ABSENCE |
| BC-3 | ABSENCE | 479 | 410 | ABSENCE | ABSENCE | ABSENCE | ABSENCE |

| | PROPERTIES STRUCTURE OF COLD-ROLLEDSTEEL SHEET | | | |
|---|---|---|---|---|
| MANUFACTURING NO. | AREA RATIO OF POLYGONAL FERRITE (%) | AREA RATIO OF BAINITICFERRITE (%) | AREA RATIO OF RESIDUAL AUSTENITE (%) | AREA RATIO OF MARTENSITE (%) |
| M-3 | 54.1 | 31.1 | 13.3 | 1.5 |
| N-3 | 52.8 | 33.6 | 12.2 | 1.4 |
| O-3 | 42.1 | 31.4 | 25.1 | 1.4 |
| P-3 | 47.9 | 31.1 | 7.9 | 13.1 |
| Q-3 | 56.5 | 31.2 | 11.1 | 1.2 |
| R-3 | 52.7 | 31.8 | 14.7 | 0.8 |
| S-3 | 52.0 | 34.8 | 11.9 | 1.3 |
| T-3 | 63.8 | 31.1 | 4.6 | 0.5 |
| U-3 | 54.0 | 31.4 | 13.1 | 1.5 |
| V-3 | 55.4 | 31.1 | 12.1 | 1.4 |
| W-3 | 51.5 | 32.7 | 14.2 | 1.6 |

TABLE 3-13-continued

| | | | | |
|---|---|---|---|---|
| X-3 | 51.3 | 32.9 | 14.2 | 1.6 |
| AL-3 | 34.0 | 31.1 | 33.4 | 1.5 |
| AM-3 | 51.6 | 34.3 | 10.4 | 3.7 |
| AN-3 | 52.4 | 31.1 | 14.8 | 1.7 |
| AO-3 | 53.2 | 32.6 | 12.8 | 1.4 |
| AP-3 | 56.6 | 31.0 | 10.6 | 1.8 |
| AQ-3 | 52.5 | 35.3 | 11.0 | 1.2 |
| AR-3 | 51.4 | 37.0 | 10.4 | 1.2 |
| AS-3 | 55.4 | 32.9 | 10.5 | 1.2 |
| AT-3 | 53.0 | 31.4 | 12.6 | 3.0 |
| AU-3 | 58.0 | 28.1 | 12.8 | 1.1 |
| AV-3 | 54.7 | 31.2 | 14.0 | 0.1 |
| AW-3 | 52.8 | 31.4 | 14.2 | 1.6 |
| AX-3 | 48.6 | 31.2 | 18.2 | 2.0 |
| AY-3 | 54.3 | 31.1 | 13.1 | 1.5 |
| AZ-3 | 41.5 | 31.2 | 25.9 | 1.4 |
| BA-3 | 49.9 | 32.0 | 16.6 | 1.5 |
| BB-3 | 54.1 | 33.5 | 11.2 | 1.2 |
| BC-3 | 49.3 | 31.5 | 17.3 | 1.9 |

UNDERLINES INDICATE THAT VALUES FALL OUTSIDE THE RANGE OF THE PRESENT INVENTION.

TABLE 3-14

| | MANUFACTURING CONDITION | | | | | | |
|---|---|---|---|---|---|---|---|
| | PRESENCE OR ABSENCE | HEAT TREATMENT PROCESS | | PRESENCE OR ABSENCE | PRESENCE | PRESENCE | PRESENCE OR ABSENCE OF HOT |
| MANUFACTURING NO. | OF REHEATING | TEMPERATURE (° C.) | TIME (s) | OF TEMPERING | OR ABSENCE OF COATING | OR ABSENCE OF ALLOYING | ROLLING ANNEALING |
| BD-3 | PRESENCE | 424 | 486 | PRESENCE | ABSENCE | PRESENCE | ABSENCE |
| BE-3 | ABSENCE | 167 | 532 | ABSENCE | ABSENCE | ABSENCE | ABSENCE |
| BF-3 | ABSENCE | 447 | 338 | ABSENCE | ABSENCE | ABSENCE | ABSENCE |
| BG-3 | ABSENCE | 228 | 281 | PRESENCE | PRESENCE | ABSENCE | ABSENCE |
| BH-3 | ABSENCE | 164 | 309 | ABSENCE | ABSENCE | ABSENCE | ABSENCE |
| BI-3 | ABSENCE | 339 | 34 | ABSENCE | ABSENCE | ABSENCE | ABSENCE |
| A-4 | ABSENCE | 245 | 347 | ABSENCE | ABSENCE | ABSENCE | ABSENCE |
| B-4 | ABSENCE | 182 | 338 | ABSENCE | ABSENCE | ABSENCE | ABSENCE |
| C-4 | PRESENCE | 353 | 284 | ABSENCE | ABSENCE | PRESENCE | ABSENCE |
| D-4 | ABSENCE | 175 | 364 | ABSENCE | ABSENCE | ABSENCE | ABSENCE |
| E-4 | ABSENCE | 527 | 551 | ABSENCE | ABSENCE | ABSENCE | ABSENCE |
| F-4 | ABSENCE | 165 | 475 | ABSENCE | ABSENCE | ABSENCE | ABSENCE |
| G-4 | ABSENCE | 169 | 599 | ABSENCE | ABSENCE | ABSENCE | ABSENCE |
| H-4 | PRESENCE | 376 | 463 | ABSENCE | ABSENCE | ABSENCE | ABSENCE |
| I-4 | ABSENCE | 448 | 531 | ABSENCE | ABSENCE | ABSENCE | ABSENCE |
| J-4 | ABSENCE | 291 | 148 | ABSENCE | ABSENCE | ABSENCE | ABSENCE |
| K-4 | ABSENCE | 288 | 159 | PRESENCE | ABSENCE | ABSENCE | ABSENCE |
| L-4 | ABSENCE | 279 | 199 | ABSENCE | ABSENCE | ABSENCE | ABSENCE |
| M-4 | ABSENCE | 166 | 484 | PRESENCE | PRESENCE | ABSENCE | ABSENCE |
| N-4 | PRESENCE | 416 | 212 | ABSENCE | PRESENCE | ABSENCE | ABSENCE |
| O-4 | ABSENCE | 387 | 600 | ABSENCE | ABSENCE | ABSENCE | ABSENCE |
| P-4 | ABSENCE | 176 | 78 | ABSENCE | ABSENCE | ABSENCE | ABSENCE |
| Q-4 | ABSENCE | 448 | 148 | PRESENCE | PRESENCE | ABSENCE | ABSENCE |
| R-4 | ABSENCE | 397 | 85 | ABSENCE | ABSENCE | ABSENCE | ABSENCE |
| S-4 | ABSENCE | 276 | 72 | ABSENCE | ABSENCE | ABSENCE | ABSENCE |
| T-4 | ABSENCE | 182 | 427 | ABSENCE | ABSENCE | ABSENCE | ABSENCE |
| U-4 | PRESENCE | 483 | 300 | PRESENCE | ABSENCE | PRESENCE | ABSENCE |
| V-4 | ABSENCE | 259 | 432 | ABSENCE | ABSENCE | ABSENCE | ABSENCE |
| W-4 | ABSENCE | 348 | 270 | ABSENCE | ABSENCE | ABSENCE | ABSENCE |
| X-4 | ABSENCE | 263 | 488 | ABSENCE | ABSENCE | PRESENCE | ABSENCE |

| | PROPERTIES STRUCTURE OF COLD-ROLLEDSTEEL SHEET | | | |
|---|---|---|---|---|
| MANUFACTURING NO. | AREA RATIO OF POLYGONAL FERRITE (%) | AREA RATIO OF BAINITICFERRITE (%) | AREA RATIO OF RESIDUAL AUSTENITE (%) | AREA RATIO OF MARTENSITE (%) |
| BD-3 | 51.9 | 32.4 | 14.1 | 1.6 |
| BE-3 | 51.6 | 31.0 | 15.7 | 1.7 |
| BF-3 | 52.5 | 31.0 | 14.8 | 1.7 |
| BG-3 | 55.9 | 31.4 | 11.4 | 1.3 |
| BH-3 | 53.9 | 31.0 | 13.6 | 1.5 |
| BI-3 | 53.5 | 31.0 | 13.9 | 1.6 |

TABLE 3-14-continued

| | | | | |
|---|---|---|---|---|
| A-4 | 43.4 | 41.6 | 11.7 | 3.3 |
| B-4 | 42.3 | 31.5 | 19.0 | 7.2 |
| C-4 | 44.8 | 37.6 | 14.2 | 3.4 |
| D-4 | 47.4 | 32.0 | 16.0 | 4.6 |
| E-4 | 54.3 | 26.7 | 17.7 | 1.3 |
| F-4 | 52.6 | 31.4 | 11.8 | 4.2 |
| G-4 | 52.1 | 32.5 | 10.9 | 4.5 |
| H-4 | 54.8 | 31.1 | 12.7 | 1.4 |
| I-4 | 38.2 | 31.7 | 28.7 | 1.4 |
| J-4 | 54.4 | 32.9 | 11.4 | 1.3 |
| K-4 | 50.6 | 33.2 | 15.3 | 0.9 |
| L-4 | 47.3 | 31.3 | 19.3 | 2.1 |
| M-4 | 42.6 | 31.3 | 22.5 | 3.6 |
| N-4 | 42.0 | 43.7 | 12.9 | 1.4 |
| O-4 | 44.8 | 43.7 | 10.3 | 1.2 |
| P-4 | 44.4 | 31.1 | 24.4 | 0.1 |
| Q-4 | 52.0 | 31.2 | 15.1 | 1.7 |
| R-4 | 55.3 | 33.2 | 10.3 | 1.2 |
| S-4 | 51.7 | 35.4 | 11.6 | 1.3 |
| T-4 | 55.8 | 31.0 | 12.1 | 1.3 |
| U-4 | 52.5 | 31.3 | 14.6 | 1.6 |
| V-4 | 43.0 | 31.2 | 23.2 | 2.6 |
| W-4 | 50.4 | 31.5 | 16.3 | 1.8 |
| X-4 | 52.2 | 31.7 | 14.5 | 1.6 |

UNDERLINES INDICATE THAT VALUES FALL OUTSIDE THE RANGE OF THE PRESENT INVENTION.

TABLE 3-15

| | MANUFACTURING CONDITION | | | | | | |
|---|---|---|---|---|---|---|---|
| | PRESENCE OR ABSENCE | HEAT TREATMENT PROCESS | | PRESENCE OR ABSENCE | PRESENCE | PRESENCE | PRESENCE OR ABSENCE OF HOT |
| MANUFACTURING NO. | OF REHEATING | TEMPEATURE (° C.) | TIME (s) | OF TEMPERING | OR ABSENCE OF COATING | OR ABSENCE OF ALLOYING | ROLLING ANNEALING |
| AL-4 | ABSENCE | 383 | 533 | ABSENCE | ABSENCE | ABSENCE | ABSENCE |
| AM-4 | ABSENCE | 464 | 308 | PRESENCE | ABSENCE | PRESENCE | ABSENCE |
| AN-4 | ABSENCE | 175 | 331 | ABSENCE | PRESENCE | ABSENCE | ABSENCE |
| AO-4 | ABSENCE | 320 | 446 | ABSENCE | ABSENCE | ABSENCE | ABSENCE |
| AP-4 | PRESENCE | 438 | 584 | ABSENCE | ABSENCE | PRESENCE | ABSENCE |
| AQ-4 | ABSENCE | 139 | 200 | ABSENCE | ABSENCE | ABSENCE | ABSENCE |
| AR-4 | ABSENCE | 228 | 66 | ABSENCE | ABSENCE | ABSENCE | ABSENCE |
| AS-4 | ABSENCE | 252 | 284 | ABSENCE | ABSENCE | ABSENCE | ABSENCE |
| AT-4 | ABSENCE | 296 | 477 | PRESENCE | ABSENCE | ABSENCE | ABSENCE |
| AU-4 | ABSENCE | 483 | 67 | ABSENCE | ABSENCE | ABSENCE | ABSENCE |
| AV-4 | ABSENCE | 309 | 27 | ABSENCE | ABSENCE | ABSENCE | ABSENCE |
| AW-4 | PRESENCE | 413 | 83 | PRESENCE | ABSENCE | PRESENCE | ABSENCE |
| AX-4 | ABSENCE | 413 | 314 | ABSENCE | ABSENCE | ABSENCE | ABSENCE |
| AY-4 | ABSENCE | 441 | 555 | ABSENCE | ABSENCE | ABSENCE | ABSENCE |
| AZ-4 | ABSENCE | 336 | 318 | ABSENCE | ABSENCE | ABSENCE | ABSENCE |
| BA-4 | ABSENCE | 321 | 530 | ABSENCE | ABSENCE | ABSENCE | ABSENCE |
| BB-4 | ABSENCE | 446 | 309 | ABSENCE | ABSENCE | ABSENCE | ABSENCE |
| BC-4 | PRESENCE | 360 | 215 | ABSENCE | PRESENCE | ABSENCE | ABSENCE |
| BD-4 | ABSENCE | 374 | 500 | ABSENCE | ABSENCE | ABSENCE | ABSENCE |
| BE-4 | ABSENCE | 379 | 542 | ABSENCE | ABSENCE | ABSENCE | ABSENCE |
| BF-4 | ABSENCE | 471 | 179 | ABSENCE | ABSENCE | ABSENCE | ABSENCE |
| BG-4 | ABSENCE | 210 | 356 | ABSENCE | ABSENCE | ABSENCE | ABSENCE |
| BH-4 | PRESENCE | 374 | 180 | ABSENCE | PRESENCE | ABSENCE | ABSENCE |
| BI-4 | ABSENCE | 242 | 283 | ABSENCE | ABSENCE | ABSENCE | ABSENCE |

| | PROPERTIES STRUCTURE OF COLD-ROLLEDSTEEL SHEET | | | |
|---|---|---|---|---|
| MANUFACTURING NO. | AREA RATIO OF POLYGONAL FERRITE (%) | AREA RATIO OF BAINITICFERRITE (%) | AREA RATIO OF RESIDUAL AUSTENITE (%) | AREA RATIO OF MARTENSITE (%) |
| AL-4 | 53.3 | 31.1 | 14.0 | 1.6 |
| AM-4 | 51.9 | 36.8 | 10.2 | 1.1 |
| AN-4 | 51.7 | 31.0 | 12.9 | 4.4 |
| AO-4 | 52.3 | 32.6 | 15.0 | 0.1 |
| AP-4 | 46.8 | 31.1 | 19.9 | 2.2 |
| AQ-4 | 40.7 | 33.5 | 10.3 | 15.5 |
| AR-4 | 52.5 | 33.1 | 11.7 | 2.7 |
| AS-4 | 66.4 | 32.3 | 1.2 | 0.1 |

TABLE 3-15-continued

| | | | | |
|---|---|---|---|---|
| AT-4 | 53.3 | 31.6 | 13.6 | 1.5 |
| AU-4 | 52.1 | 31.2 | 15.0 | 1.7 |
| AV-4 | 53.3 | 31.1 | 7.4 | 8.2 |
| AW-4 | 51.8 | 31.8 | 15.4 | 1.0 |
| AX-4 | 48.1 | 31.1 | 18.7 | 2.1 |
| AY-4 | 53.5 | 31.1 | 13.9 | 1.5 |
| AZ-4 | 50.9 | 31.0 | 18.3 | 1.8 |
| BA-4 | 51.1 | 31.7 | 15.5 | 1.7 |
| BB-4 | 53.4 | 33.8 | 11.5 | 1.3 |
| BC-4 | 49.5 | 31.6 | 17.0 | 1.9 |
| BD-4 | 53.0 | 34.5 | 11.2 | 1.3 |
| BE-4 | 51.3 | 31.0 | 15.9 | 1.8 |
| BF-4 | 50.5 | 31.0 | 16.6 | 1.9 |
| BG-4 | 52.4 | 31.2 | 14.8 | 1.6 |
| BH-4 | 54.1 | 31.0 | 13.4 | 1.5 |
| BI-4 | 62.7 | 31.0 | 5.7 | 0.6 |

UNDERLINES INDICATE THAT VALUES FALL OUTSIDE THE RANGE OF THE PRESENT INVENTION.

TABLE 3-16

| MANUFACTURING NO. | PROPERTIES: STRUCTURE OF COLD-ROLLED STEEL SHEET (A) (%) | (B) (%) | (C) | STRUCTURE OF HOT-ROLLED STEEL SHEET (D) (%) | (E) | MECHANICAL PROPERTIES: 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
|---|---|---|---|---|---|---|---|---|---|---|---|
| A-2 | 83.7 | 82.5 | 0.68 | 81.5 | 0.39 | 775.2 | 1020.1 | 22.0 | 32.9 | 2.2E+05 | EXAMPLE OF INVENTION |
| B-2 | 81.8 | 81.5 | 0.43 | 85.7 | 0.34 | 694.1 | 1076.1 | 21.1 | 23.1 | 1.5E+06 | COMPARATIVE EXAMPLE |
| C-2 | 95.6 | 81.3 | 0.19 | 83.5 | 0.13 | 664.0 | 1032.7 | 22.6 | 63.0 | 1.8E+06 | EXAMPLE OF INVENTION |
| D-2 | 89.4 | 82.4 | 0.09 | 85.0 | 0.09 | 759.6 | 1022.3 | 23.3 | 72.3 | 3.3E+06 | EXAMPLE OF INVENTION |
| E-2 | 90.6 | 89.7 | 0.30 | 81.5 | 0.21 | 826.1 | 1094.2 | 22.2 | 56.7 | 1.6E+06 | EXAMPLE OF INVENTION |
| F-2 | 81.7 | 89.5 | 0.25 | 86.0 | 0.23 | 791.6 | 1223.5 | 21.5 | 65.8 | 1.7E+06 | EXAMPLE OF INVENTION |
| G-2 | 98.3 | 87.3 | 0.36 | 92.8 | 0.26 | 795.4 | 1073.4 | 23.3 | 53.4 | 1.7E+06 | EXAMPLE OF INVENTION |
| H-2 | 90.6 | 87.6 | 0.21 | 92.0 | 0.18 | 759.9 | 1187.4 | 21.6 | 17.5 | 1.7E+06 | COMPARATIVE EXAMPLE |
| I-2 | 92.6 | 85.2 | 0.24 | 88.4 | 0.19 | 724.5 | 1092.8 | 23.6 | 65.3 | 1.6E+06 | EXAMPLE OF INVENTION |
| J-2 | 98.2 | 89.7 | 0.55 | 91.0 | 0.39 | 799.5 | 1202.3 | 21.9 | 48.3 | 8.9E+05 | EXAMPLE OF INVENTION |
| K-2 | 71.0 | 81.3 | 0.28 | 85.4 | 0.22 | 788.1 | 1147.1 | 23.0 | 23.3 | 1.6E+06 | COMPARATIVE EXAMPLE |
| L-2 | 89.3 | 82.2 | 0.09 | 90.5 | 0.10 | 858.0 | 1161.0 | 20.1 | 28.1 | 3.3E+06 | COMPARATIVE EXAMPLE |
| M-2 | 88.9 | 93.6 | 0.72 | 93.0 | 0.48 | 895.9 | 1163.5 | 23.4 | 18.1 | 9.4E+04 | COMPARATIVE EXAMPLE |
| N-2 | 71.0 | 73.1 | 0.17 | 92.9 | 0.15 | 548.0 | 1035.6 | 26.2 | 25.1 | 8.4E+04 | COMPARATIVE EXAMPLE |
| O-2 | 98.3 | 85.6 | 0.22 | 84.4 | 0.21 | 713.4 | 1028.0 | 27.1 | 72.4 | 1.8E+06 | EXAMPLE OF INVENTION |
| P-2 | 89.1 | 88.8 | 0.24 | 92.8 | 0.16 | 684.6 | 1069.7 | 26.9 | 72.9 | 1.6E+06 | EXAMPLE OF INVENTION |
| Q-2 | 85.3 | 81.6 | 0.24 | 87.2 | 0.18 | 745.4 | 1164.7 | 25.4 | 14.9 | 1.7E+06 | COMPARATIVE EXAMPLE |
| R-2 | 96.7 | 89.7 | 0.44 | 87.1 | 0.32 | 721.7 | 1078.8 | 17.5 | 55.4 | 1.4E+06 | COMPARATIVE EXAMPLE |
| S-2 | 85.6 | 93.3 | 0.28 | 92.2 | 0.26 | 712.9 | 1064.0 | 30.1 | 104.8 | 1.7E+06 | EXAMPLE OF INVENTION |
| T-2 | 95.5 | 82.2 | 0.19 | 92.6 | 0.19 | 769.7 | 1202.7 | 25.3 | 22.2 | 1.8E+06 | COMPARATIVE EXAMPLE |
| U-2 | 98.5 | 87.0 | 0.16 | 90.7 | 0.09 | 779.0 | 1150.7 | 26.6 | 85.7 | 2.1E+06 | EXAMPLE OF INVENTION |
| V-2 | 86.7 | 83.7 | 0.41 | 91.8 | 0.33 | 924.4 | 1214.7 | 25.7 | 61.4 | 1.8E+06 | EXAMPLE OF INVENTION |
| W-2 | 82.7 | 84.1 | 0.17 | 86.1 | 0.16 | 879.1 | 1247.0 | 25.3 | 87.3 | 1.9E+06 | EXAMPLE OF INVENTION |
| X-2 | 85.7 | 83.1 | 0.58 | 74.8 | 0.38 | 584.5 | 1074.8 | 29.6 | 45.1 | 6.1E+04 | COMPARATIVE EXAMPLE |
| AL-2 | 85.5 | 91.2 | 0.24 | 88.2 | 0.22 | 873.7 | 1292.4 | 22.7 | 74.3 | 1.7E+06 | EXAMPLE OF INVENTION |
| AM-2 | 85.4 | 83.2 | 0.30 | 84.8 | 0.23 | 708.6 | 1045.1 | 21.5 | 52.4 | 1.5E+06 | EXAMPLE OF INVENTION |
| AN-2 | 85.2 | 86.3 | 0.38 | 83.6 | 0.27 | 816.3 | 1214.8 | 22.9 | 17.5 | 1.6E+06 | COMPARATIVE EXAMPLE |
| AO-2 | 84.5 | 81.4 | 0.27 | 89.6 | 0.20 | 700.7 | 1035.0 | 32.0 | 105.4 | 1.7E+06 | EXAMPLE OF INVENTION |
| AP-2 | 92.0 | 86.5 | 0.57 | 91.6 | 0.36 | 853.9 | 1125.0 | 21.0 | 41.7 | 8.0E+05 | EXAMPLE OF INVENTION |
| AQ-2 | 82.8 | 87.2 | 0.30 | 92.2 | 0.24 | 675.3 | 981.6 | 24.0 | 55.0 | 1.7E+06 | EXAMPLE OF INVENTION |

UNDERLINES INDICATE THAT VALUES FALL OUTSIDE THE RANGE OF THE PRESENT INVENTION.

TABLE 3-17

| MANUFACTURING NO. | PROPERTIES: STRUCTURE OF COLD-ROLLED STEEL SHEET (A) (%) | (B) (%) | (C) | STRUCTURE OF HOT-ROLLED STEEL SHEET (D) (%) | (E) | MECHANICAL PROPERTIES: 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
|---|---|---|---|---|---|---|---|---|---|---|---|
| AR-2 | 88.5 | 86.9 | 0.51 | 92.2 | 0.33 | 663.5 | 997.8 | 24.0 | 48.7 | 9.6E+05 | EXAMPLE OF INVENTION |
| AS-2 | 82.1 | 87.8 | 0.06 | 85.8 | 0.03 | 637.1 | 983.2 | 24.7 | 76.1 | 4.4E+06 | EXAMPLE OF INVENTION |
| AT-2 | 92.9 | 90.9 | 0.37 | 83.4 | 0.26 | 679.6 | 1025.1 | 24.4 | 52.5 | 1.6E+06 | EXAMPLE OF INVENTION |
| AU-2 | 93.5 | 82.3 | 0.36 | 90.1 | 0.28 | 838.6 | 1272.6 | 21.1 | 27.3 | 1.6E+06 | COMPARATIVE EXAMPLE |
| AV-2 | 87.6 | 93.0 | 0.12 | 81.1 | 0.06 | 826.7 | 1260.2 | 21.1 | 78.0 | 2.6E+06 | EXAMPLE OF INVENTION |
| AW-2 | 89.9 | 87.5 | 0.25 | 83.7 | 0.22 | 717.2 | 1032.0 | 26.6 | 16.8 | 1.6E+06 | COMPARATIVE EXAMPLE |
| AX-2 | 90.3 | 82.2 | 0.36 | 89.2 | 0.31 | 875.0 | 1246.4 | 19.5 | 59.8 | 1.6E+06 | COMPARATIVE EXAMPLE |
| AY-2 | 84.3 | 83.0 | 0.72 | 86.3 | 0.06 | 571.4 | 1185.0 | 23.8 | 26.5 | 3.7E+04 | COMPARATIVE EXAMPLE |
| AZ-2 | 90.7 | 93.1 | 0.30 | 88.2 | 0.23 | 834.5 | 1205.9 | 23.5 | 66.1 | 1.6E+06 | EXAMPLE OF INVENTION |
| BA-2 | 91.0 | 81.9 | 0.44 | 91.5 | 0.36 | 893.2 | 1259.8 | 23.0 | 54.1 | 1.4E+06 | EXAMPLE OF INVENTION |
| BB-2 | 89.5 | 88.1 | 0.20 | 91.4 | 0.14 | 744.4 | 1088.3 | 26.5 | 76.9 | 1.8E+06 | EXAMPLE OF INVENTION |
| BC-2 | 82.0 | 81.1 | 0.09 | 87.5 | 0.10 | 816.5 | 1146.7 | 25.5 | 88.7 | 3.5E+06 | EXAMPLE OF INVENTION |
| BD-2 | 97.8 | 90.4 | 0.17 | 82.4 | 0.16 | 710.4 | 1049.4 | 20.2 | 28.9 | 1.9E+06 | COMPARATIVE EXAMPLE |
| BE-2 | 98.0 | 82.6 | 0.40 | 82.5 | 0.32 | 853.6 | 1238.9 | 25.2 | 62.4 | 1.6E+06 | EXAMPLE OF INVENTION |
| BF-2 | 87.3 | 86.6 | 0.39 | 88.7 | 0.30 | 863.2 | 1243.8 | 25.2 | 23.7 | 1.6E+06 | COMPARATIVE EXAMPLE |
| BG-2 | 83.7 | 91.6 | 0.09 | 88.1 | 0.11 | 718.6 | 1063.0 | 29.4 | 24.8 | 3.4E+06 | COMPARATIVE EXAMPLE |
| BH-2 | 91.8 | 89.7 | 0.30 | 83.6 | 0.27 | 796.3 | 1204.7 | 26.3 | 73.9 | 1.6E+06 | EXAMPLE OF INVENTION |
| BI-2 | 86.5 | 85.1 | 0.07 | 89.9 | 0.04 | 840.8 | 1253.1 | 25.8 | 66.3 | 4.0E+06 | EXAMPLE OF INVENTION |
| A-3 | 94.7 | 81.8 | 0.54 | 82.5 | 0.34 | 648.8 | 992.0 | 22.6 | 49.3 | 9.4E+05 | EXAMPLE OF INVENTION |
| B-3 | 82.4 | 92.3 | 0.32 | 82.1 | 0.28 | 822.6 | 1117.7 | 24.3 | 61.6 | 1.7E+06 | EXAMPLE OF INVENTION |
| C-3 | 89.7 | 81.7 | 0.33 | 92.4 | 0.25 | 703.0 | 1076.5 | 17.8 | 52.4 | 1.7E+06 | COMPARATIVE EXAMPLE |
| D-3 | 95.6 | 87.3 | 0.27 | 92.0 | 0.19 | 692.8 | 1077.5 | 22.2 | 25.2 | 1.6E+06 | COMPARATIVE EXAMPLE |
| E-3 | 96.2 | 84.1 | 0.35 | 84.7 | 0.28 | 671.0 | 1051.8 | 23.1 | 52.6 | 1.6E+06 | EXAMPLE OF INVENTION |
| F-3 | 87.1 | 91.5 | 0.30 | 84.9 | 0.23 | 836.8 | 1237.8 | 20.3 | 26.4 | 1.7E+05 | COMPARATIVE EXAMPLE |
| G-3 | 81.9 | 88.9 | 0.35 | 92.9 | 0.31 | 792.8 | 1104.2 | 22.7 | 54.3 | 1.6E+06 | EXAMPLE OF INVENTION |
| H-3 | 96.0 | 93.3 | 0.16 | 85.7 | 0.10 | 742.8 | 1181.0 | 21.7 | 71.8 | 2.1E+06 | EXAMPLE OF INVENTION |
| I-3 | 90.8 | 86.9 | 0.38 | 90.7 | 0.31 | 694.3 | 1081.4 | 23.8 | 53.2 | 1.5E+06 | EXAMPLE OF INVENTION |
| J-3 | 94.8 | 83.3 | 0.36 | 84.0 | 0.27 | 801.9 | 1204.0 | 21.9 | 16.3 | 1.7E+06 | COMPARATIVE EXAMPLE |
| K-3 | 95.6 | 92.8 | 0.82 | 88.6 | 0.39 | 774.1 | 1140.0 | 23.1 | 35.6 | 5.1E+05 | EXAMPLE OF INVENTION |
| L-3 | 92.4 | 84.5 | 0.20 | 84.7 | 0.20 | 876.9 | 1167.7 | 23.2 | 72.2 | 1.7E+06 | EXAMPLE OF INVENTION |

UNDERLINES INDICATE THAT VALUES FALL OUTSIDE THE RANGE OF THE PRESENT INVENTION.

TABLE 3-18

| MANUFACTURING NO. | PROPERTIES: STRUCTURE OF COLD-ROLLED STEEL SHEET (A) (%) | (B) (%) | (C) | STRUCTURE OF HOT-ROLLED STEEL SHEET (D) (%) | (E) | MECHANICAL PROPERTIES: 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
|---|---|---|---|---|---|---|---|---|---|---|---|
| M-3 | 85.4 | 83.7 | 0.18 | 88.4 | 0.11 | 725.7 | 1101.2 | 24.6 | 74.0 | 1.9E+06 | EXAMPLE OF INVENTION |
| N-3 | 88.1 | 88.9 | 0.25 | 93.3 | 0.22 | 695.8 | 1035.4 | 26.2 | 67.8 | 1.7E+06 | EXAMPLE OF INVENTION |
| O-3 | 89.6 | 89.5 | 0.12 | 93.5 | 0.10 | 569.8 | 1070.7 | 26.1 | 82.0 | 6.0E+04 | COMPARATIVE EXAMPLE |
| P-3 | 93.6 | 90.8 | 0.34 | 89.0 | 0.27 | 815.2 | 1130.6 | 25.6 | 26.7 | 1.6E+06 | COMPARATIVE EXAMPLE |
| Q-3 | 86.4 | 91.3 | 0.46 | 92.9 | 0.40 | 737.4 | 1161.2 | 25.5 | 53.3 | 1.3E+06 | EXAMPLE OF INVENTION |
| R-3 | 82.4 | 92.0 | 0.40 | 90.5 | 0.35 | 732.2 | 1087.9 | 27.3 | 59.4 | 1.6E+06 | EXAMPLE OF INVENTION |
| S-3 | 83.0 | 90.0 | 0.25 | 85.2 | 0.21 | 720.5 | 1059.5 | 28.2 | 74.7 | 1.7E+06 | EXAMPLE OF INVENTION |
| T-3 | 83.7 | 83.3 | 0.42 | 88.3 | 0.34 | 799.3 | 1207.4 | 25.2 | 21.8 | 1.5E+06 | COMPARATIVE EXAMPLE |
| U-3 | 86.6 | 82.8 | 0.12 | 92.4 | 0.06 | 751.0 | 1137.9 | 26.9 | 89.8 | 2.7E+06 | EXAMPLE OF INVENTION |
| V-3 | 86.4 | 83.3 | 0.37 | 92.7 | 0.29 | 726.1 | 1124.0 | 27.6 | 65.1 | 1.6E+06 | EXAMPLE OF INVENTION |
| W-3 | 98.8 | 81.4 | 0.79 | 71.1 | 0.48 | 541.9 | 1229.0 | 25.6 | 12.4 | 1.8E+04 | COMPARATIVE EXAMPLE |
| X-3 | 86.1 | 89.7 | 0.40 | 84.4 | 0.30 | 745.3 | 1084.9 | 29.4 | 63.8 | 1.5E+06 | EXAMPLE OF INVENTION |
| AL-3 | 81.9 | 90.9 | 0.28 | 81.7 | 0.25 | 847.6 | 1284.2 | 17.8 | 67.2 | 1.6E+06 | COMPARATIVE EXAMPLE |
| AM-3 | 92.2 | 91.7 | 0.10 | 92.7 | 0.07 | 676.0 | 988.3 | 22.6 | 67.0 | 3.0E+06 | EXAMPLE OF INVENTION |
| AN-3 | 87.7 | 85.0 | 0.20 | 93.5 | 0.14 | 822.2 | 1216.3 | 21.7 | 70.4 | 1.7E+06 | EXAMPLE OF INVENTION |
| AO-3 | 86.8 | 88.7 | 0.55 | 91.3 | 0.35 | 690.2 | 1033.3 | 22.0 | 49.3 | 8.9E+05 | EXAMPLE OF INVENTION |
| AP-3 | 91.9 | 83.0 | 0.52 | 92.9 | 0.34 | 865.0 | 1048.9 | 22.4 | 47.0 | 9.1E+05 | EXAMPLE OF INVENTION |
| AQ-3 | 94.8 | 88.5 | 0.15 | 87.4 | 0.09 | 661.5 | 980.0 | 24.0 | 66.6 | 2.1E+06 | EXAMPLE OF INVENTION |

TABLE 3-18-continued

| MANUFACTURING NO. | PROPERTIES: STRUCTURE OF COLD-ROLLED STEEL SHEET (A) (%) | (B) (%) | (C) | STRUCTURE OF HOT-ROLLED STEEL SHEET (D) (%) | (E) | MECHANICAL PROPERTIES: 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
|---|---|---|---|---|---|---|---|---|---|---|---|
| AR-3 | 89.3 | 91.0 | 0.08 | 88.9 | 0.03 | 676.1 | 985.6 | 24.3 | 73.4 | 3.6E+06 | REFERENCE EXAMPLET |
| AS-3 | 87.4 | 86.6 | 0.32 | 91.8 | 0.29 | 636.6 | 985.4 | 24.7 | 55.2 | 1.7E+06 | EXAMPLE OF INVENTION |
| AT-3 | 85.6 | 84.1 | 0.86 | 85.6 | 0.56 | 693.4 | 1034.9 | 24.2 | 11.5 | 3.7E+04 | COMPARATIVE EXAMPLE |
| AU-3 | 74.4 | 77.3 | 0.23 | 87.8 | 0.21 | 583.9 | 1267.6 | 21.1 | 28.6 | 5.9E+04 | COMPARATIVE EXAMPLE |
| AV-3 | 83.0 | 89.5 | 0.13 | 92.1 | 0.09 | 821.2 | 1257.6 | 21.1 | 77.0 | 2.5E+06 | EXAMPLE OF INVENTION |
| AW-3 | 88.8 | 88.1 | 0.36 | 81.2 | 0.30 | 682.9 | 1016.2 | 27.0 | 58.5 | 1.7E+06 | EXAMPLE OF INVENTION |
| AX-3 | 92.6 | 87.9 | 0.30 | 85.0 | 0.25 | 895.0 | 1253.5 | 22.3 | 65.2 | 1.7E+06 | EXAMPLE OF INVENTION |
| AY-3 | 97.8 | 83.1 | 0.43 | 83.8 | 0.36 | 781.2 | 1189.0 | 23.7 | 53.5 | 1.4E+06 | EXAMPLE OF INVENTION |
| AZ-3 | 96.8 | 86.3 | 0.15 | 89.7 | 0.13 | 571.3 | 1177.6 | 24.0 | 80.1 | 7.3E+04 | COMPARATIVE EXAMPLE |
| BA-3 | 87.6 | 81.5 | 0.23 | 86.7 | 0.22 | 881.1 | 1256.9 | 23.1 | 74.5 | 1.7E+06 | EXAMPLE OF INVENTION |
| BB-3 | 87.0 | 92.5 | 0.42 | 85.0 | 0.30 | 703.1 | 1066.9 | 27.0 | 55.7 | 1.5E+06 | EXAMPLE OF INVENTION |
| BC-3 | 94.9 | 84.1 | 0.76 | 90.3 | 0.45 | 810.5 | 1146.4 | 25.5 | 19.9 | 5.7E+04 | COMPARATIVE EXAMPLE |

UNDERLINES INDICATE THAT VALUES FALL OUTSIDE THE RANGE OF THE PRESENT INVENTION.

TABLE 3-19

| MANUFACTURING NO. | PROPERTIES: STRUCTURE OF COLD-ROLLED STEEL SHEET (A) (%) | (B) (%) | (C) | STRUCTURE OF HOT-ROLLED STEEL SHEET (D) (%) | (E) | MECHANICAL PROPERTIES: 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
|---|---|---|---|---|---|---|---|---|---|---|---|
| BD-3 | 93.5 | 88.6 | 0.14 | 86.1 | 0.15 | 714.4 | 1049.1 | 28.2 | 84.8 | 2.2E+06 | EXAMPLE OF INVENTION |
| BE-3 | 94.4 | 81.7 | 0.73 | 78.1 | 0.47 | 544.0 | 1233.9 | 25.3 | 13.5 | 3.0E+04 | COMPARATIVE EXAMPLE |
| BF-3 | 90.6 | 92.8 | 0.31 | 87.7 | 0.25 | 827.1 | 1225.4 | 25.5 | 71.9 | 1.6E+06 | EXAMPLE OF INVENTION |
| BG-3 | 95.4 | 92.3 | 0.16 | 92.2 | 0.11 | 661.4 | 1031.9 | 29.3 | 84.7 | 2.0E+06 | EXAMPLE OF INVENTION |
| BH-3 | 88.1 | 93.3 | 0.11 | 81.2 | 0.11 | 796.3 | 1204.7 | 20.3 | 24.0 | 2.8E+06 | COMPARATIVE EXAMPLE |
| BI-3 | 98.9 | 91.5 | 0.46 | 91.0 | 0.35 | 829.1 | 1246.7 | 25.9 | 58.1 | 1.3E+06 | EXAMPLE OF INVENTION |
| A-4 | 85.9 | 93.9 | 0.18 | 89.5 | 0.14 | 775.7 | 1012.7 | 22.2 | 61.5 | 1.8E+06 | EXAMPLE OF INVENTION |
| B-4 | 88.1 | 82.6 | 0.34 | 81.5 | 0.30 | 881.5 | 1134.5 | 21.4 | 53.4 | 1.7E+06 | EXAMPLE OF INVENTION |
| C-4 | 93.0 | 93.7 | 0.15 | 90.7 | 0.12 | 752.6 | 1000.8 | 23.3 | 66.1 | 2.2E+06 | EXAMPLE OF INVENTION |
| D-4 | 88.0 | 82.2 | 0.16 | 89.5 | 0.13 | 735.1 | 1013.3 | 23.5 | 66.7 | 2.1E+06 | EXAMPLE OF INVENTION |
| E-4 | 90.3 | 90.9 | 0.77 | 90.4 | 0.31 | 580.7 | 1066.5 | 22.8 | 27.9 | 3.0E+04 | COMPARATIVE EXAMPLE |
| F-4 | 98.5 | 90.4 | 0.14 | 90.8 | 0.12 | 833.5 | 1236.6 | 22.1 | 78.3 | 2.2E+06 | EXAMPLE OF INVENTION |
| G-4 | 82.1 | 91.3 | 0.81 | 93.0 | 0.57 | 714.7 | 1052.6 | 23.7 | 15.7 | 2.8E+04 | COMPARATIVE EXAMPLE |
| H-4 | 92.2 | 93.1 | 0.36 | 84.2 | 0.31 | 779.4 | 1195.4 | 21.4 | 54.6 | 1.7E+06 | EXAMPLE OF INVENTION |
| I-4 | 87.2 | 92.7 | 0.08 | 87.6 | 0.04 | 718.0 | 1091.2 | 19.7 | 79.0 | 3.8E+06 | COMPARATIVE EXAMPLE |
| J-4 | 94.5 | 86.7 | 0.53 | 85.3 | 0.35 | 784.3 | 1195.6 | 22.0 | 47.3 | 9.0E+05 | EXAMPLE OF INVENTION |
| K-4 | 88.2 | 82.2 | 0.09 | 87.2 | 0.06 | 795.9 | 1146.8 | 23.0 | 80.0 | 3.5E+06 | EXAMPLE OF INVENTION |
| L-4 | 88.1 | 89.4 | 0.10 | 92.0 | 0.06 | 838.7 | 1153.6 | 23.4 | 81.0 | 3.0E+06 | EXAMPLE OF INVENTION |
| M-4 | 81.8 | 88.0 | 0.26 | 86.6 | 0.23 | 903.9 | 1167.8 | 23.3 | 67.1 | 1.7E+06 | EXAMPLE OF INVENTION |
| N-4 | 89.8 | 82.8 | 0.41 | 89.1 | 0.36 | 775.3 | 994.0 | 27.3 | 53.4 | 1.5E+06 | EXAMPLE OF INVENTION |
| O-4 | 84.3 | 93.6 | 0.27 | 91.9 | 0.22 | 755.8 | 1005.0 | 27.6 | 67.5 | 1.6E+06 | EXAMPLE OF INVENTION |
| P-4 | 95.6 | 90.7 | 0.15 | 88.5 | 0.11 | 872.3 | 1153.9 | 25.1 | 82.1 | 2.2E+06 | REFERENCE EXAMPLET |
| Q-4 | 92.7 | 82.1 | 0.14 | 84.8 | 0.09 | 809.4 | 1190.3 | 24.9 | 85.0 | 2.3E+06 | EXAMPLE OF INVENTION |
| R-4 | 93.0 | 91.7 | 0.43 | 83.0 | 0.31 | 686.9 | 1061.6 | 27.9 | 56.3 | 1.4E+06 | EXAMPLE OF INVENTION |
| S-4 | 88.1 | 86.5 | 0.41 | 85.8 | 0.30 | 722.4 | 1057.7 | 28.3 | 58.9 | 1.5E+06 | EXAMPLE OF INVENTION |
| T-4 | 98.4 | 82.3 | 0.33 | 86.8 | 0.28 | 768.6 | 1193.5 | 25.4 | 67.7 | 1.6E+06 | EXAMPLE OF INVENTION |
| U-4 | 93.9 | 93.0 | 0.17 | 86.9 | 0.17 | 775.4 | 1148.7 | 26.6 | 84.5 | 2.0E+06 | EXAMPLE OF INVENTION |
| V-4 | 84.1 | 92.1 | 0.15 | 86.1 | 0.12 | 939.3 | 1219.9 | 25.6 | 88.5 | 2.2E+06 | REFERENCE EXAMPLET |
| W-4 | 97.2 | 89.8 | 0.11 | 85.2 | 0.12 | 865.1 | 1243.0 | 25.4 | 93.7 | 2.9E+06 | EXAMPLE OF INVENTION |
| X-4 | 94.0 | 87.3 | 0.34 | 93.9 | 0.30 | 737.9 | 1088.3 | 29.3 | 70.2 | 1.6E+06 | EXAMPLE OF INVENTION |

UNDERLINES INDICATE THAT VALUES FALL OUTSIDE THE RANGE OF THE PRESENT INVENTION.

TABLE 3-20

| MANUFACTURING NO. | PROPERTIES: STRUCTURE OF COLD-ROLLED STEEL SHEET (A) (%) | (B) (%) | (C) | STRUCTURE OF HOT-ROLLED STEEL SHEET (D) (%) | (E) | MECHANICAL PROPERTIES: 0.2% PROOF STRESS (MPa) | TENSILE STRENGTH (MPa) | TOTAL ELONGATION (%) | HOLE EXPANSION (%) | PUNCHING FATIGUE NUMBER OF TIMES | REFERENCE |
|---|---|---|---|---|---|---|---|---|---|---|---|
| AL-4 | 93.9 | 86.7 | 0.38 | 92.6 | 0.27 | 859.0 | 1287.8 | 21.8 | 58.0 | 1.7E+06 | EXAMPLE OF INVENTION |
| AM-4 | 96.9 | 89.1 | 0.52 | 85.6 | 0.34 | 712.8 | 1046.7 | 21.5 | 43.5 | 9.7E+05 | EXAMPLE OF INVENTION |
| AN-4 | 88.0 | 84.9 | 0.57 | 90.5 | 0.36 | 833.2 | 1219.9 | 21.8 | 47.0 | 7.9E+05 | EXAMPLE OF INVENTION |
| AO-4 | 97.3 | 84.0 | 0.54 | 89.3 | 0.39 | 702.0 | 1037.0 | 22.0 | 42.6 | 9.0E+05 | EXAMPLE OF INVENTION |
| AP-4 | 89.5 | 90.6 | 0.51 | 93.8 | 0.33 | 812.4 | 1109.8 | 21.2 | 46.3 | 9.6E+05 | EXAMPLE OF INVENTION |
| AQ-4 | 84.9 | 91.1 | 0.08 | 81.1 | 0.07 | 681.5 | 983.4 | 23.9 | 12.7 | 3.9E+06 | COMPARATIVE EXAMPLE |
| AR-4 | 85.0 | 81.3 | 0.59 | 85.0 | 0.36 | 680.1 | 1007.6 | 23.8 | 44.0 | 6.2E+05 | EXAMPLE OF INVENTION |
| AS-4 | 95.5 | 83.0 | 0.30 | 89.4 | 0.23 | 656.9 | 1032.9 | 23.6 | 26.9 | 1.7E+06 | COMPARATIVE EXAMPLE |
| AT-4 | 83.7 | 88.6 | 0.18 | 88.2 | 0.13 | 688.5 | 1032.3 | 24.3 | 68.6 | 1.9E+06 | EXAMPLE OF INVENTION |
| AU-4 | 98.0 | 85.5 | 0.26 | 92.6 | 0.20 | 871.4 | 1283.3 | 22.0 | 69.6 | 1.7E+06 | EXAMPLE OF INVENTION |
| AV-4 | 84.3 | 84.4 | 0.27 | 90.0 | 0.24 | 845.2 | 1267.2 | 21.0 | 24.8 | 1.6E+06 | COMPARATIVE EXAMPLE |
| AW-4 | 88.1 | 90.2 | 0.29 | 93.1 | 0.25 | 695.6 | 1020.0 | 26.9 | 64.9 | 1.6E+06 | EXAMPLE OF INVENTION |
| AX-4 | 85.0 | 91.9 | 0.18 | 84.8 | 0.17 | 903.9 | 1257.1 | 22.3 | 76.6 | 1.9E+06 | EXAMPLE OF INVENTION |
| AY-4 | 87.5 | 87.9 | 0.35 | 83.2 | 0.26 | 794.1 | 1194.1 | 23.6 | 61.1 | 1.7E+06 | EXAMPLE OF INVENTION |
| AZ-4 | 98.0 | 93.6 | 0.31 | 92.0 | 0.22 | 833.3 | 1205.9 | 23.5 | 65.2 | 1.7E+06 | EXAMPLE OF INVENTION |
| BA-4 | 89.4 | 84.4 | 0.16 | 72.7 | 0.10 | 562.9 | 1252.4 | 23.2 | 81.4 | 6.5E+04 | COMPARATIVE EXAMPLE |
| BB-4 | 84.3 | 83.3 | 0.17 | 89.3 | 0.10 | 712.0 | 1069.1 | 16.9 | 79.6 | 2.0E+06 | COMPARATIVE EXAMPLE |
| BC-4 | 88.9 | 89.5 | 0.44 | 84.0 | 0.35 | 806.9 | 1144.6 | 25.5 | 54.5 | 1.4E+06 | EXAMPLE OF INVENTION |
| BD-4 | 90.6 | 85.2 | 0.21 | 83.0 | 0.16 | 689.2 | 1028.6 | 28.7 | 77.7 | 1.7E+06 | EXAMPLE OF INVENTION |
| BE-4 | 83.4 | 91.6 | 0.47 | 94.0 | 0.35 | 849.8 | 1236.9 | 25.3 | 55.3 | 1.4E+06 | EXAMPLE OF INVENTION |
| BF-4 | 81.9 | 85.9 | 0.67 | 87.8 | 0.39 | 865.1 | 1244.7 | 25.2 | 33.3 | 2.6E+05 | REFERENCE EXAMPLET |
| BG-4 | 82.9 | 86.0 | 0.11 | 87.6 | 0.05 | 718.6 | 1063.0 | 29.4 | 92.7 | 2.9E+06 | EXAMPLE OF INVENTION |
| BH-4 | 95.0 | 86.0 | 0.12 | 89.9 | 0.07 | 792.5 | 1202.6 | 26.3 | 92.8 | 2.6E+06 | EXAMPLE OF INVENTION |
| BI-4 | 77.5 | 82.5 | 0.06 | 88.1 | 0.08 | 864.4 | 1265.6 | 25.6 | 21.8 | 4.4E+06 | COMPARATIVE EXAMPLE |

UNDERLINES INDICATE THAT VALUES FALL OUTSIDE THE RANGE OF THE PRESENT INVENTION.

The sample was collected from the hot-rolled steel sheet after the coiling, and the connection index E value of the pearlite and the area ratio of the bainitic ferrite in which the average value of the crystal orientation difference in the region surrounded by the boundary in which the crystal orientation difference was 15° or more is 0.5° or more and less than 3.0° in the bainitic ferrite were investigated. In addition, the sample was collected from the cold-rolled steel sheet, and the area ratio of the polygonal ferrite, the bainitic ferrite, the residual austenite, and the martensite, the proportion of the residual austenite in which the aspect ratio is 2.0 or less, the length of the long axis is 1.0 μm or less and the length of the short axis is 1.0 μm or less, in the residual austenite, the proportion of the bainitic ferrite in which the aspect ratio is 1.7 or less and the average value of the crystal orientation difference in the region surrounded by the boundary in which the crystal orientation difference is 15° or more is 0.5° or more and less than 3.0°, in the bainitic ferrite, and the connection index D value of the martensite, the bainitic ferrite, and the residual austenite, in the metallographic structure, were evaluated. In addition, as the mechanical properties of the cold-rolled steel sheet, the 0.2% proof stress, the tensile strength, the elongation, the hole expansion ratio, and the punching fatigue properties were evaluated by the following method.

The evaluation related to the metallographic structure was performed by the above-described method.

With respect to the 0.2% proof stress, the tensile strength, and the elongation, the JIS No. 5 test piece was collected at a right angle in the rolling direction of the steel sheet, the tension test is performed conforming to JIS Z 2242, and the 0.2% proof stress (YP), the tensile strength (TS), and the total elongation (EI) were measured. A hole expansion ratio (λ) was evaluated according to a hole expansion test described in Japanese Industrial Standard JISZ2256.

In addition, the punching fatigue properties were evaluated by the following method. In other words, a test piece in which the width of a parallel portion is 20 mm, the length is 40 mm, and the entire length including a grip portion is 220 mm is prepared such that the stress loading direction and the rolling direction are parallel to each other, and a hole of 10 mm in diameter at the center of the parallel portion is punched under the condition that clearance is 12.5%. Furthermore, by repeatedly giving a tensile stress that is 40% of tensile strength of each sample evaluated by JIS No. 5 test piece to the test piece by pulsating, the number of repetitions until the breaking occurs was evaluated. In addition, in a case where the number of repetitions exceeds $10^5$, it was determined that the punching fatigue properties were sufficient.

The result is illustrated in Tables 2-1 to 3-20.

(A) to (C) in Tables 2-1 to 3-20 are structures of the annealed sheet, and (D) to (E) are structures of the hot-rolled steel sheet. In addition, (A) indicates "proportion (%) of the residual austenite in which the aspect ratio is 2.0 or less, the length of the long axis is 1.0 μm or more, and the length of the short axis is 1.0 μm or less in the residual austenite", (B) indicates "proportion (%) of the bainitic ferrite in which the aspect ratio is 1.7 or less and the average value of the crystal orientation difference in the region surrounded by the boundary in which the crystal orientation difference is 15° or more is 0.5° or more and less than 3.0° in the bainitic ferrite, (C) indicates "connection index D value of the martensite, the bainitic ferrite, and the residual austenite", (D) indicates "area ratio (%) of the bainitic ferrite in which the average value of the crystal orientation difference in the region surrounded by the boundary in which the crystal orientation difference is 15° or more is 0.5° or more and less than 3.0° in the bainitic ferrite", and (E) indicates "connection index E value of pearlite".

As is ascertained from Tables 1-1 to 3-20, in the example of the present invention, the cold-rolled steel sheet has properties in which the tensile strength is 980 MPa or more, the 0.2% proof stress is 600 MPa or more, the total elongation is 21.0% or more, and the hole expansibility is 30.0% or more. In addition, the number of repetitions until the breaking occurs is $1.0\times10^5$ (1.0E+05 shown in Table) or more, and the punching fatigue properties are excellent.

Meanwhile, in a comparative example in which any one of the composition, the structure, and the manufacturing method is out of the range of the present invention, any one or more of the mechanical properties do not achieve the target value.

However, the manufacturing Nos. AR-3, P-4, V-4, and BF-4 are examples in which the preferable mechanical properties are obtained, but generation of defects on the surface of the steel sheet and breaking of the steel sheet in a furnace are caused, and productivity deteriorates since the manufacturing methods are not preferable.

In addition, for example, the manufacturing No. Q-2 and the manufacturing No. AN-2 are examples in which a first cooling rate is excessively fast, the structure in the sheet thickness direction becomes non-uniform because the proportion of the martensite exceeds 10% in a range from the surface layer to 200 μm from the surface layer in the sheet thickness direction, and the formability deteriorates. In addition, the manufacturing No. R-2 and the manufacturing No. AX-2 are examples in which the cumulative rolling reduction in the cold rolling is low, the austenite becomes the duplex grain when the holding is performed at the annealing temperature, and as a result, the coarse ferrite that exceeds 15 μm is yielded in advance of other fine ferrite which is less than 5 μm when the ferrite becomes the duplex grain and the tensile deformation is performed, and the total elongation deteriorates since micro plastic instability is caused. In addition, the manufacturing No. T-2 and the manufacturing No. AU-2 are examples in which the average carbon concentration in the residual austenite was less than 0.5%, the stability with respect to the processing deteriorated, and the hole expansibility deteriorated, since the annealing time is short and the dissolution of the carbide to the austenite was not sufficient. In addition, the manufacturing No. X-2 and the manufacturing No. BA-4 are examples in which the yield strength deteriorates without refining of the structure after the annealing since the holding time is short and the area ratio of the bainitic ferrite in which the average value of the crystal orientation difference in the region surrounded by the boundary in which the crystal orientation difference is 15° or more is 0.5° or more and less than 3.0° in the bainitic ferrite during the hot rolling decreases. In addition, the manufacturing No. BD-2 and the manufacturing No. F-3 are examples in which the total elongation and the hole expansibility deteriorate since the cumulative rolling reduction at 1000 to 1150° C. is low and the coarse ferrite that exceeds 15 μm is formed in a shape of a band at the sheet thickness ¼ position of the cold-rolled steel sheet after the annealing by forming the austenite grain that exceeds 250 μm at the sheet thickness ¼ position of the material in the rough rolling. In addition, the manufacturing No. L-2 and BH-3 are examples in which the total elongation and the hole expansibility deteriorate since the finish rolling temperature is low, the grain of the austenite at the sheet thickness ¼ position is coarsened after the finish rolling, and the coarse ferrite that exceeds 15 μm is formed in a shape of a band at the sheet thickness ¼ position of the cold rolling steel sheet after the annealing.

Furthermore, regarding the examples of the present invention, the proportion of the martensite within the range of 200 μm from the surface layer is less than 10%, the ferrite grain size is 15 μm or less, and the average carbon concentration in the residual austenite is 0.5% or more.

INDUSTRIAL APPLICABILITY

According to the present invention, it is possible to provide a high-strength cold-rolled steel sheet which is appropriate as a structure member of a vehicle or the like and in which the tensile strength is 980 MPa or more, the 0.2% proof stress is 600 MPa or more, and the punching fatigue properties, the elongation, and the hole expansibility are excellent, and the method of manufacturing the same.

The invention claimed is:

1. A cold-rolled steel sheet, comprising, as a chemical composition, in % by mass:

C: 0.100% or more and less than 0.500%;
Si: 0.8% or more and less than 4.0%;
Mn: 1.0% or more and less than 4.0%;
P: less than 0.015%;
S: less than 0.0500%;
N: less than 0.0100%;
Al: less than 2.000%;
Ti: 0.020% or more and less than 0.150%;
Nb: 0% or more and less than 0.200%;
V: 0% or more and less than 0.500%;
B: 0% or more and less than 0.0030%;
Mo: 0% or more and less than 0.500%;
Cr: 0% or more and less than 2.000%;
Mg: 0% or more and less than 0.0400%;
Rem: 0% or more and less than 0.0400%;
Ca: 0% or more and less than 0.0400%; and
a remainder of Fe and impurities, wherein the total amount of Si and Al is 1.000% or more, wherein a metallographic structure contains 40.0% or more and less than 60.0% of a polygonal ferrite, 30.0% or more of a bainitic ferrite, 10.0% to 25.0% of a residual austenite, and 15.0% or less of a martensite, by an area ratio, wherein, in the residual austenite, a proportion of the residual austenite in which an aspect ratio is 2.0 or less, a length of a long axis is 1.0 μm or less, and a length of a short axis is 1.0 μm or less, is 80.0% or more, wherein, in the bainitic ferrite, a proportion of the bainitic ferrite in which an aspect ratio is 1.7 or less and an average value of a crystal orientation difference in a region surrounded by a boundary in which a crystal orientation difference is 15° or more is 0.5° or more and less than 3.0°, is 80.0% or more, wherein a connection index D value of the martensite, the bainitic ferrite, and the residual austenite is 0.70 or less, and wherein a tensile strength is 980 MPa or more, a 0.2% proof stress is 600 MPa or more, a total elongation is 21.0% or more, and a hole expansion ratio is 30.0% or more.

2. The cold-rolled steel sheet according to claim 1, wherein the connection index D value is 0.50 or less and the hole expansion ratio is 50.0% or more.

3. The cold-rolled steel sheet according to claim 1 or 2, comprising, as the chemical composition, in % by mass:

one or two or more of

Nb: 0.005% or more and less than 0.200%;

V: 0.010% or more and less than 0.500%;

B: 0.0001% or more and less than 0.0030%;

Mo: 0.010% or more and less than 0.500%;

Cr: 0.010% or more and less than 2.000%;

Mg: 0.0005% or more and less than 0.0400%;

Rem: 0.0005% or more and less than 0.0400%; and

Ca: 0.0005% or more and less than 0.0400%.

4. A hot-rolled steel sheet which is used for manufacturing the cold-rolled steel sheet according to claim 1 or 2, comprising, as a chemical composition, in % by mass:

C: 0.100% or more and less than 0.500%;

Si: 0.8% or more and less than 4.0%;

Mn: 1.0% or more and less than 4.0%;

P: less than 0.015%;

S: less than 0.0500%;

N: less than 0.0100%;

Al: less than 2.000%;

Ti: 0.020% or more and less than 0.150%;

Nb: 0% or more and less than 0.200%;

V: 0% or more and less than 0.500%;

B: 0% or more and less than 0.0030%;

Mo: 0% or more and less than 0.500%;

Cr: 0% or more and less than 2.000%;

Mg: 0% or more and less than 0.0400%;

Rem: 0% or more and less than 0.0400%;

Ca: 0% or more and less than 0.0400%; and a remainder of Fe and impurities, wherein the total amount of Si and Al is 1.000% or more, wherein a metallographic structure contains a bainitic ferrite, wherein, in the bainitic ferrite, an area ratio of the bainitic ferrite in which an average value of a crystal orientation difference in a region surrounded by a boundary in which a crystal orientation difference is 15° or more is 0.5° or more and less than 3.0°, is 80.0% or more, and wherein a connection index E value of pearlite is 0.40 or less.

5. A method of manufacturing a cold-rolled steel sheet according to claim 1, the method comprising:

casting a steel ingot or a slab including, as a chemical composition, C: 0.100% or more and less than 0.500%, Si: 0.8% or more and less than 4.0%, Mn: 1.0% or more and less than 4.0%, P: less than 0.015%, S: less than 0.0500%, N: less than 0.0100%, Al: less than 2.000%, Ti: 0.020% or more and less than 0.150%, Nb: 0% or more and less than 0.200%, V: 0% or more and less than 0.500%, B: 0% or more and less than 0.0030%, Mo: 0% or more and less than 0.500%, Cr: 0% or more and less than 2.000%, Mg: 0% or more and less than 0.0400%, Rem: 0% or more and less than 0.0400%, Ca: 0% or more and less than 0.0400%, and a remainder of Fe and impurities, in which the total amount of Si and Al is 1.000% or more;

hot rolling including a rough rolling in which the steel ingot or the slab is reduced at 40% or more in total in a first temperature range of 1000° C. to 1150° C., and a finish rolling in which the steel ingot or the slab is reduced at 50% or more in total in a second temperature range of T1° C. to T1+150° C., and the hot rolling being finished at T1−40° C. or more to obtain a hot-rolled steel sheet when a temperature determined by compositions specified in the following Equation (1) is set to be T1;

first cooling of cooling the hot-rolled steel sheet after the hot rolling at a cooling rate of 20° C./s to 80° C./s to a third temperature range of 600° C. to 650° C.;

holding the hot-rolled steel sheet after the first cooling for time t seconds to 10.0 seconds determined by the following Equation (2) in the third temperature range of 600° C. to 650° C.;

second cooling of cooling the hot-rolled steel sheet after the holding, to 600° C. or less;

coiling the hot-rolled steel sheet at 600° C. or less so that in a microstructure of the hot-rolled steel sheet after coiling, the connection index E value of the pearlite is 0.40 or less, and in the bainitic ferrite, an area ratio of the bainitic ferrite in which an average value of a crystal orientation difference in a region surrounded by a boundary in which a crystal orientation difference is 15° or more is 0.5° or more and less than 3.0°, is 80.0% or more to obtain the hot-rolled steel sheet;

pickling the hot-rolled steel sheet;

cold rolling the hot-rolled steel sheet after the pickling so that a cumulative rolling reduction is 40.0% to 80.0% to obtain a cold-rolled steel sheet;

annealing of holding the cold-rolled steel sheet after the cold rolling for 30 to 600 seconds in a fourth temperature range after raising the temperature to the fourth temperature range of T1−50° C. to 960° C.;

third cooling of cooling the cold-rolled steel sheet after the annealing at a cooling rate of 1.0° C./s to 10.0° C./s to a fifth temperature range of 600° C. to 720° C.; and heat treating of holding the cold-rolled steel sheet for 30 seconds to 600 seconds after cooling the temperature to a sixth temperature range of 150° C. to 500° C. at the cooling rate of 10.0° C./s to 60.0° C./s, $$T1(^\circ\,C.)=920+40\times C^2-80\times C+Si^2+0.5\times Si+0.4\times Mn^2-9\times Mn+10\times Al+200\times N^2-30\times N-15\times Ti \quad \text{Equation (1)}$$

$$t(\text{seconds})=1.6+(10\times C+Mn-20\times Ti)/8 \quad \text{Equation (2)}$$

here, element symbols in the equations indicate the amount of elements in % by mass.

6. The method of manufacturing a cold-rolled steel sheet according to claim 5, wherein the steel sheet is coiled at 100° C. or less in the coiling.

7. The method of manufacturing a cold-rolled steel sheet according to claim 6, comprising:

holding the hot-rolled steel sheet for 10 seconds to 10 hours after raising the temperature to a seventh temperature range of 400° C. to an Al transformation point between the coiling and the pickling.

8. The method of manufacturing a cold-rolled steel sheet according to any one of claims 5 to 7, comprising:

reheating the cold-rolled steel sheet to a temperature range of 150° C. to 500° C. before holding the cold-rolled steel sheet for 1 second or more after cooling the cold-rolled steel sheet to the sixth temperature range in the heat treating.

9. The method of manufacturing a cold-rolled steel sheet according to any one of claims 5 to 7, further comprising:

hot-dip galvanizing the cold-rolled steel sheet after the heat treating.

10. The method of manufacturing a cold-rolled steel sheet according to claim 9, further comprising:

alloying of performing the heat treatment within an eighth temperature range of 450° C. to 600° C. after the hot-dip galvanizing.

11. The method of manufacturing a cold-rolled steel sheet according to claim 8, further comprising:

hot-dip galvanizing the cold-rolled steel sheet after the heat treating.

* * * * *